US007410000B2

(12) United States Patent
Cook et al.

(10) Patent No.: US 7,410,000 B2
(45) Date of Patent: Aug. 12, 2008

(54) MONO-DIAMETER WELLBORE CASING

(75) Inventors: Robert Lance Cook, Katy, TX (US); Lev Ring, Houston, TX (US)

(73) Assignee: Enventure Global Technology, LLC., Houston, TX (US)

( * ) Notice: Subject to any disclaimer, the term of this patent is extended or adjusted under 35 U.S.C. 154(b) by 0 days.

(21) Appl. No.: 11/134,013

(22) Filed: May 20, 2005

(65) Prior Publication Data

US 2005/0236163 A1 Oct. 27, 2005

Related U.S. Application Data

(62) Division of application No. 10/465,835, filed on Jun. 13, 2003, now Pat. No. 7,185,710.

(51) Int. Cl.
*E21B 23/00* (2006.01)

(52) U.S. Cl. ..... 166/380; 166/207; 166/382

(58) Field of Classification Search ..... 166/206, 166/207, 382, 384, 380
See application file for complete search history.

(56) References Cited

U.S. PATENT DOCUMENTS

| | | | |
|---|---|---|---|
| 46,818 | A | 3/1865 | Patterson |
| 331,940 | A | 12/1885 | Bole |
| 332,184 | A | 12/1885 | Bole |
| 341,237 | A | 5/1886 | Healey |
| 519,805 | A | 5/1894 | Bavier |
| 802,880 | A | 10/1905 | Phillips, Jr. |
| 806,156 | A | 12/1905 | Marshall |
| 958,517 | A | 5/1910 | Mettler |
| 984,449 | A | 2/1911 | Stewart |
| 1,166,040 | A | 12/1915 | Burlingham |
| 1,225,005 | A | 5/1917 | Boyd et al. |
| 1,233,888 | A | 7/1917 | Leonard |

(Continued)

FOREIGN PATENT DOCUMENTS

| | | |
|---|---|---|
| AU | 767364 | 2/2004 |

(Continued)

OTHER PUBLICATIONS

International Search Report, Application PCT/IL00/00245, Sep. 18, 2000.

(Continued)

*Primary Examiner*—Hoang Dang
(74) *Attorney, Agent, or Firm*—Conley Rose, P.C.

(57) ABSTRACT

A mono-diameter wellbore casing. A tubular liner and an expansion cone are positioned within a new section of a wellbore with the tubular liner in an overlapping relationship with a pre-existing casing. A hardenable fluidic material is injected into the new section of the wellbore below the level of the expansion cone and into the annular region between the tubular liner and the new section of the wellbore. The inner and outer regions of the tubular liner are then fluidicly isolated. A non hardenable fluidic material is then injected into a portion of an interior region of the tubular liner to pressurize the portion of the interior region of the tubular liner below the expansion cone. The tubular liner is then extruded off of the expansion cone. The overlapping portion of the pre-existing casing and the tubular liner are then radially expanded using an expansion cone.

48 Claims, 15 Drawing Sheets

U.S. PATENT DOCUMENTS

| | | | |
|---|---|---|---|
| 1,358,818 | A | 11/1920 | Bering |
| 1,494,128 | A | 5/1924 | Primrose |
| 1,589,781 | A | 6/1926 | Anderson |
| 1,590,357 | A | 6/1926 | Feisthamel |
| 1,597,212 | A | 8/1926 | Spengler |
| 1,613,461 | A | 1/1927 | Johnson |
| 1,739,932 | A | 12/1929 | Ventresca |
| 1,756,531 | A | 4/1930 | Aldeen et al. |
| 1,880,218 | A | 10/1932 | Simmons |
| 1,952,652 | A | 3/1934 | Brannon |
| 1,981,515 | A | 11/1934 | Price |
| 1,981,525 | A | 11/1934 | Price |
| 2,046,870 | A | 7/1936 | Clasen et al. |
| 2,087,185 | A | 7/1937 | Dillom |
| 2,110,913 | A | 3/1938 | Lowrey |
| 2,122,757 | A | 7/1938 | Scott |
| 2,134,311 | A | 10/1938 | Minor et al. |
| 2,145,168 | A | 1/1939 | Flagg |
| 2,160,263 | A | 5/1939 | Fletcher |
| 2,187,275 | A | 1/1940 | McLennan |
| 2,204,586 | A | 6/1940 | Grau |
| 2,214,226 | A | 9/1940 | English |
| 2,226,804 | A | 12/1940 | Carroll |
| 2,273,017 | A | 2/1942 | Boynton |
| 2,293,938 | A | 8/1942 | Dunn et al. |
| 2,301,495 | A | 11/1942 | Abegg |
| 2,305,282 | A | 12/1942 | Taylor, Jr. et al. |
| 2,371,840 | A | 3/1945 | Otis |
| 2,383,214 | A | 8/1945 | Prout |
| 2,407,552 | A | 9/1946 | Hoesel |
| 2,447,629 | A | 8/1948 | Beissinger et al. |
| 2,481,637 | A | 9/1949 | Yancey |
| 2,500,276 | A | 3/1950 | Church |
| 2,546,295 | A | 3/1951 | Boice |
| 2,583,316 | A | 1/1952 | Bannister |
| 2,609,258 | A | 11/1952 | Taylor, Jr. et al. |
| 2,627,891 | A | 2/1953 | Clark |
| 2,647,847 | A | 8/1953 | Black et al. |
| 2,664,952 | A | 1/1954 | Losey |
| 2,691,418 | A | 10/1954 | Connolly |
| 2,695,449 | A | 11/1954 | Chauvin |
| 2,723,721 | A | 11/1955 | Corsette |
| 2,734,580 | A | 2/1956 | Layne |
| 2,735,485 | A | 2/1956 | Metcalf, Jr. |
| 2,796,134 | A | 6/1957 | Binkley |
| 2,812,025 | A | 11/1957 | Teague et al. |
| 2,877,822 | A | 3/1959 | Buck |
| 2,907,589 | A | 10/1959 | Knox |
| 2,919,741 | A | 1/1960 | Strock et al. |
| 2,929,741 | A | 1/1960 | Strock et al. |
| 3,015,362 | A | 1/1962 | Moosman |
| 3,015,500 | A | 1/1962 | Barnett |
| 3,018,547 | A | 1/1962 | Marskell |
| 3,039,530 | A | 6/1962 | Condra |
| 3,067,801 | A | 12/1962 | Sortor |
| 3,067,819 | A | 12/1962 | Gore |
| 3,068,563 | A | 12/1962 | Reverman |
| 3,104,703 | A | 9/1963 | Rike et al. |
| 3,111,991 | A | 11/1963 | O'Neal |
| 3,167,122 | A | 1/1965 | Lang |
| 3,175,618 | A | 3/1965 | Lang et al. |
| 3,179,168 | A | 4/1965 | Vincent |
| 3,188,816 | A | 6/1965 | Koch |
| 3,191,677 | A | 6/1965 | Kinley |
| 3,191,680 | A | 6/1965 | Vincent |
| 3,203,451 | A | 8/1965 | Vincent |
| 3,203,483 | A | 8/1965 | Vincent |
| 3,209,546 | A | 10/1965 | Lawton |
| 3,210,102 | A | 10/1965 | Joslin |
| 3,233,315 | A | 2/1966 | Levake |
| 3,245,471 | A | 4/1966 | Howard |
| 3,270,817 | A | 9/1966 | Papaila |
| 3,297,092 | A | 1/1967 | Jennings |
| 3,326,293 | A | 6/1967 | Skipper |
| 3,331,439 | A | 7/1967 | Sanford |
| 3,343,252 | A | 9/1967 | Reesor |
| 3,353,599 | A | 11/1967 | Swift |
| 3,354,955 | A | 11/1967 | Berry |
| 3,358,760 | A | 12/1967 | Blagg |
| 3,358,769 | A | 12/1967 | Berry |
| 3,364,993 | A | 1/1968 | Skipper |
| 3,371,717 | A | 3/1968 | Chenoweth |
| 3,412,565 | A | 11/1968 | Lindsey et al. |
| 3,419,080 | A | 12/1968 | Lebourg |
| 3,422,902 | A | 1/1969 | Bouchillon |
| 3,424,244 | A | 1/1969 | Kinley |
| 3,427,707 | A | 2/1969 | Nowosadko |
| 3,477,506 | A | 11/1969 | Malone |
| 3,489,220 | A | 1/1970 | Kinley |
| 3,498,376 | A | 3/1970 | Sizer et al. |
| 3,504,515 | A | 4/1970 | Reardon |
| 3,520,049 | A | 7/1970 | Lysenko et al. |
| 3,528,498 | A | 9/1970 | Carothers |
| 3,532,174 | A | 10/1970 | Diamantides et al. |
| 3,568,773 | A | 3/1971 | Chancellor |
| 3,578,081 | A | 5/1971 | Bodine |
| 3,579,805 | A | 5/1971 | Kast |
| 3,605,887 | A | 9/1971 | Lambie |
| 3,631,926 | A | 1/1972 | Young |
| 3,665,591 | A | 5/1972 | Kowal |
| 3,667,547 | A | 6/1972 | Ahlstone |
| 3,669,190 | A | 6/1972 | Sizer et al. |
| 3,682,256 | A | 8/1972 | Stuart |
| 3,687,196 | A | 8/1972 | Mullins |
| 3,691,624 | A | 9/1972 | Kinley |
| 3,693,387 | A | 9/1972 | Blackburn |
| 3,693,717 | A | 9/1972 | Wuenschel |
| 3,704,730 | A | 12/1972 | Witzig |
| 3,709,306 | A | 1/1973 | Curington |
| 3,711,123 | A | 1/1973 | Arnold |
| 3,712,376 | A | 1/1973 | Owen et al. |
| 3,746,068 | A | 7/1973 | Deckert et al. |
| 3,746,091 | A | 7/1973 | Owen et al. |
| 3,746,092 | A | 7/1973 | Land |
| 3,764,168 | A | 10/1973 | Kisling, III et al. |
| 3,776,307 | A | 12/1973 | Young |
| 3,779,025 | A | 12/1973 | Godley et al. |
| 3,780,562 | A | 12/1973 | Kinley |
| 3,781,966 | A | 1/1974 | Lieberman |
| 3,785,193 | A | 1/1974 | Kinely et al. |
| 3,789,648 | A | 2/1974 | Ames |
| 3,797,259 | A | 3/1974 | Kammerer, Jr. |
| 3,805,567 | A | 4/1974 | Agius-Sincero |
| 3,812,912 | A | 5/1974 | Wuenschel |
| 3,818,734 | A | 6/1974 | Bateman |
| 3,834,742 | A | 9/1974 | McPhillips |
| 3,866,954 | A | 2/1975 | Slator et al. |
| 3,885,298 | A | 5/1975 | Pogonowski |
| 3,887,006 | A | 6/1975 | Pitts |
| 3,893,718 | A | 7/1975 | Powell |
| 3,898,163 | A | 8/1975 | Mott |
| 3,915,478 | A | 10/1975 | Al et al. |
| 3,935,910 | A | 2/1976 | Gaudy et al. |
| 3,942,824 | A | 3/1976 | Sable |
| 3,945,444 | A | 3/1976 | Knudson |
| 3,948,321 | A | 4/1976 | Owen et al. |
| 3,970,336 | A | 7/1976 | O'Sickey et al. |
| 3,977,076 | A | 8/1976 | Vieira et al. |
| 3,977,473 | A | 8/1976 | Page, Jr. |
| 3,989,280 | A | 11/1976 | Schwarz |
| 3,997,193 | A | 12/1976 | Tsuda et al. |
| 3,999,605 | A | 12/1976 | Braddick |
| 4,003,433 | A | 1/1977 | Goins |
| 4,011,652 | A | 3/1977 | Black |

4,019,579 A 4/1977 Thuse
4,026,583 A 5/1977 Gottlieb
4,047,568 A 9/1977 Aulenbacher
4,053,247 A 10/1977 Marsh, Jr.
4,068,711 A 1/1978 Aulenbacher
4,069,573 A 1/1978 Rogers, Jr. et al.
4,076,287 A 2/1978 Bill et al.
4,096,913 A 6/1978 Kenneday et al.
4,098,334 A 7/1978 Crowe
4,118,954 A 10/1978 Jenkins
4,125,937 A 11/1978 Brown et al.
4,152,821 A 5/1979 Scott
4,168,747 A 9/1979 Youmans
4,190,108 A 2/1980 Webber
4,204,312 A 5/1980 Tooker
4,205,422 A 6/1980 Hardwick
4,226,449 A 10/1980 Cole
4,253,687 A 3/1981 Maples
4,257,155 A 3/1981 Hunter
4,274,665 A 6/1981 Marsh, Jr.
RE30,802 E 11/1981 Rogers, Jr.
4,304,428 A 12/1981 Grigorian et al.
4,328,983 A 5/1982 Gibson
4,355,664 A 10/1982 Cook et al.
4,359,889 A 11/1982 Kelly
4,363,358 A 12/1982 Ellis
4,366,971 A 1/1983 Lula
4,368,571 A 1/1983 Cooper, Jr.
4,379,471 A 4/1983 Kuenzel
4,380,347 A 4/1983 Sable
4,384,625 A 5/1983 Roper et al.
4,388,752 A 6/1983 Vinciguerra et al.
4,391,325 A 7/1983 Baker et al.
4,393,931 A 7/1983 Muse et al.
4,396,061 A 8/1983 Tamplen et al.
4,401,325 A 8/1983 Tsuchiya et al.
4,402,372 A 9/1983 Cherrington
4,407,681 A 10/1983 Ina et al.
4,411,435 A 10/1983 McStravick
4,413,395 A 11/1983 Garnier
4,413,682 A 11/1983 Callihan et al.
4,420,866 A 12/1983 Mueller
4,421,169 A 12/1983 Dearth et al.
4,422,317 A 12/1983 Mueller
4,422,507 A 12/1983 Reimert
4,423,889 A 1/1984 Weise
4,423,986 A 1/1984 Skogberg
4,424,865 A 1/1984 Payton, Jr.
4,429,741 A 2/1984 Hyland
4,440,233 A 4/1984 Baugh et al.
4,442,586 A 4/1984 Ridenour
4,444,250 A 4/1984 Keithahn et al.
4,449,713 A 5/1984 Ishido et al.
4,462,471 A 7/1984 Hipp
4,467,630 A 8/1984 Kelly
4,468,309 A 8/1984 White
4,469,356 A 9/1984 Duret et al.
4,473,245 A 9/1984 Raulins et al.
4,483,399 A 11/1984 Colgate
4,485,847 A 12/1984 Wentzell
4,491,001 A 1/1985 Yoshida
4,501,327 A 2/1985 Retz
4,505,017 A 3/1985 Schukei
4,505,987 A 3/1985 Yamada et al.
4,507,019 A 3/1985 Thompson
4,508,129 A 4/1985 Brown
4,511,289 A 4/1985 Herron
4,519,456 A 5/1985 Cochran
4,526,232 A 7/1985 Hughson et al.
4,526,839 A 7/1985 Herman et al.
4,530,231 A 7/1985 Main
4,541,655 A 9/1985 Hunter
4,550,782 A 11/1985 Lawson
4,553,776 A 11/1985 Dodd
4,573,248 A 3/1986 Hackett
4,573,540 A 3/1986 Dellinger et al.
4,576,386 A 3/1986 Benson et al.
4,581,817 A 4/1986 Kelly
4,590,227 A 5/1986 Nakamura et al.
4,590,995 A 5/1986 Evans
4,592,577 A 6/1986 Ayres et al.
4,595,063 A 6/1986 Jennings et al.
4,601,343 A 7/1986 Lindsey, Jr. et al.
4,605,063 A 8/1986 Ross
4,611,662 A 9/1986 Harrington
4,614,233 A 9/1986 Menard
4,627,488 A 12/1986 Szarka
4,629,218 A 12/1986 Dubois
4,630,849 A 12/1986 Fukui et al.
4,632,944 A 12/1986 Thompson
4,634,317 A 1/1987 Skogberg et al.
4,635,333 A 1/1987 Finch
4,637,436 A 1/1987 Stewart, Jr. et al.
4,646,787 A 3/1987 Rush et al.
4,649,492 A 3/1987 Sinha et al.
4,651,831 A 3/1987 Baugh et al.
4,651,836 A 3/1987 Richards
4,656,779 A 4/1987 Fedeli
4,660,863 A 4/1987 Bailey et al.
4,662,446 A 5/1987 Brisco et al.
4,669,541 A 6/1987 Bissonnette
4,674,572 A 6/1987 Gallus
4,682,797 A 7/1987 Hildner
4,685,191 A 8/1987 Mueller et al.
4,685,834 A 8/1987 Jordan
4,693,498 A 9/1987 Baugh et al.
4,703,802 A 11/1987 Bryan et al.
4,711,474 A 12/1987 Patrick
4,714,117 A 12/1987 Dech
4,730,851 A 3/1988 Watts
4,735,444 A 4/1988 Skipper
4,739,654 A 4/1988 Pilkington et al.
4,739,916 A 4/1988 Ayres et al.
4,751,836 A 6/1988 Breese
4,754,781 A 7/1988 Putter
4,758,025 A 7/1988 Frick
4,776,394 A 10/1988 Lynde et al.
4,778,088 A 10/1988 Miller
4,779,445 A 10/1988 Rabe
4,793,382 A 12/1988 Szalvay
4,796,668 A 1/1989 Depret
4,817,710 A 4/1989 Edwards et al.
4,817,712 A 4/1989 Bodine
4,817,716 A 4/1989 Taylor et al.
4,826,347 A 5/1989 Baril et al.
4,827,594 A 5/1989 Cartry et al.
4,828,033 A 5/1989 Frison
4,830,109 A 5/1989 Wedel
4,832,382 A 5/1989 Kapgan
4,836,579 A 6/1989 Wester et al.
4,842,082 A 6/1989 Springer
4,848,459 A 7/1989 Blackwell et al.
4,854,338 A 8/1989 Grantham
4,856,592 A 8/1989 Van Bilderbeek et al.
4,865,127 A 9/1989 Koster
4,871,199 A 10/1989 Ridenour et al.
4,872,253 A 10/1989 Carstensen
4,887,646 A 12/1989 Groves
4,888,975 A 12/1989 Soward et al.
4,892,337 A 1/1990 Gunderson et al.
4,893,658 A 1/1990 Kimura et al.
4,904,136 A 2/1990 Matsumoto
4,907,828 A 3/1990 Change
4,911,237 A 3/1990 Melenyzer
4,913,758 A 4/1990 Koster
4,915,177 A 4/1990 Claycomb 4,915,426 A 4/1990 Skipper
4,917,409 A 4/1990 Reeves
4,919,989 A 4/1990 Colangelo
4,930,573 A 6/1990 Lane et al.
4,934,038 A 6/1990 Caudill
4,934,312 A 6/1990 Koster et al.
4,938,291 A 7/1990 Lynde et al.
4,941,512 A 7/1990 McParland
4,941,532 A 7/1990 Hurt et al.
4,942,925 A 7/1990 Themig
4,942,926 A 7/1990 Lessi
4,949,745 A 8/1990 McKeon
4,958,691 A 9/1990 Hipp
4,968,184 A 11/1990 Reid
4,971,152 A 11/1990 Koster et al.
4,976,322 A 12/1990 Abdrakhmanov et al.
4,981,250 A 1/1991 Persson
4,995,464 A 2/1991 Watkins et al.
5,014,779 A 5/1991 Meling et al.
5,015,017 A 5/1991 Geary
5,026,074 A 6/1991 Hoes et al.
5,031,370 A 7/1991 Jewett
5,031,699 A 7/1991 Artynov et al.
5,040,283 A 8/1991 Pelgrom
5,044,676 A 9/1991 Burton et al.
5,052,483 A 10/1991 Hudson
5,059,043 A 10/1991 Kuhne
5,064,004 A 11/1991 Lundel
5,074,355 A 12/1991 Lennon
5,079,837 A 1/1992 Vanselow
5,083,608 A 1/1992 Abdrakhmanov et al.
5,093,015 A 3/1992 Oldiges
5,095,991 A 3/1992 Milberger
5,101,653 A 4/1992 Hermes et al.
5,105,888 A 4/1992 Pollock et al.
5,107,221 A 4/1992 N'Guyen et al.
5,119,661 A 6/1992 Abdrakhmanov et al.
5,134,891 A 8/1992 Canevet
5,150,755 A 9/1992 Cassel et al.
5,156,043 A 10/1992 Ose
5,156,213 A 10/1992 George et al.
5,156,223 A 10/1992 Hipp
5,174,376 A 12/1992 Singeetham
5,181,571 A 1/1993 Mueller et al.
5,195,583 A 3/1993 Toon et al.
5,197,553 A 3/1993 Leturno
5,209,600 A 5/1993 Koster
5,226,492 A 7/1993 Solaeche et al.
5,242,017 A 9/1993 Hailey
5,253,713 A 10/1993 Gregg et al.
5,265,675 A 11/1993 Hearn et al.
5,275,242 A 1/1994 Payne
5,282,508 A 2/1994 Ellingsen et al.
5,282,652 A 2/1994 Werner
5,286,393 A 2/1994 Oldiges et al.
5,297,629 A 3/1994 Barrington et al.
5,306,101 A 4/1994 Rockower et al.
5,309,621 A 5/1994 O'Donnell et al.
5,314,014 A 5/1994 Tucker
5,314,209 A 5/1994 Kuhne
5,318,122 A 6/1994 Murray et al.
5,318,131 A 6/1994 Baker
5,325,923 A 7/1994 Surjaatmadja et al.
5,326,137 A 7/1994 Lorenz et al.
5,327,964 A 7/1994 O'Donnell et al.
5,330,850 A 7/1994 Suzuki et al.
5,332,038 A 7/1994 Tapp et al.
5,332,049 A 7/1994 Tew
5,333,692 A 8/1994 Baugh et al.
5,335,736 A 8/1994 Windsor
5,337,808 A 8/1994 Graham
5,337,823 A 8/1994 Nobileau
5,337,827 A 8/1994 Hromas et al.
5,339,894 A 8/1994 Stotler
5,343,949 A 9/1994 Ross et al.
5,346,007 A 9/1994 Dillon et al.
5,348,087 A 9/1994 Williamson, Jr.
5,348,093 A 9/1994 Wood et al.
5,348,095 A 9/1994 Worrall et al.
5,348,668 A 9/1994 Oldiges et al.
5,351,752 A 10/1994 Wood et al.
5,360,239 A 11/1994 Klementich
5,360,292 A 11/1994 Allen et al.
5,361,843 A 11/1994 Shy et al.
5,366,010 A 11/1994 Zwart
5,366,012 A 11/1994 Lohbeck
5,368,075 A 11/1994 Bäro et al.
5,370,425 A 12/1994 Dougherty et al.
5,375,661 A 12/1994 Daneshy et al.
5,377,753 A 1/1995 Haberman et al.
5,388,648 A 2/1995 Jordan, Jr.
5,390,735 A 2/1995 Williamson, Jr.
5,390,742 A 2/1995 Dines et al.
5,396,957 A 3/1995 Surjaatmadja et al.
5,400,827 A 3/1995 Baro et al.
5,405,171 A 4/1995 Allen et al.
5,413,180 A 5/1995 Ross et al.
5,425,559 A 6/1995 Nobileau
5,426,130 A 6/1995 Thurder et al.
5,431,831 A 7/1995 Vincent
5,435,395 A 7/1995 Connell
5,439,320 A 8/1995 Abrams
5,447,201 A 9/1995 Mohn
5,454,419 A 10/1995 Vloedman
5,456,319 A 10/1995 Schmidt et al.
5,458,194 A 10/1995 Brooks
5,462,120 A 10/1995 Gondouin
5,467,822 A 11/1995 Zwart
5,472,055 A 12/1995 Simson et al.
5,474,334 A 12/1995 Eppink
5,492,173 A 2/1996 Kilgore et al.
5,494,106 A 2/1996 Gueguen et al.
5,498,809 A 3/1996 Emert et al.
5,507,343 A 4/1996 Carlton et al.
5,511,620 A 4/1996 Baugh et al.
5,513,703 A 5/1996 Mills et al.
5,524,937 A 6/1996 Sides, III et al.
5,535,824 A 7/1996 Hudson
5,536,422 A 7/1996 Oldiges et al.
5,540,281 A 7/1996 Round
5,554,244 A 9/1996 Ruggles et al.
5,566,772 A 10/1996 Coone et al.
5,576,485 A 11/1996 Serata
5,584,512 A 12/1996 Carstensen
5,606,792 A 3/1997 Schafer
5,611,399 A 3/1997 Richard et al.
5,613,557 A 3/1997 Blount et al.
5,617,918 A 4/1997 Cooksey et al.
5,642,560 A 7/1997 Tabuchi et al.
5,642,781 A 7/1997 Richard
5,662,180 A 9/1997 Coffman et al.
5,664,327 A 9/1997 Swars
5,667,011 A 9/1997 Gill et al.
5,667,252 A 9/1997 Schafer et al.
5,678,609 A 10/1997 Washburn
5,685,369 A 11/1997 Ellis et al.
5,689,871 A 11/1997 Carstensen
5,695,008 A 12/1997 Bertet et al.
5,695,009 A 12/1997 Hipp
5,697,449 A 12/1997 Hennig et al.
5,718,288 A 2/1998 Bertet et al.
5,738,146 A 4/1998 Abe
5,743,335 A 4/1998 Bussear
5,749,419 A 5/1998 Coronado et al.
5,749,585 A 5/1998 Lembcke
5,755,895 A 5/1998 Tamehiro et al.

5,775,422 A 7/1998 Wong et al.
5,785,120 A 7/1998 Smalley et al.
5,787,933 A 8/1998 Russ et al.
5,791,409 A 8/1998 Flanders
5,791,419 A 8/1998 Valisalo
5,794,702 A 8/1998 Nobileau
5,794,840 A 8/1998 Hohl et al.
5,797,454 A 8/1998 Hipp
5,829,520 A 11/1998 Johnson
5,829,524 A 11/1998 Flanders et al.
5,833,001 A 11/1998 Song et al.
5,845,945 A 12/1998 Carstensen
5,849,188 A 12/1998 Voll et al.
5,857,524 A 1/1999 Harris
5,862,866 A 1/1999 Springer
5,875,851 A 3/1999 Vick, Jr. et al.
5,885,941 A 3/1999 Sateva et al.
5,887,476 A 3/1999 Damsohn et al.
5,895,079 A 4/1999 Carstensen et al.
5,899,268 A 5/1999 Lynde et al.
5,901,789 A 5/1999 Donnelly et al.
5,918,677 A 7/1999 Head
5,924,745 A 7/1999 Campbell
5,931,511 A 8/1999 DeLange et al.
5,944,100 A 8/1999 Hipp
5,944,107 A 8/1999 Ohmer
5,944,108 A 8/1999 Baugh et al.
5,951,207 A 9/1999 Chen
5,957,195 A 9/1999 Bailey et al.
5,971,443 A 10/1999 Noel et al.
5,975,587 A 11/1999 Wood et al.
5,979,560 A 11/1999 Nobileau
5,984,369 A 11/1999 Crook et al.
5,984,568 A 11/1999 Lohbeck
5,985,053 A 11/1999 Hara et al.
6,012,521 A 1/2000 Zunkel et al.
6,012,522 A 1/2000 Donnelly et al.
6,012,523 A 1/2000 Campbell et al.
6,012,874 A 1/2000 Groneck et al.
6,013,724 A 1/2000 Mizutani et al.
6,015,012 A 1/2000 Reddick
6,017,168 A 1/2000 Fraser et al.
6,021,850 A 2/2000 Wood et al.
6,029,748 A 2/2000 Forsyth et al.
6,035,954 A 3/2000 Hipp
6,044,906 A 4/2000 Saltel
6,047,505 A 4/2000 Willow
6,047,774 A 4/2000 Allen
6,050,341 A 4/2000 Metcalf
6,050,346 A 4/2000 Hipp
6,056,059 A 5/2000 Ohmer
6,056,324 A 5/2000 Reimert et al.
6,062,324 A 5/2000 Hipp
6,065,500 A 5/2000 Metcalfe
6,070,671 A * 6/2000 Cumming et al. ..... 166/381
6,073,692 A 6/2000 Wood et al.
6,074,133 A 6/2000 Kelsey
6,078,031 A 6/2000 Bliault et al.
6,079,495 A 6/2000 Ohmer
6,085,838 A 7/2000 Vercaemer et al.
6,089,320 A 7/2000 LaGrange
6,098,717 A 8/2000 Bailey et al.
6,102,119 A 8/2000 Raines
6,109,355 A 8/2000 Reid
6,112,818 A 9/2000 Campbell
6,131,265 A 10/2000 Bird
6,135,208 A 10/2000 Gano et al.
6,138,761 A 10/2000 Freeman et al.
6,142,230 A 11/2000 Smalley et al.
6,148,915 A 11/2000 Mullen et al.
6,158,963 A 12/2000 Hollis
6,167,970 B1 1/2001 Stout
6,182,775 B1 2/2001 Hipp
6,189,616 B1 2/2001 Gano et al.
6,196,336 B1 3/2001 Fincher et al.
6,226,855 B1 5/2001 Maine
6,230,843 B1 5/2001 Geiss
6,231,086 B1 5/2001 Tierling
6,250,385 B1 6/2001 Montaron
6,263,966 B1 7/2001 Haut et al.
6,263,968 B1 7/2001 Freeman et al.
6,263,972 B1 7/2001 Richard et al.
6,267,181 B1 7/2001 Rhein-Knudsen et al.
6,273,634 B1 8/2001 Lohbeck
6,275,556 B1 8/2001 Kinney et al.
6,283,211 B1 9/2001 Vloedman
6,286,614 B1 9/2001 Gano et al.
6,315,043 B1 11/2001 Farrant et al.
6,318,457 B1 11/2001 Den Boer et al.
6,318,465 B1 11/2001 Coon et al.
6,322,109 B1 11/2001 Campbell et al.
6,325,148 B1 12/2001 Trahan et al.
6,328,113 B1 12/2001 Cook
6,334,351 B1 1/2002 Tsuchiya
6,343,495 B1 2/2002 Cheppe et al.
6,343,657 B1 2/2002 Baugh et al.
6,345,373 B1 2/2002 Chakradhar et al.
6,345,431 B1 2/2002 Greig
6,352,112 B1 3/2002 Mills
6,354,373 B1 3/2002 Vercaemer et al.
6,390,720 B1 5/2002 LeBegue et al.
6,405,761 B1 6/2002 Shimizu et al.
6,406,063 B1 6/2002 Pfeiffer
6,409,175 B1 6/2002 Evans et al.
6,419,025 B1 7/2002 Lohbeck et al.
6,419,026 B1 7/2002 MacKenzie et al.
6,419,033 B1 7/2002 Hahn et al.
6,419,147 B1 7/2002 Daniel
6,425,444 B1 7/2002 Metcalfe et al.
6,431,277 B1 8/2002 Cox et al.
6,446,323 B1 9/2002 Metcalfe et al.
6,446,724 B2 9/2002 Baugh et al.
6,450,261 B1 9/2002 Baugh
6,454,013 B1 9/2002 Metcalfe
6,457,532 B1 10/2002 Simpson
6,457,533 B1 10/2002 Metcalfe
6,457,749 B1 10/2002 Heijnen
6,460,615 B1 10/2002 Heijnen
6,461,999 B1 10/2002 Fanta et al.
6,464,008 B1 10/2002 Roddy et al.
6,464,014 B1 10/2002 Bernat
6,470,966 B2 10/2002 Cook et al.
6,470,996 B1 10/2002 Kyle et al.
6,478,091 B1 11/2002 Gano
6,478,092 B2 11/2002 Voll et al.
6,491,108 B1 12/2002 Slup et al.
6,497,289 B1 12/2002 Cook et al.
6,516,887 B2 2/2003 Nguyen et al.
6,517,126 B1 2/2003 Peterson et al.
6,527,049 B2 3/2003 Metcalfe et al.
6,543,545 B1 4/2003 Chatterji et al.
6,543,552 B1 4/2003 Metcalfe et al.
6,550,539 B2 4/2003 Maguire et al.
6,550,821 B2 4/2003 DeLange et al.
6,557,460 B2 5/2003 Hester
6,557,640 B1 5/2003 Cook et al.
6,561,227 B2 5/2003 Cook et al.
6,561,279 B2 5/2003 MacKenzie et al.
6,564,875 B1 5/2003 Bullock
6,568,471 B1 5/2003 Cook et al.
6,568,488 B2 5/2003 Wentworth et al.
6,575,240 B1 6/2003 Cook et al.
6,575,250 B1 6/2003 Wijsman
6,578,630 B2 6/2003 Simpson
6,585,053 B2 7/2003 Coon
6,591,905 B2 7/2003 Coon 6,598,677 B1 7/2003 Baugh et al.
6,598,678 B1 7/2003 Simpson
6,604,763 B1 8/2003 Cook et al.
6,607,220 B2 8/2003 Sivley, IV
6,619,696 B2 9/2003 Baugh et al.
6,622,797 B2 9/2003 Sivley, IV
6,629,567 B2 10/2003 Lauritzen et al.
6,631,759 B2 10/2003 Cook et al.
6,631,760 B2 10/2003 Cook et al.
6,631,765 B2 10/2003 Baugh et al.
6,631,769 B2 10/2003 Cook et al.
6,634,431 B2 10/2003 Cook et al.
6,640,895 B2 11/2003 Murray
6,640,903 B1 11/2003 Cook et al.
6,648,075 B2 11/2003 Badrak et al.
6,662,876 B2 12/2003 Lauritzen
6,668,930 B2 12/2003 Hoffman
6,668,937 B1 12/2003 Murray
6,672,759 B2 1/2004 Feger
6,679,328 B2 1/2004 Davis et al.
6,681,862 B2 1/2004 Freeman
6,684,947 B2 2/2004 Cook et al.
6,688,397 B2 2/2004 McClurkin et al.
6,695,012 B1 2/2004 Ring et al.
6,695,065 B2 2/2004 Simpson et al.
6,698,517 B2 3/2004 Simpson
6,701,598 B2 3/2004 Chen et al.
6,702,030 B2 3/2004 Simpson
6,705,395 B2 3/2004 Cook et al.
6,708,767 B2 3/2004 Harrall et al.
6,712,154 B2 3/2004 Cook et al.
6,712,401 B2 3/2004 Coulon et al.
6,719,064 B2 4/2004 Price-Smith et al.
6,722,427 B2 4/2004 Gano et al.
6,722,437 B2 4/2004 Vercaemer et al.
6,722,443 B1 4/2004 Metcalfe
6,723,683 B2 4/2004 Crossman et al.
6,725,919 B2 4/2004 Cook et al.
6,725,934 B2 4/2004 Coronado et al.
6,725,939 B2 4/2004 Richard
6,732,806 B2 5/2004 Mauldin et al.
6,739,392 B2 5/2004 Cook et al.
6,745,845 B2 6/2004 Cook et al.
6,749,954 B2 6/2004 Toyooka et al.
6,758,278 B2 7/2004 Cook et al.
6,796,380 B2 9/2004 Xu
6,814,147 B2 11/2004 Baugh
6,820,690 B2 11/2004 Vercaemer et al.
6,823,937 B1 11/2004 Cook et al.
6,826,937 B2 12/2004 Su
6,832,649 B2 12/2004 Bode et al.
6,834,725 B2 12/2004 Whanger et al.
6,843,319 B2 1/2005 Tran et al.
6,843,322 B2 1/2005 Burtner et al.
6,857,473 B2 2/2005 Cook et al.
6,880,632 B2 4/2005 Tom et al.
6,892,819 B2 5/2005 Cook et al.
6,902,000 B2 6/2005 Simpson et al.
6,907,652 B1 6/2005 Heijnen
6,966,370 B2 11/2005 Cook et al.
6,968,618 B2 11/2005 Cook et al.
6,977,096 B2 12/2005 LeClaire
7,011,161 B2 3/2006 Ring et al.
7,040,396 B2 5/2006 Cook et al.
7,044,218 B2 5/2006 Cook et al.
7,044,221 B2 5/2006 Cook et al.
7,048,062 B2 5/2006 Ring
7,048,067 B1 5/2006 Cook et al.
7,055,608 B2 6/2006 Cook et al.
7,063,142 B2 6/2006 Cook et al.
7,063,149 B2 6/2006 Simpson et al.
7,114,559 B2 10/2006 Sonnier et al.
7,164,964 B2 1/2007 Stacklies
7,185,710 B2 3/2007 Cook et al.
7,191,841 B2 3/2007 Sivley, IV
7,198,100 B2 4/2007 Cook et al.
7,201,223 B2 4/2007 Cook et al.
7,204,007 B2 4/2007 Cook et al.
7,216,701 B2 5/2007 Cook et al.
7,225,879 B2 6/2007 Wylie et al.
7,231,985 B2 6/2007 Cook et al.
7,234,531 B2 6/2007 Kendziora et al.
7,234,968 B2 6/2007 Lottmann et al.
7,240,728 B2 7/2007 Cook et al.
7,240,729 B2 7/2007 Cook et al.
7,243,731 B2 7/2007 Watson et al.
7,246,667 B2 7/2007 Cook et al.
7,258,168 B2 8/2007 Cook et al.
7,270,188 B2 9/2007 Cook et al.
7,275,601 B2 10/2007 Cook et al.
7,290,605 B2 11/2007 Waddell et al.
7,290,616 B2 11/2007 Cook et al.
2001/0018354 A1 8/2001 Pigni
2001/0045289 A1 11/2001 Cook et al.
2002/0060068 A1 5/2002 Cook et al.
2002/0195252 A1 12/2002 Maguire et al.
2002/0195256 A1 12/2002 Metcalfe et al.
2003/0024708 A1 2/2003 Ring et al.
2003/0024711 A1 2/2003 Simpson et al.
2003/0034177 A1 2/2003 Chitwood et al.
2003/0042022 A1 3/2003 Lauritzen et al.
2003/0047322 A1 3/2003 Maguire et al.
2003/0047323 A1 3/2003 Jackson et al.
2003/0056991 A1 3/2003 Hahn et al.
2003/0066655 A1 4/2003 Cook et al.
2003/0067166 A1 4/2003 Maguire
2003/0075337 A1 4/2003 Sivley, IV
2003/0075338 A1 4/2003 Sivley, IV
2003/0075339 A1 4/2003 Gano et al.
2003/0094277 A1 5/2003 Cook et al.
2003/0094278 A1 5/2003 Cook et al.
2003/0094279 A1 5/2003 Ring et al.
2003/0098154 A1 5/2003 Cook et al.
2003/0098162 A1 5/2003 Cook
2003/0107217 A1 6/2003 Daigle et al.
2003/0111234 A1 6/2003 McClurkin et al.
2003/0116325 A1 6/2003 Cook et al.
2003/0121558 A1 7/2003 Cook et al.
2003/0121655 A1 7/2003 Lauritzen et al.
2003/0121669 A1 7/2003 Cook et al.
2003/0140673 A1 7/2003 Marr et al.
2003/0150608 A1 8/2003 Smith, Jr. et al.
2003/0159764 A1 8/2003 Goto
2003/0168222 A1 9/2003 Maguire et al.
2003/0173090 A1 9/2003 Cook et al.
2003/0192705 A1 10/2003 Cook et al.
2003/0222455 A1 12/2003 Cook et al.
2004/0011534 A1 1/2004 Simonds et al.
2004/0045616 A1 3/2004 Cook et al.
2004/0045646 A1 3/2004 Cook et al.
2004/0045718 A1 3/2004 Brisco et al.
2004/0060706 A1 4/2004 Stephenson
2004/0065446 A1 4/2004 Tran et al.
2004/0069499 A1 4/2004 Cook et al.
2004/0112589 A1 6/2004 Cook et al.
2004/0112606 A1 6/2004 Lewis et al.
2004/0112610 A1 6/2004 Tran et al.
2004/0118574 A1 6/2004 Cook et al.
2004/0123983 A1 7/2004 Cook et al.
2004/0123988 A1 7/2004 Cook et al.
2004/0129431 A1 7/2004 Jackson
2004/0149431 A1 8/2004 Wylie et al.
2004/0159446 A1 8/2004 Haugen et al.
2004/0188099 A1 9/2004 Cook et al.
2004/0194966 A1 10/2004 Zimmerman
2004/0195826 A1 10/2004 Goto

| | | | |
|---|---|---|---|
| 2004/0216506 | A1 | 11/2004 | Simpson et al. |
| 2004/0216873 | A1 | 11/2004 | Frost, Jr. et al. |
| 2004/0221996 | A1 | 11/2004 | Burge |
| 2004/0231839 | A1 | 11/2004 | Ellington et al. |
| 2004/0231843 | A1 | 11/2004 | Simpson et al. |
| 2004/0231855 | A1 | 11/2004 | Cook et al. |
| 2004/0238181 | A1 | 12/2004 | Cook et al. |
| 2004/0244968 | A1 | 12/2004 | Cook et al. |
| 2004/0262014 | A1 | 12/2004 | Cook et al. |
| 2005/0011641 | A1 | 1/2005 | Cook et al. |
| 2005/0015963 | A1 | 1/2005 | Costa et al. |
| 2005/0028988 | A1 | 2/2005 | Cook et al. |
| 2005/0039910 | A1 | 2/2005 | Lohbeck |
| 2005/0039928 | A1 | 2/2005 | Cook et al. |
| 2005/0045324 | A1 | 3/2005 | Cook et al. |
| 2005/0045341 | A1 | 3/2005 | Cook et al. |
| 2005/0045342 | A1 | 3/2005 | Luke et al. |
| 2005/0056433 | A1 | 3/2005 | Watson et al. |
| 2005/0056434 | A1 | 3/2005 | Ring et al. |
| 2005/0077051 | A1 | 4/2005 | Cook et al. |
| 2005/0081358 | A1 | 4/2005 | Cook et al. |
| 2005/0087337 | A1 | 4/2005 | Brisco et al. |
| 2005/0098323 | A1 | 5/2005 | Cook et al. |
| 2005/0103502 | A1 | 5/2005 | Watson et al. |
| 2005/0123639 | A1 | 6/2005 | Ring et al. |
| 2005/0133225 | A1 | 6/2005 | Oosterling |
| 2005/0138790 | A1 | 6/2005 | Cook et al. |
| 2005/0144771 | A1 | 7/2005 | Cook et al. |
| 2005/0144772 | A1 | 7/2005 | Cook et al. |
| 2005/0144777 | A1 | 7/2005 | Cook et al. |
| 2005/0150098 | A1 | 7/2005 | Cook et al. |
| 2005/0150660 | A1 | 7/2005 | Cook et al. |
| 2005/0161228 | A1 | 7/2005 | Cook et al. |
| 2005/0166387 | A1 | 8/2005 | Cook et al. |
| 2005/0166388 | A1 | 8/2005 | Cook et al. |
| 2005/0173108 | A1 | 8/2005 | Cook et al. |
| 2005/0175473 | A1 | 8/2005 | Cook et al. |
| 2005/0183863 | A1 | 8/2005 | Cook et al. |
| 2005/0205253 | A1 | 9/2005 | Cook et al. |
| 2005/0217768 | A1 | 10/2005 | Asahi et al. |
| 2005/0217865 | A1 | 10/2005 | Ring et al. |
| 2005/0217866 | A1 | 10/2005 | Watson et al. |
| 2005/0223535 | A1 | 10/2005 | Cook et al. |
| 2005/0224225 | A1 | 10/2005 | Cook et al. |
| 2005/0230102 | A1 | 10/2005 | Cook et al. |
| 2005/0230103 | A1 | 10/2005 | Cook et al. |
| 2005/0230104 | A1 | 10/2005 | Cook et al. |
| 2005/0230123 | A1 | 10/2005 | Cook et al. |
| 2005/0236159 | A1 | 10/2005 | Cook et al. |
| 2005/0236163 | A1 | 10/2005 | Cook et al. |
| 2005/0244578 | A1 | 11/2005 | Van Egmond et al. |
| 2005/0247453 | A1 | 11/2005 | Shuster et al. |
| 2005/0265788 | A1 | 12/2005 | Renkema |
| 2005/0269107 | A1 | 12/2005 | Cook et al. |
| 2007/0131431 | A1 | 6/2007 | Shuster et al. |
| 2007/0143987 | A1 | 6/2007 | Cook et al. |
| 2007/0144735 | A1 | 6/2007 | Lloyd et al. |
| 2007/0151360 | A1 | 7/2007 | Ring et al. |
| 2007/0151725 | A1 | 7/2007 | Cook et al. |
| 2007/0154270 | A1 | 7/2007 | Waddell et al. |
| 2007/0169939 | A1 | 7/2007 | Costa et al. |
| 2007/0169944 | A1 | 7/2007 | Parker et al. |
| 2007/0175630 | A1 | 8/2007 | Costa et al. |
| 2007/0227730 | A1 | 10/2007 | Brisco et al. |
| 2007/0246934 | A1 | 10/2007 | Heertjes et al. |

FOREIGN PATENT DOCUMENTS

| | | | |
|---|---|---|---|
| AU | 2004/202805 | B9 | 7/2004 |
| AU | 2004/202809 | B8 | 7/2004 |
| AU | 2004/202812 | B8 | 7/2004 |
| AU | 2004/202813 | B2 | 7/2004 |
| AU | 2004/202815 | B2 | 7/2004 |
| AU | 770008 | | 7/2004 |
| AU | 770359 | | 7/2004 |
| AU | 771884 | | 8/2004 |
| AU | 776580 | | 1/2005 |
| AU | 780123 | | 3/2005 |
| AU | 2001269810 | | 8/2005 |
| AU | 782901 | | 9/2005 |
| AU | 783245 | | 10/2005 |
| AU | 2001/292695 | B2 | 10/2006 |
| AU | 2003/257878 | B2 | 8/2007 |
| AU | 2003/257881 | B2 | 8/2007 |
| CA | 736288 | | 6/1966 |
| CA | 771462 | | 11/1967 |
| CA | 1171310 | | 7/1984 |
| CA | 2292171 | | 6/2000 |
| CA | 2298139 | | 8/2000 |
| CA | 2419806 | | 4/2002 |
| CA | 2453034 | | 1/2003 |
| CA | 2234386 | | 3/2003 |
| CA | 2466685 | | 3/2004 |
| CA | 2249139 | | 1/2007 |
| CA | 2536716 | A1 | 7/2007 |
| DE | 174521 | | 4/1953 |
| DE | 1549823 | | 12/1970 |
| DE | 1549824 | | 5/1971 |
| DE | 2458188 | | 6/1975 |
| DE | 203767 | | 11/1983 |
| DE | 233607 | A1 | 3/1986 |
| DE | 278517 | A1 | 5/1990 |
| EP | 0084940 | A1 | 8/1983 |
| EP | 0272511 | | 12/1987 |
| EP | 0294264 | | 5/1988 |
| EP | 0553566 | A1 | 12/1992 |
| EP | 620289 | A1 | 10/1994 |
| EP | 0633391 | A2 | 1/1995 |
| EP | 0713953 | B1 | 11/1995 |
| EP | 0823534 | | 2/1998 |
| EP | 0881354 | | 12/1998 |
| EP | 0881359 | | 12/1998 |
| EP | 0899420 | | 3/1999 |
| EP | 0937861 | | 8/1999 |
| EP | 0952305 | | 10/1999 |
| EP | 0952306 | | 10/1999 |
| EP | 1106778 | A1 | 6/2001 |
| EP | 1141515 | A | 10/2001 |
| EP | 1152119 | A2 | 11/2001 |
| EP | 1152120 | A2 | 11/2001 |
| EP | 1152120 | A3 | 11/2001 |
| EP | 1375820 | A1 | 3/2002 |
| EP | 1235972 | A | 9/2002 |
| EP | 1306519 | A2 | 5/2003 |
| EP | 1505251 | A2 | 2/2005 |
| EP | 1555386 | A1 | 7/2005 |
| EP | 1505251 | A3 | 2/2007 |
| EP | 1549824 | B1 | 7/2007 |
| FR | 1325596 | | 6/1962 |
| FR | 1325596 | | 3/1963 |
| FR | 2583398 | A1 | 12/1986 |
| FR | 2717855 | A1 | 9/1995 |
| FR | 2741907 | A1 | 6/1997 |
| FR | 2771133 | A | 5/1999 |
| FR | 2780751 | | 1/2000 |
| FR | 2841626 | A1 | 1/2004 |
| GB | 557823 | | 12/1943 |
| GB | 788150 | | 12/1957 |
| GB | 961750 | | 6/1964 |
| GB | 1062610 | | 3/1967 |
| GB | 1107902 | A | 3/1968 |
| GB | 1549823 | | 8/1979 |
| GB | 1549824 | | 8/1979 |
| GB | 2124275 | A | 2/1984 |
| GB | 2194978 | A | 3/1988 |
| GB | 2211446 | A | 7/1989 |

| | | | |
|---|---|---|---|
| GB | 2275705 | A | 9/1994 |
| GB | 2279383 | | 1/1995 |
| GB | 2355738 | A | 4/2000 |
| GB | 2368865 | A | 7/2000 |
| GB | 2348657 | A | 10/2000 |
| GB | 2348661 | A | 10/2000 |
| GB | 2350137 | A | 11/2000 |
| GB | 2357099 | A | 12/2000 |
| GB | 2356651 | A | 5/2001 |
| GB | 2350137 | B | 8/2001 |
| GB | 2361724 | | 10/2001 |
| GB | 2359837 | B | 4/2002 |
| GB | 2370301 | A | 6/2002 |
| GB | 2371064 | A | 7/2002 |
| GB | 2371574 | A | 7/2002 |
| GB | 2373524 | | 9/2002 |
| GB | 2367842 | A | 10/2002 |
| GB | 2374098 | A | 10/2002 |
| GB | 2374622 | A | 10/2002 |
| GB | 2375560 | A | 11/2002 |
| GB | 2380213 | A | 4/2003 |
| GB | 2380503 | A | 4/2003 |
| GB | 2381019 | A | 4/2003 |
| GB | 2382364 | A | 5/2003 |
| GB | 2382607 | A | 6/2003 |
| GB | 2382828 | A | 6/2003 |
| GB | 2380213 | B | 8/2003 |
| GB | 2380214 | B | 8/2003 |
| GB | 2380215 | B | 8/2003 |
| GB | 2385622 | A | 8/2003 |
| GB | 2348223 | B | 9/2003 |
| GB | 2348657 | B | 10/2003 |
| GB | 2384800 | B | 10/2003 |
| GB | 2384801 | B | 10/2003 |
| GB | 2384802 | B | 10/2003 |
| GB | 2384803 | B | 10/2003 |
| GB | 2384804 | B | 10/2003 |
| GB | 2384805 | B | 10/2003 |
| GB | 2384806 | B | 10/2003 |
| GB | 2384807 | B | 10/2003 |
| GB | 2387405 | A | 10/2003 |
| GB | 2388134 | A | 11/2003 |
| GB | 2388860 | A | 11/2003 |
| GB | 2355738 | B | 12/2003 |
| GB | 2374622 | B | 12/2003 |
| GB | 2388391 | B | 12/2003 |
| GB | 2388392 | B | 12/2003 |
| GB | 2388393 | B | 12/2003 |
| GB | 2388394 | B | 12/2003 |
| GB | 2388395 | B | 12/2003 |
| GB | 2356651 | B | 2/2004 |
| GB | 2368865 | B | 2/2004 |
| GB | 2388860 | B | 2/2004 |
| GB | 2388861 | B | 2/2004 |
| GB | 2388862 | B | 2/2004 |
| GB | 2391886 | A | 2/2004 |
| GB | 2390628 | B | 3/2004 |
| GB | 2391033 | B | 3/2004 |
| GB | 2392686 | A | 3/2004 |
| GB | 2373524 | B | 4/2004 |
| GB | 2390387 | B | 4/2004 |
| GB | 2392686 | B | 4/2004 |
| GB | 2392691 | B | 4/2004 |
| GB | 2391575 | B | 5/2004 |
| GB | 2394979 | A | 5/2004 |
| GB | 2395506 | A | 5/2004 |
| GB | 2392932 | B | 6/2004 |
| GB | 2396634 | A | 6/2004 |
| GB | 2396635 | A | 6/2004 |
| GB | 2396640 | A | 6/2004 |
| GB | 2396641 | A | 6/2004 |
| GB | 2396642 | A | 6/2004 |
| GB | 2396643 | A | 6/2004 |
| GB | 2396644 | A | 6/2004 |
| GB | 2373468 | B | 7/2004 |
| GB | 2397261 | A | 7/2004 |
| GB | 2397262 | A | 7/2004 |
| GB | 2397263 | A | 7/2004 |
| GB | 2397264 | A | 7/2004 |
| GB | 2397265 | A | 7/2004 |
| GB | 2390622 | B | 8/2004 |
| GB | 2398317 | A | 8/2004 |
| GB | 2398318 | A | 8/2004 |
| GB | 2398319 | A | 8/2004 |
| GB | 2398320 | A | 8/2004 |
| GB | 2398321 | A | 8/2004 |
| GB | 2398322 | A | 8/2004 |
| GB | 2398323 | A | 8/2004 |
| GB | 2398326 | A | 8/2004 |
| GB | 2382367 | B | 9/2004 |
| GB | 2396641 | B | 9/2004 |
| GB | 2396643 | B | 9/2004 |
| GB | 2397261 | B | 9/2004 |
| GB | 2397262 | B | 9/2004 |
| GB | 2397263 | B | 9/2004 |
| GB | 2397264 | B | 9/2004 |
| GB | 2397265 | B | 9/2004 |
| GB | 2399120 | A | 9/2004 |
| GB | 2399579 | A | 9/2004 |
| GB | 2399580 | A | 9/2004 |
| GB | 2399837 | A | 9/2004 |
| GB | 2399848 | A | 9/2004 |
| GB | 2399849 | A | 9/2004 |
| GB | 2399850 | A | 9/2004 |
| GB | 2384502 | B | 10/2004 |
| GB | 2396644 | B | 10/2004 |
| GB | 2400126 | A | 10/2004 |
| GB | 2400393 | A | 10/2004 |
| GB | 2400624 | A | 10/2004 |
| GB | 2396640 | B | 11/2004 |
| GB | 2396642 | B | 11/2004 |
| GB | 2401136 | A | 11/2004 |
| GB | 2401137 | A | 11/2004 |
| GB | 2401138 | A | 11/2004 |
| GB | 2401630 | A | 11/2004 |
| GB | 2401631 | A | 11/2004 |
| GB | 2401632 | A | 11/2004 |
| GB | 2401633 | A | 11/2004 |
| GB | 2401634 | A | 11/2004 |
| GB | 2401635 | A | 11/2004 |
| GB | 2401636 | A | 11/2004 |
| GB | 2401637 | A | 11/2004 |
| GB | 2401638 | A | 11/2004 |
| GB | 2401639 | A | 11/2004 |
| GB | 2381019 | B | 12/2004 |
| GB | 2382368 | B | 12/2004 |
| GB | 2394979 | B | 12/2004 |
| GB | 2401136 | B | 12/2004 |
| GB | 2401137 | B | 12/2004 |
| GB | 2401138 | B | 12/2004 |
| GB | 2403970 | A | 1/2005 |
| GB | 2403971 | A | 1/2005 |
| GB | 2403972 | A | 1/2005 |
| GB | 2400624 | B | 2/2005 |
| GB | 2404676 | A | 2/2005 |
| GB | 2404677 | A | 2/2005 |
| GB | 2404680 | A | 2/2005 |
| GB | 2384807 | C | 3/2005 |
| GB | 2387861 | B | 3/2005 |
| GB | 2388134 | B | 3/2005 |
| GB | 2398320 | B | 3/2005 |
| GB | 2398323 | B | 3/2005 |
| GB | 2399120 | B | 3/2005 |
| GB | 2399848 | B | 3/2005 |
| GB | 2399849 | B | 3/2005 |
| GB | 2405893 | A | 3/2005 |

| | | | |
|---|---|---|---|
| GB | 2406117 | A | 3/2005 |
| GB | 2406118 | A | 3/2005 |
| GB | 2406119 | A | 3/2005 |
| GB | 2406120 | A | 3/2005 |
| GB | 2406125 | A | 3/2005 |
| GB | 2406126 | A | 3/2005 |
| GB | 2410518 | A | 3/2005 |
| GB | 2389597 | B | 5/2005 |
| GB | 2399119 | B | 5/2005 |
| GB | 2399580 | B | 5/2005 |
| GB | 2401630 | B | 5/2005 |
| GB | 2401631 | B | 5/2005 |
| GB | 2401632 | B | 5/2005 |
| GB | 2401633 | B | 5/2005 |
| GB | 2401634 | B | 5/2005 |
| GB | 2401635 | B | 5/2005 |
| GB | 2401636 | B | 5/2005 |
| GB | 2401637 | B | 5/2005 |
| GB | 2401638 | B | 5/2005 |
| GB | 2401639 | B | 5/2005 |
| GB | 2407593 | A | 5/2005 |
| GB | 2408278 | A | 5/2005 |
| GB | 2399579 | B | 6/2005 |
| GB | 2409216 | A | 6/2005 |
| GB | 2409218 | A | 6/2005 |
| GB | 2401893 | B | 7/2005 |
| GB | 2414749 | A | 7/2005 |
| GB | 2414750 | A | 7/2005 |
| GB | 2414751 | A | 7/2005 |
| GB | 2398326 | B | 8/2005 |
| GB | 2403970 | B | 8/2005 |
| GB | 2403971 | B | 8/2005 |
| GB | 2403972 | B | 8/2005 |
| GB | 2380503 | B | 10/2005 |
| GB | 2382828 | B | 10/2005 |
| GB | 2398317 | B | 10/2005 |
| GB | 2398318 | B | 10/2005 |
| GB | 2398319 | B | 10/2005 |
| GB | 2398321 | B | 10/2005 |
| GB | 2398322 | B | 10/2005 |
| GB | 2412681 | A | 10/2005 |
| GB | 2412682 | A | 10/2005 |
| GB | 2413136 | A | 10/2005 |
| GB | 2414493 | A | 11/2005 |
| GB | 2409217 | B | 12/2005 |
| GB | 2410518 | B | 12/2005 |
| GB | 2415003 | A | 12/2005 |
| GB | 2415219 | A | 12/2005 |
| GB | 2412682 | B | 1/2006 |
| GB | 2415979 | A | 1/2006 |
| GB | 2415983 | A | 1/2006 |
| GB | 2415987 | A | 1/2006 |
| GB | 2415988 | A | 1/2006 |
| GB | 2416177 | A | 1/2006 |
| GB | 2408278 | B | 2/2006 |
| GB | 2396639 | B | 3/2006 |
| GB | 2422860 | A | 8/2006 |
| GB | 2427636 | A | 1/2007 |
| GB | 2429482 | A | 2/2007 |
| GB | 2410280 | B | 4/2007 |
| GB | 2430953 | A | 4/2007 |
| GB | 2431179 | A | 4/2007 |
| GB | 2431181 | A | 4/2007 |
| GB | 2412178 | B | 5/2007 |
| GB | 2415215 | B | 5/2007 |
| GB | 2426993 | B | 5/2007 |
| GB | 2427636 | B | 5/2007 |
| GB | 2432383 | A | 5/2007 |
| GB | 2432384 | A | 5/2007 |
| GB | 2432385 | A | 5/2007 |
| GB | 2432386 | A | 5/2007 |
| GB | 2415003 | B | 6/2007 |
| GB | 2416556 | B | 7/2007 |
| GB | 2433756 | A | 7/2007 |
| GB | 2415454 | B | 8/2007 |
| GB | 2429226 | B | 8/2007 |
| GB | 2429996 | B | 8/2007 |
| GB | 2433281 | B | 8/2007 |
| GB | 2435280 | A | 8/2007 |
| GB | 2415983 | B | 9/2007 |
| GB | 2415987 | B | 9/2007 |
| GB | 2416361 | B | 9/2007 |
| GB | 2421529 | B | 9/2007 |
| GB | 2429480 | B | 9/2007 |
| GB | 2429482 | B | 9/2007 |
| GB | 2436114 | A | 9/2007 |
| GB | 2415988 | B | 10/2007 |
| GB | 2424437 | B | 10/2007 |
| GB | 2427886 | B | 10/2007 |
| GB | 2429481 | B | 10/2007 |
| GB | 2432388 | B | 10/2007 |
| GB | 2433757 | B | 10/2007 |
| GB | 2433758 | B | 10/2007 |
| GB | 2435064 | B | 10/2007 |
| GB | 2436931 | A | 10/2007 |
| GB | 2437045 | A | 10/2007 |
| GB | 2437467 | A | 10/2007 |
| GB | 2416794 | B | 11/2007 |
| GB | 2429224 | B | 11/2007 |
| GB | 2429225 | B | 11/2007 |
| GB | 2436743 | B | 11/2007 |
| GB | 2437044 | B | 11/2007 |
| GB | 2437879 | A | 11/2007 |
| GB | 2437880 | A | 11/2007 |
| GB | 2408277 | A | 5/2008 |
| ID | 044.392/2005 | | 9/2005 |
| JP | 59-197323 | | 11/1984 |
| JP | 208458 | | 10/1985 |
| JP | 6475715 | | 3/1989 |
| JP | 102875 | | 4/1995 |
| JP | 11-169975 | | 6/1999 |
| JP | 94068 | A | 4/2000 |
| JP | 107870 | A | 4/2000 |
| JP | 162192 | | 6/2000 |
| JP | 2001-47161 | | 2/2001 |
| JP | P2001-47161 | A | 2/2001 |
| JP | 2006-525483 | | 8/2007 |
| NL | 6505793 | A | 11/1965 |
| NL | 9001081 | | 12/1991 |
| RO | 113267 | B1 | 5/1998 |
| RU | 1786241 | A1 | 1/1993 |
| RU | 1804543 | A3 | 3/1993 |
| RU | 1810482 | A1 | 4/1993 |
| RU | 1818459 | A1 | 5/1993 |
| RU | 2016345 | C1 | 7/1994 |
| RU | 1295799 | A1 | 2/1995 |
| RU | 2039214 | C1 | 7/1995 |
| RU | 2056201 | C1 | 3/1996 |
| RU | 2064357 | C1 | 7/1996 |
| RU | 2068940 | C1 | 11/1996 |
| RU | 2068943 | C1 | 11/1996 |
| RU | 2079633 | C1 | 5/1997 |
| RU | 2083798 | C1 | 7/1997 |
| RU | 2091655 | C1 | 9/1997 |
| RU | 2095179 | C1 | 11/1997 |
| RU | 2105128 | C1 | 2/1998 |
| RU | 2108445 | C1 | 4/1998 |
| RU | 2144128 | C1 | 1/2000 |
| SU | 350833 | | 9/1972 |
| SU | 511468 | | 9/1976 |
| SU | 607950 | | 5/1978 |
| SU | 612004 | | 5/1978 |
| SU | 620582 | | 7/1978 |
| SU | 641070 | | 1/1979 |
| SU | 909114 | | 5/1979 |
| SU | 832049 | | 5/1981 |

| | | | |
|---|---|---|---|
| SU | 853089 | | 8/1981 |
| SU | 874952 | | 10/1981 |
| SU | 894169 | | 1/1982 |
| SU | 899850 | | 1/1982 |
| SU | 907220 | | 2/1982 |
| SU | 953172 | | 8/1982 |
| SU | 959878 | | 9/1982 |
| SU | 976019 | | 11/1982 |
| SU | 976020 | | 11/1982 |
| SU | 989038 | | 1/1983 |
| SU | 1002514 | | 3/1983 |
| SU | 1041671 | A | 9/1983 |
| SU | 1051222 | A | 10/1983 |
| SU | 1086118 | A | 4/1984 |
| SU | 1077803 | A | 7/1984 |
| SU | 1158400 | A | 5/1985 |
| SU | 1212575 | A | 2/1986 |
| SU | 1250637 | A1 | 8/1986 |
| SU | 1324722 | A1 | 7/1987 |
| SU | 1411434 | | 7/1988 |
| SU | 1430498 | A1 | 10/1988 |
| SU | 1432190 | A1 | 10/1988 |
| SU | 1601330 | A1 | 10/1990 |
| SU | 1627663 | A2 | 2/1991 |
| SU | 1659621 | A1 | 6/1991 |
| SU | 1663179 | A2 | 7/1991 |
| SU | 1663180 | A1 | 7/1991 |
| SU | 1677225 | A1 | 9/1991 |
| SU | 1677248 | A1 | 9/1991 |
| SU | 1686123 | A1 | 10/1991 |
| SU | 1686124 | A1 | 10/1991 |
| SU | 1686125 | A1 | 10/1991 |
| SU | 1698413 | A1 | 12/1991 |
| SU | 1710694 | A | 2/1992 |
| SU | 1730429 | A1 | 4/1992 |
| SU | 1745873 | A1 | 7/1992 |
| SU | 1747673 | A1 | 7/1992 |
| SU | 1749267 | A1 | 7/1992 |
| WO | WO 93/25800 | | 12/1993 |
| WO | WO 96/10710 | | 11/1996 |
| WO | WO 98/22690 | | 5/1998 |
| WO | WO 98/42947 | | 10/1998 |
| WO | WO00/01926 | | 1/2000 |
| WO | WO00/04271 | | 1/2000 |
| WO | WO 00/08301 | | 2/2000 |
| WO | WO00/08301 | | 2/2000 |
| WO | WO00/26500 | | 5/2000 |
| WO | WO00/26501 | | 5/2000 |
| WO | WO00/26502 | | 5/2000 |
| WO | WO00/31375 | | 6/2000 |
| WO | WO00/37766 | | 6/2000 |
| WO | WO00/37767 | | 6/2000 |
| WO | WO00/37768 | | 6/2000 |
| WO | WO00/37771 | | 6/2000 |
| WO | WO 00/37771 | A1 | 6/2000 |
| WO | WO00/37772 | | 6/2000 |
| WO | WO00/39432 | | 7/2000 |
| WO | WO00/46484 | | 8/2000 |
| WO | WO00/50727 | | 8/2000 |
| WO | WO00/50732 | | 8/2000 |
| WO | WO00/50733 | | 8/2000 |
| WO | WO00/77431 | A2 | 12/2000 |
| WO | WO01/04520 | A1 | 1/2001 |
| WO | WO01/04535 | A1 | 1/2001 |
| WO | WO 01/18354 | A1 | 3/2001 |
| WO | WO01/18354 | A1 | 3/2001 |
| WO | WO01/21929 | A1 | 3/2001 |
| WO | WO01/26860 | A1 | 4/2001 |
| WO | WO 01/33037 | A1 | 5/2001 |
| WO | WO01/33037 | A1 | 5/2001 |
| WO | WO01/38693 | A1 | 5/2001 |
| WO | WO01/60545 | A1 | 8/2001 |
| WO | WO01/83943 | A1 | 11/2001 |
| WO | WO01/98623 | A1 | 12/2001 |
| WO | WO 01/98623 | A1 | 12/2001 |
| WO | WO02/01102 | A1 | 1/2002 |
| WO | WO02/10550 | A1 | 2/2002 |
| WO | WO02/10551 | A1 | 2/2002 |
| WO | WO 02/20941 | A1 | 3/2002 |
| WO | WO02/25059 | A1 | 3/2002 |
| WO | WO02/29199 | A1 | 4/2002 |
| WO | WO 02/38343 | A2 | 5/2002 |
| WO | WO02/40825 | A1 | 5/2002 |
| WO | WO02/053867 | A2 | 7/2002 |
| WO | WO02/053867 | A3 | 7/2002 |
| WO | WO02/059456 | A1 | 8/2002 |
| WO | WO02/066783 | A1 | 8/2002 |
| WO | WO02/068792 | A1 | 9/2002 |
| WO | WO02/073000 | A1 | 9/2002 |
| WO | WO02/075107 | A1 | 9/2002 |
| WO | WO02/077411 | A1 | 10/2002 |
| WO | WO02/081863 | A1 | 10/2002 |
| WO | WO02/081864 | A2 | 10/2002 |
| WO | WO02/086285 | A1 | 10/2002 |
| WO | WO02/086286 | A2 | 10/2002 |
| WO | WO02/090713 | | 11/2002 |
| WO | WO02/095181 | A1 | 11/2002 |
| WO | WO02/103150 | A2 | 12/2002 |
| WO | WO03/004819 | A2 | 1/2003 |
| WO | WO03/004819 | A3 | 1/2003 |
| WO | WO03/004820 | A2 | 1/2003 |
| WO | WO03/004820 | A3 | 1/2003 |
| WO | WO03/008756 | A1 | 1/2003 |
| WO | WO03/012255 | A1 | 2/2003 |
| WO | WO03/016669 | A2 | 2/2003 |
| WO | WO03/016669 | A3 | 2/2003 |
| WO | WO 03/023178 | A2 | 3/2003 |
| WO | WO03/023178 | A2 | 3/2003 |
| WO | WO03/023178 | A3 | 3/2003 |
| WO | WO03/023179 | A2 | 3/2003 |
| WO | WO03/023179 | A3 | 3/2003 |
| WO | WO03/029607 | A1 | 4/2003 |
| WO | WO03/029608 | A1 | 4/2003 |
| WO | WO03/036018 | A2 | 5/2003 |
| WO | WO03/042486 | A2 | 5/2003 |
| WO | WO03/042486 | A3 | 5/2003 |
| WO | WO03/042487 | A2 | 5/2003 |
| WO | WO03/042487 | A3 | 5/2003 |
| WO | WO03/042489 | A2 | 5/2003 |
| WO | WO03/048520 | A1 | 6/2003 |
| WO | WO03/048521 | A2 | 6/2003 |
| WO | WO03/055616 | A2 | 7/2003 |
| WO | WO03/056022 | A2 | 7/2003 |
| WO | WO03/058022 | A3 | 7/2003 |
| WO | WO03/059549 | A1 | 7/2003 |
| WO | WO03/064813 | A1 | 8/2003 |
| WO | WO03/069115 | A3 | 8/2003 |
| WO | WO03/071086 | A2 | 8/2003 |
| WO | WO03/071086 | A3 | 8/2003 |
| WO | WO03/078785 | A2 | 9/2003 |
| WO | WO03/078785 | A3 | 9/2003 |
| WO | WO03/086675 | A2 | 10/2003 |
| WO | WO03/086675 | A3 | 10/2003 |
| WO | WO03/089161 | A2 | 10/2003 |
| WO | WO03/089161 | A3 | 10/2003 |
| WO | WO03/093623 | A2 | 11/2003 |
| WO | WO 03/093623 | A2 | 11/2003 |
| WO | WO03/093623 | A3 | 11/2003 |
| WO | WO 03/093624 | | 11/2003 |
| WO | WO03/102365 | A1 | 12/2003 |
| WO | WO03/104601 | A2 | 12/2003 |
| WO | WO03/104601 | A3 | 12/2003 |
| WO | WO03/106130 | A2 | 12/2003 |
| WO | WO03/106130 | A3 | 12/2003 |
| WO | WO2004/003337 | A1 | 1/2004 |
| WO | WO2004/009950 | A1 | 1/2004 |

| | | | |
|---|---|---|---|
| WO | WO2004/010039 | A2 | 1/2004 |
| WO | WO2004/010039 | A3 | 1/2004 |
| WO | WO2004/011776 | A2 | 2/2004 |
| WO | WO2004/011776 | A3 | 2/2004 |
| WO | WO2004/018823 | A2 | 3/2004 |
| WO | WO2004/018823 | A3 | 3/2004 |
| WO | WO2004/018824 | A2 | 3/2004 |
| WO | WO2004/018824 | A3 | 3/2004 |
| WO | WO2004/020895 | A2 | 3/2004 |
| WO | WO2004/020895 | A3 | 3/2004 |
| WO | WO2004/023014 | A2 | 3/2004 |
| WO | WO2004/023014 | A3 | 3/2004 |
| WO | WO2004/026017 | A2 | 4/2004 |
| WO | WO2004/026017 | A3 | 4/2004 |
| WO | WO2004/026073 | A2 | 4/2004 |
| WO | WO2004/026073 | A3 | 4/2004 |
| WO | WO2004/026500 | A2 | 4/2004 |
| WO | WO 2004/026500 | A2 | 4/2004 |
| WO | WO2004/026500 | A3 | 4/2004 |
| WO | WO2004/027200 | A2 | 4/2004 |
| WO | WO2004/027200 | A3 | 4/2004 |
| WO | WO 2004/027201 | A2 | 4/2004 |
| WO | WO2004/027204 | A2 | 4/2004 |
| WO | WO2004/027204 | A3 | 4/2004 |
| WO | WO2004/027205 | A2 | 4/2004 |
| WO | WO2004/027205 | A3 | 4/2004 |
| WO | WO2004/027392 | A1 | 4/2004 |
| WO | WO2004/027786 | A2 | 4/2004 |
| WO | WO2004/027786 | A3 | 4/2004 |
| WO | WO 2004/053434 | A2 | 6/2004 |
| WO | WO2004/053434 | A2 | 6/2004 |
| WO | WO2004/053434 | A3 | 6/2004 |
| WO | WO2004/057715 | A2 | 7/2004 |
| WO | WO2004/057715 | A3 | 7/2004 |
| WO | WO2004/067961 | A2 | 8/2004 |
| WO | WO2004/067961 | A3 | 8/2004 |
| WO | WO2004/072436 | A1 | 8/2004 |
| WO | WO2004/074622 | A2 | 9/2004 |
| WO | WO2004/074622 | A3 | 9/2004 |
| WO | WO2004/076798 | A2 | 9/2004 |
| WO | WO2004/076798 | A3 | 9/2004 |
| WO | WO2004/081346 | A2 | 9/2004 |
| WO | WO2004/083591 | A2 | 9/2004 |
| WO | WO2004/083591 | A3 | 9/2004 |
| WO | WO2004/083592 | A2 | 9/2004 |
| WO | WO2004/083592 | A3 | 9/2004 |
| WO | WO2004/083593 | A2 | 9/2004 |
| WO | WO2004/083594 | A2 | 9/2004 |
| WO | WO2004/083594 | A3 | 9/2004 |
| WO | WO2004/089608 | A2 | 10/2004 |
| WO | WO2004/094766 | A3 | 11/2004 |
| WO | WO2005/021921 | A3 | 3/2005 |
| WO | WO2005/071212 | A1 | 4/2005 |
| WO | WO2005/079186 | A3 | 9/2005 |
| WO | WO2005/081803 | A2 | 9/2005 |
| WO | WO2005/086614 | A2 | 9/2005 |
| WO | WO 2006/096762 | A1 | 9/2006 |
| WO | WO 2007/047193 | A2 | 4/2007 |
| WO | WO 2007/076078 | A2 | 7/2007 |
| WO | WO 2007/079321 | A2 | 7/2007 |

OTHER PUBLICATIONS

International Search Report, Application PCT/US00/18635, Nov. 24, 2000.
International Search Report, Application PCT/US00/27645, Dec. 29, 2000.
International Search Report, Application PCT/US00/30022, Mar. 27, 2001.
International Search Report, Application PCT/US01/04753, Jul. 3, 2001.
International Search Report, Application PCT/US01/19014, Nov. 23, 2001.
International Search Report, Application PCT/US01/23815, Nov. 16, 2001.
International Search Report, Application PCT/US01/28960, Jan. 22, 2002.
International Search Report, Application PCT/US01/30256, Jan. 3, 2002.
International Search Report, Application PCT/US01/41446, Oct. 30, 2001.
International Search Report, Application PCT/US02/00093, Aug. 6, 2002.
International Search Report, Application PCT/US02/00677, Feb. 24, 2004.
International Search Report, Application PCT/US02/00677, Jul. 17, 2002.
International Search Report, Application PCT/US02/04353, Jun. 24, 2002.
International Search Report, Application PCT/US02/20256, Jan. 3, 2003.
International Search Report, Application PCT/US02/20477; Apr. 6, 2004.
International Search Report, Application PCT/US02/20477; Oct. 31, 2003.
International Search Report, Application PCT/US02/24399; Feb. 27, 2004.
International Examination Report, Application PCT/US02/24399, Aug. 6, 2004.
International Examination Report, Application PCT/US02/25608; Jun. 1, 2005.
International Search Report, Application PCT/US02/25608; May 24, 2004.
International Search Report, Application PCT/US02/25727; Feb. 19, 2004.
Examination Report, Application PCT/US02/25727; Jul. 7, 2004.
International Search Report, Application PCT/US02/29856, Dec. 16, 2002.
International Search Report, Application PCT/US02/36157; Apr. 14, 2004.
International Search Report, Application PCT/US02/36157; Sep. 29, 2003.
International Examination Report, Application PCT/US02/36267, Jan. 4, 2004.
International Search Report, Application PCT/US02/36267; May 21, 2004.
International Examination Report, Application PCT/US02/39418, Feb. 18, 2005.
International Search Report, Application PCT/US02/39418, Mar. 24, 2003.
International Search Report, Application PCT/US02/39425, May 28, 2004.
International Search Report, Application PCT/US03/00609, May 20, 2004.
International Examination Report, Application PCT/US03/04837, Dec. 9, 2004.
International Search Report, Application PCT/US03/04837, May 28, 2004.
International Examination Report, Application PCT/US03/06544, May 10 2005.
International Search Report, Application PCT/US03/06544, Jun. 9, 2004.
International Search Report, Application PCT/US03/10144; Oct. 31, 2003.
Examination Report, Application PCT/US03/10144; Jul. 7, 2004.
International Examination Report, Application PCT/US03/11765; Dec. 10, 2004.
International Search Report, Application PCT/US03/11765; Nov. 13, 2003.
International Examination Report, Application PCT/US03/11765;; Jan. 25, 2005.
International Examination Report, Application PCT/US03/11765; Jul. 18, 2005.
International Search Report, Application PCT/US03/13787; May 28, 2004.

International Examination Report, Application PCT/US03/13787; Apr. 7, 2005.
International Examination Report, Application PCT/US03/13787; Mar. 2, 2005.
International Search Report, Application PCT/US03/14153; May 28, 2004.
International Examination Report, Application PCT/US03/14153; May 12, 2005.
International Search Report, Application PCT/US03/15020; Jul. 30, 2003.
International Examination Report, Application PCT/US03/15020, May 9, 2005.
International Search Report, Application PCT/US03/18530; Jun. 24, 2004.
International Search Report, Application PCT/US03/19993; May 24, 2004.
International Search Report, Application PCT/US03/20694; Nov. 12, 2003.
International Search Report, Application PCT/US03/20870; May 24, 2004.
International Search Report, Application PCT/US03/20870; Sep. 30, 2004.
International Search Report, Application PCT/US03/24779; Mar. 3, 2004.
International Examination Report, Application PCT/US03/25667, May 25, 2005.
Internatioinal Search Report, Application PCT/US03/25675; May 25, 2004.
International Search Report, Application PCT/US03/25676; May 17, 2004.
International Examination Report, Application PCT/US03/25676, Aug. 17, 2004.
International Search Report, Application PCT/US03/25677; May 21, 2004.
International Examination Report, Application PCT/US03/25677, Aug. 17, 2004.
International Search Report, Application PCT/US03/25707; Jun. 23, 2004.
International Search Report, Application PCT/US03/25715; Apr. 9, 2004.
International Search Report, Application PCT/US03/25716; Jan. 13, 2005.
International Search Report, Application PCT/US03/25742; Dec. 20, 2004.
International Search Report, Application PCT/US03/25742; May 27, 2004.
International Search Report, Application PCT/US03/29460; May 25, 2004.
International Examination Report, Application PCT/US03/29460; Dec. 8, 2004.
International Search Report, Application PCT/US03/25667; Feb. 26, 2004.
International Search Report, Application PCT/US03/29858; Jun. 30, 2003.
International Examination Report, Application PCT/US03/29858; May 23, 2005.
International Search Report, Application PCT/US03/29859; May 21, 2004.
International Examination Report, Application PCT/US03/29859, Aug. 16, 2004.
International Search Report, Application PCT/US03/38550; Jun. 15, 2004.
International Search Report, Application PCT/US03/38550; May 23, 2005.
International Preliminary Report on Patentability, Application PCT/US04/02122; May 13, 2005.
International Preliminary Report on Patentability, Application PCT/US04/04740; Apr. 27, 2005.
International Preliminary Report on Patentability, Application PCT/US04/06246; May 5, 2005.
International Preliminary Report on Patentability, Application PCT/US04/08030; Apr. 7, 2005.
International Preliminary Report on Patentability, Application PCT/US04/08030; Jun. 10, 2005.
International Preliminary Report on Patentability, Application PCT/US04/08073; May 9, 2005.
International Preliminary Report on Patentability, Application PCT/US04/11177;Jun. 9, 2005.
Examination Report to Application No. AU 2001278196 ,Apr. 21, 2005.
Examination Report to Application No. Au 2002237757 ,Apr. 28, 2005.
Examination Report to Application No. AU 2002240366 ,Apr. 13, 2005.
Search Report to Application No. EP 02806451.7; Feb. 9, 2005.
Search Report to Application No. GB 0003251.6, Jul. 13, 2000.
Search Report to Application No. GB 0004282.0, Jul. 31, 2000.
Search Report to Application No. GB 0004282.0 Jan. 15, 2001.
Search and Examination Report to Application No. GB 0004282.0, Jun. 3, 2003.
Search Report to Application No. GB 0004285.3, Jul. 12, 2000.
Search Report to Application No. GB0004285.3, Jan. 17, 2001.
Search Report to Application No. GB 0004285.3, Jan. 19, 2001.
Examination Report to Application No. 0004285.3, Mar. 28, 2003.
Search Report to Application No. GB 0004285.3, Aug. 28, 2002.
Examination Report to Application No. GB 0005399.1; Jul. 24, 2000.
Search Report to Application No. GB 0005399.1, Feb. 15, 2001.
Examination Report to Application No. GB 0005399.1; Oct. 14, 2002.
Search Report to Application No. GB 0013661.4, Oct. 20, 2000.
Search Report to Application No. GB 0013661.4, Feb. 19, 2003.
Search Report to Application No. GB 0013661.4, Apr. 17, 2001.
Examination Report to Application No. GB 0013661.4, Nov. 25, 2003.
Search Report to Application No. GB 0013661.4, Oct. 20, 2003.
Examination Report to Application No. GB 0208367.3, Apr. 4, 2003.
Examination Report to Application No. GB 0208367.3, Nov. 4, 2003.
Examination Report to Application No. GB 0208367.3, Nov. 17, 2003.
Examination Report to Application No. GB 0208367.3, Jan. 30, 2004.
Examination Report to Application No. GB 0212443.6, Apr. 10, 2003.
Examination Report to Application No. GB 0216409.3, Feb. 9, 2004.
Search Report to Application No. GB 0219757.2, Nov. 25, 2002.
Search Report to Application No. GB 0219757.2, Jan. 20, 2003.
Examination Report to Application No. GB 0219757.2, May 10, 2004.
Search Report to Application No. GB 0220872.6, Dec. 5, 2002.
Search Report to Application GB 0220872.6, Mar. 13, 2003.
Examination Report to Application GB 0220872.6, Oct. 29, 2004.
Search Report to Application No. GB 0225505.7, Mar. 5, 2003.
Search and Examination Report to Application No. GB 0225505.7, Jul. 1, 2003.
Examination Report to Application No. GB 0225505.7, Oct. 27, 2004.
Examination Report to Application No. GB 0225505.7 Feb. 15, 2005.
Examination Report to Application No. GB 0300085.8, Nov. 28, 2003.
Examination Report to Application No. GB 030086.6, Dec. 1, 2003.
Examination Report to Application No. GB 0306046.4, Sep. 10, 2004.
Search and Examination Report to Application No. GB 0308290.6, Jun. 2, 2003.
Search and Examination Report to Application No. GB 0308293.0, Jun. 2, 2003.
Search and Examination Report to Application No. GB 0308293.0, Jul. 14, 2003.
Search and Examination Report to Application No. GB 0308294.8, Jun. 2, 2003.
Search and Examination Report to Application No. GB 0308294.8, Jul. 14, 2003.
Search and Examination Report to Application No. GB 0308295.5, Jun. 2, 2003.

Search and Examination Report to Application No. GB 0308295.5, Jul. 14, 2003.
Search and Examination Report to Application No. GB 0308296.3, Jun. 2, 2003.
Search and Examination Report to Application No. GB 0308296.3, Jul. 14, 2003.
Search and Examination Report to Application No. GB 0308297.1, Jun. 2, 2003.
Search and Examination Report to Application No. GB 0308297.1, Jul. 2003.
Search and Examination Report to Application No. GB 0308299.7, Jun. 2, 2003.
Search and Examination Report to Application No. GB 0308299.7, Jun. 14, 2003.
Search and Examination Report to Application No. GB 0308302.9, Jun. 2, 2003.
Search and Examination Report to Application No. GB 0308303.7, Jun. 2, 2003.
Search and Examination Report to Application No. GB 0308303.7, Jul. 14, 2003.
Search and Examination Report to Application No. GB 0310090.6, Jun. 24, 2003.
Search and Examination Report to Application No. GB 0310099.7, Jun. 24, 2003.
Search and Examination Report to Application No. GB 0310101.1, Jun. 24, 2003.
Search and Examination Report to Application No. GB 0310104.5, Jun. 24, 2003.
Search and Examination Report to Application No. GB 0310118.5, Jun. 24, 2003.
Search and Examination Report to Application No. GB 0310757.0, Jun. 12, 2003.
Search and Examination Report to Application No. GB 0310759.6, Jun. 12, 2003.
Search and Examination Report to Application No. GB 0310770.3, Jun. 12, 2003.
Search and Examination Report to Application No. GB 0310772.9, Jun. 12, 2003.
Search and Examination Report to Application No. GB 0310785.1, Jun. 12, 2003.
Search and Examination Report to Application No. GB 0310795.0, Jun. 12, 2003.
Search and Examination Report to Application No. GB 0310797.6, Jun. 12, 2003.
Search and Examination Report to Application No. GB 0310799.2, Jun. 12, 2003.
Search and Examination Report to Application No. GB 0310801.6, Jun. 12, 2003.
Search and Examination Report to Application No. GB 0310833.9, Jun. 12, 2003.
Search and Examination Report to Application No. GB 0310836.2, Jun. 12, 2003.
Examination Report to Application No. GB 0310836.2, Aug. 7, 2003.
Examination Report to Application No. GB 0311596.1, May 18, 2004.
Search and Examination Report to Application No. GB 0313406.1, Sep. 3, 2003.
Examination Report to Application No. GB 0314846.7, Jul. 15, 2004.
Search and Examination Report to Application No. GB 0316883.8, Aug. 14, 2003.
Search and Examination Report to Application No. GB 0316883.8, Nov. 25, 2003.
Search and Examination Report to Application No. GB 0316886.1, Aug. 14, 2003.
Search and Examination Report to Application No. GB 0316883.1, Nov. 25, 2003.
Search and Examination Report to Application No. GB 0316887.9, Aug. 14, 2003.
Search and Examination Report to Application No. GB 0316887.9, Nov. 25, 2003.
Search and Examination Report to Application No. GB 0318545.1, Sep. 3, 2003.
Search and Examination Report to Application No. GB 0318547.4; Sep. 3, 2003.
Search and Examination Report to Application No. GB 0318549.3; Sep. 3, 2003.
Search and Examination Report to Application No. GB 0318550.1, Sep. 3, 2003.
Search and Examination Report to Application No. GB 0320579.6, Dec. 16, 2003.
Search and Examination Report to Application No. GB 0320580.4, Dec. 17, 2003.
Examination Report to Application No. GB 0320747.9, May 25, 2004.
Search and Examination Report to Application No. GB 0323891.2, Dec. 19, 2003.
Search and Examination Report to Application No. GB 0324172.6, Nov. 4, 2003.
Search and Examination Report to Application No. GB 0324174.2, Nov. 4, 2003.
Search and Examination Report to Application No. GB 0325071.9, Nov. 18, 2003.
Examination Report to Application No. GB 0325071.9, Feb. 2, 2004.
Examination Report to Application No. GB 0325072.7, Feb. 5, 2004.
Search and Examination Report to Application No. GB 0325072.7; Dec. 3, 2003.
Examination Report to Application No. GB 0325072.7; Apr. 13, 2004.
Examination Report to Application No. GB 0400018.8; Oct. 29, 2004.
Search and Examination Report to Application No. GB 0400018.8; May 17, 2005.
Examination Report to Application No. GB 0400019.6; Oct. 29, 2004.
Examination Report to Application No. GB 0400019.6; May 19, 2005.
Search and Examination Report to Application No. GB 0403891.5, Jun. 9, 2004.
Examination Report to Application No. GB 0403891.5, Feb. 14, 2005.
Examination Report to Application No. GB 0403891.5, Jun. 30, 2005.
Search and Examination Report to Application No. GB 0403893.1, Jun. 9, 2004.
Examination Report to Application No. GB 0403893.1, Feb. 14, 2005.
Search and Examination Report to Application No. GB 0403894.9, Jun. 9, 2004.
Examination Report to Application No. GB 0403894.9, Feb. 15, 2005.
Search and Examination Report to Application No. GB 0403897.2, Jun. 9, 2004.
Search and Examination Report to Application No. GB 0403920.2, Jun. 10, 2004.
Examination Report to Application No. GB 0403920.2, Feb. 15, 2005.
Search and Examination Report to Application No. GB 0403921.0, Jun. 10, 2004.
Examination Report to Application No. GB 0403921.0, Feb. 15, 2005.
Search and Examination Report to Application No. GB 0403926.9, Jun. 10, 2004.
Examination Report to Application No. GB 0404796.5; Apr. 14, 2005.
Examination Report to Application No. GB 0404796.5; May 20, 2004.
Search and Examination Report to Application No. GB 0404826.0, Apr. 21, 2004.
Search and Examination Report to Application No. GB 0404828.6, Apr. 21, 2004.
Search and Examination Report to Application No. GB 0404830.2, Apr. 21, 2004.
Search and Examination Report to Application No. GB 0404832.8, Apr. 21, 2004.

Search and Examination Report to Application No. GB 0404833.6, Apr. 21, 2004.
Search and Examination Report to Application No. GB 0404833.6, Aug. 19, 2004.
Search and Examination Report to Application No. GB 0404837.7, May 17, 2004.
Examination Report to Application No. GB 0404837.7, Jul. 12, 2004.
Search and Examination Report to Application No. GB 0404839.3, May 14, 2004.
Search and Examination Report to Application No. GB 0404842.7, May 14, 2004.
Search and Examination Report to Application No. GB 0404845.0, May 14, 2004.
Search and Examination Report to Application No. GB 0404849.2, May 17, 2004.
Examination Report to Application No. GB 0406257.6, Jun. 28, 2004.
Examination Report to Application No. GB 0406257.6, Jan. 25, 2005.
Examination Report to Application No. GB 0406257.6, Jun. 16, 2005.
Examination Report to Application No. GB 0406258.4, May 20, 2004.
Examination Report to Application No. GB 0406258.4; Jan. 12, 2005.
Examination Report to Application No. GB 0408672.4; Jul. 12, 2004.
Examination Report to Application No. GB 0408672.4, Mar. 21, 2005.
Examination Report to Application No. GB 0404830.2, Aug. 17, 2004.
Search and Examination Report to Application No. GB 0411698.4, Jun. 30, 2004.
Examination Report to Application No. GB 0411698.4, Jan. 24, 2005.
Search and Examination Report to Application No. GB 0411892.3, Jul. 14, 2004.
Examination Report to Application No. GB 0411892.3, Feb. 21, 2005.
Search and Examination Report to Application No. GB 0411893.3, Jul. 14, 2004.
Search and Examination Report to Application No. GB 0411894.9, Jun. 30, 2004.
Search and Examination Report to Application No. GB 0412190.1, Jul. 22, 2004.
Search and Examination Report to Application No. GB 0412191.9, Jul. 22, 2004.
Search and Examination Report to Application No. GB 0412192.7, Jul. 22, 2004.
Examination Report to Application No. GB 0412533.2, May 20, 2005.
Search Report to Application No. GB 0415835.8, Dec. 2, 2004.
Search Report to Application No. GB 0415835.8; Mar. 10, 2005.
Examination Report to Application No. 0416625.2, Jan. 20, 2005.
Search and Examination Report to Application No. GB 0416834.0, Aug. 11, 2004.
Search and Examination Report to Application No. GB 0416834.0, Nov. 16, 2004.
Search and Examination Report to Application No. GB 0417810.9, Aug. 25, 2004.
Search and Examination Report to Application No. GB 0417811.7, Aug. 25, 2004.
Search and Examination Report to Application No. GB 0418005.5, Aug. 25, 2004.
Search and Examination Report to Application No. GB 0418425.5, Sep. 10, 2004.
Search and Examination Report to Application No. GB 0418426.3 Sep. 10, 2004.
Search and Examination Report to Application No. GB 0418427.1 Sep. 10, 2004.
Search and Examination Report to Application No. GB 0418429.7 Sep. 10, 2004.
Search and Examination Report to Application No. GB 0418430.5 Sep. 10, 2004.
Search and Examination Report to Application No. GB 0418431.3 Sep. 10, 2004.
Search and Examination Report to Application No. GB 0418432.1 Sep. 10, 2004.
Search and Examination Report to Application No. GB 0418433.9 Sep. 10, 2004.
Search and Examination Report to Application No. GB 0418439.6 Sep. 10, 2004.
Search and Examination Report to Application No. GB 0418442.0 Sep. 10, 2004.
Examination Report to Application No. GB 0422419.2 Dec. 8, 2004.
Search and Examination Report to Application No. GB 0422893.8 Nov. 24, 2004.
Search and Examination Report to Application No. GB 0423416.7 Nov. 12, 2004.
Search and Examination Report to Application No. GB 0423417.5 Nov. 12, 2004.
Search and Examination Report to Application No. GB 0423418.3 Nov. 12, 2004.
Search and Examination Report to Application No. GB 0425948.7 Apr. 13, 2005.
Search and Examination Report to Application No. GB 0425951.1 Apr. 14, 2005.
Search and Examination Report to Application No. GB 0425956.0 Apr. 14, 2005.
Search and Examination Report to Application No. GB 0426155.8 Jan. 12, 2005.
Search and Examination Report to Application No. GB 0426156.6 Jan. 12, 2005.
Search and Examination Report to Application No. GB 0426157.4 Jan. 12, 2005.
Examination Report to Application No. GB 0428141.6 Feb. 9, 2005.
Examination Report to Application No. GB 0500184.7 Feb. 9, 2005.
Search and Examination Report to Application No. GB 0500600.2 Feb. 15, 2005.
Examination Report to Application No. GB 0501667.0 May 27, 2005.
Search and Examination Report to Application No. GB 0503470.7 Mar. 21, 2005.
Search and Examination Report to Application No. GB 0506697.2 May 20, 2005.
Search and Examination Report to Application No. GB 0507979.3 Jun. 16, 2005.
Search Report to Application No. GB 9926449.1, Mar. 27, 2000.
Search Report to Application No. GB 9926449.1, Jul. 4, 2001.
Search Report to Application No. GB 9926449.1, Sep. 5, 2001.
Search Report to Application No. GB 9926450.9, Feb. 28, 2000.
Examination Report to Application No. GB 9926450.9, May 15, 2002.
Examination Report to Application No. GB 9926450.9, Nov. 22, 2002.
Search Report to Application No. GB 9930398.4, Jun. 27, 2000.
Search Report to Application No. Norway 1999 5593, Aug. 20, 2002.
Halliburton Energy Services, "Halliburton Completion Products" 1996, p. Packers 5-37, United States of America.
Turcotte and Schubert, Geodynamics (1982) John Wiley & Sons, Inc., pp. 9, 432.
Baker Hughes Incorporated, "EXPatch Expandable Cladding System" (2002).
Baker Hughes Incorporated, "EXPress Expandable Screen System".
High-Tech Wells, "World's First Completion Set Inside Expandable Screen" (2003) Gilmer, J.M., Emerson, A.B.
Baker Hughes Incorporated, "Technical Overview Production Enhancement Technology" (Mar. 10, 2003) Geir Owe Egge.
Baker Hughes Incorporated, "FORMlock Expandable Liner Hangers".
Weatherford Completion Systems, "Expandable Sand Screens" (2002).
Expandable Tubular Technology, "EIS Expandable Isolation Sleeve" (Feb. 2003).
Oilfield Catalog; "Jet-Lok Product Application Description" (Aug. 8, 2003).

Power Ultrasonics, "Design and Optimisation of an Ultrasonic Die System For Form" Chris Cheers (1999, 2000).
Research Area—Sheet Metal Forming—Superposition of Vibra; Fraunhofer IWU (2001).
Research Projects;"Analysis of Metal Sheet Formability and It's Factors of Influence" Prof. Dorel Banabic (2003).
www.materialsresources.com, "Low Temperature Bonding of Dissimilar and Hard-to-Bond Materials and Metal-including.." (2004).
www.tribtech.com. "Trib-gel A Chemical Cold Welding Agent" G R Linzell (Sep. 14, 1999).
www.spurind.com, "Galvanic Protection, Metallurgical Bonds, Custom Fabrication—Spur Industries" (2000).
Lubrication Engineering, "Effect of Micro-Surface Texturing on Breakaway Torque and Blister Formation on Carbon-Graphite Faces In a Mechanical Seal" Philip Guichelaar, Karalyn Folkert, Izhak Etsion, Steven Pride (Aug. 2002).
Surface Technologies Inc., "Improving Tribological Performance of Mechanical Seals by Laser Surface Texturing" Izhak Etsion.
Tribology Transactions "Experimental Investigation of Laser Surface Texturing for Reciprocating Automotive Components" G Ryk, Y Klingerman and I Etsion (2002).
Proceeding of the International Tribology Conference, "Microtexturing of Functional Surfaces for Improving Their Tribological Performance" Henry Haefke, Yvonne Gerbig, Gabriel Dumitru and Valerio Romano (2002).
Sealing Technology, "A laser surface textured hydrostatic mechanical seal" Izhak Etsion and Gregory Halperin (Mar. 2003).
Metalforming Online, "Advanced Laser Texturing Tames Tough Tasks" Harvey Arbuckle.
Tribology Transactions, "A Laser Surface Textured Parallel Thrust Bearing" V. Brizmer. Y. Klingerman and I. Etsion (Mar. 2003).
PT Design, "Scratching the Surface" Todd E. Lizotte (Jun. 1999).
Tribology Transactions, "Friction-Reducing Surface-Texturing in Reciprocating Automotive Components" Aviram Ronen, and Izhak Etsion (2001).
Michigan Metrology "3D Surface Finish Roughness Texture Wear WYKO Veeco" C.A. Brown, PHD; Charles, W.A. Johnsen, S. Chester.
Letter From Baker Oil Tools to William Norvell in Regards to Enventure's Claims of Baker Infringement Of Enventure's Expandable Patents Apr. 1, 2005.
Offshore, "Agbada Well Solid Tubulars Expanded Bottom Up, Screens Expanded Top Down" William Furlow, Jan. 2002.(copy not available).
Drilling Contractor, "Solid Expandable Tubulars are Enabling Technology" Mar./Apr. 2001 .(copy not available).
Hart's E & P, "SET Technology: Setting the Standard" Mar. 2002.
Hart's E & P, "An Expanded Horizon" Jim Brock, Lev Ring, Scott Costa, Andrei Fillppov. Feb. 2000.
Hart's E & P, "Technology Strategy Breeds Value" Ali Daneshy. May 2004.
Hart's E & P, "Solid Expandable Tubulars Slimwell: Stepping Stone to MonoDiameter" Jun. 2003.
Innovators Chart the Course, Shell Exploration & Production.
"Case Study: Value in Drilling Derived From Application-Specific Technology" Langley, Diane., Oct. 2004.
L'Usine Nouvelle, "Les Tubes Expansibles Changent La Face Du Forage Petrolier" Demoulin, Laurence No. 2878 . pp. 50-52, 3 Juillet 2003.
Offshore, "Monodiameter Technology Keeps Hole Diameter to TD", Hull, Jennifer., Oct. 2002.
News Release, "Shell and Halliburton Agree to Form Company to Develop and Market Expandable Casing Technology", 1998.
Offshore, "Expandable Tubulars Enable Multilaterals Without Compromise on Hole Size," DeMong, Karl, et al., Jun. 2003.
Offshore Engineer, "From Exotic to Routine- the offshore quickstep" Apr. 2004, pp. 77-83.
Offshore, "Expandable Solid Casing Reduces Telescope Effect," Furlow, William, Aug. 1998, pp. 102 & 140.
Offshore, "Casing Expansion, Test Process Fine Tuned on Ultradeepwater Well," Furlow, William, Dec. 2000.
Offshore Engineer, "Ollfield Service Trio Target Jules Verne Territory," Von Flater, Rick., Aug. 2001.
Offshore, "Expandable Casing Program Helps Operator Hit TD With Larger Tubulars" Furlow, William, Jan. 2000.
Offshore, "Same Internal Casing Diameter From Surface to TD", Cook, Lance., Jul. 2002.
Oil and Gas Investor, "Straightening the Drilling Curve," Williams, Peggy. Jan. 2003.
Petroleum Engineer International, "Expandable Casing Accesses Remote Reservoirs" Apr. 1999.
New Technology Magazine, "Pipe Dream Reality," Smith, Maurice, Dec. 2003.
Roustabout, "First ever SET Workshop Held in Aberdeen," Oct. 2004.
Roustabout, "Enventure Ready to Rejuvenate the North Sea" Sep. 2004.
EP Journal of Technology, "Solid Expandable Tubulars (SET) Provide Value to Operators Worldwide in a Variety of Applications," Fonlova, Rick, Apr. 2005.
The American Oil & Gas Reporter, "Advances Grow Expandable Applications," Bullock, Michael D., Sep. 2004.
Upstream, "Expandable Tubulars Close in on the Holy Grail of Drilling", Cottrill, Adrian, Jul. 26, 2002.
Oil and Gas, "Shell Drills First Monodiameter Well in South Texas" Sumrow, Mike., Oct. 21, 2002.
World Oil, "Expandables and the Dream of the Monodiameter Well: A Status Report", Fischer, Perry, Jul. 2004.
World Oil, "Well Remediation Using Expandable Cased-Hole Liners", Merritt, Randy et al., Jul. 2002.
World Oil, "How in Situ Expansion Affects Casing and Tubing Properties", Mack, R.D., et al., Jul. 1999. pp. 69-71.
Enventure Global Technology "Expandable Tubular Technology—Drill Deeper, Farther, More Economically" Mark Rivenbark. EGT10171.
Society of Petroleum Engineers, "Addressing Common Drilling Challenges Using Solid Expandable Tubular Technology" Perez-Roca, Eduardo, et al., 2003.
Society of Petroleum Engineers, "Monodiameter Drilling Liner—From Concept to Reality" Dean, Bill, et al. 2003.
Offshore Technology Conference, "Expandable Liner Hangers: Case Histories" Moore, Melvin, J., et al., 2002.
Offshore Technology Conference, "Deepwater Expandable Openhole Liner Case Histories: Learnings Through Field Applications" Grant, Thomas P., et al., 2002.
Offshore Technology Conference, "Realization of the MonoDiameter Well: Evolution of a Game-Changing Technology" Dupal, Kenneth, et al., 2002.
Offshore Technology Conference, "Water Production Reduced Using Solid Expandable Tubular Technology to "Clad" in Fractured Carbonate Formation" van Noort, Roger, et al., 2003.
Offshore Technology Conference, "Overcoming Well Control Challengers with Solid Expandable Tubular Technology" Patin, Michael, et al., 2003.
Offshore Technology Conference, "Expandable Cased-hole Liner Remediates Prolific Gas Well and Minimizes Loss of Production" Buckler Bill, et al., 2002.
Offshore Technology Conference, "Development and Field Testing of Solid Expandable Corrosion Resistant Cased-hole Liners to Boost Gas Production in Corrosive Environments" Siemers Gertjan, et al., 2003.
"Practices for Providing Zonal Isolation in Conjunction with Expandable Casing Jobs-Case Histories" Sanders, T, et al. 2003.
Society of Petroleum Engineers, "Increasing Solid Expandable Tubular Technology Reliability in a Myriad of Downhole Environments", Escobar, C. et al., 2003.
Society of Petroleum Engineers, "Water Production Management—PDO's Successful Application of Expandable Technology", Braas, JCM., et al., 2002.
Society of Petroleum Engineers, "Expandable Tubular Solutions", Filippov, Andrei, et al., 1999.
Society of Petroleum Engineers, "Expandable Liner Hanger Provides Cost-Effective Alternative Solution" Lohoefer, C. Lee, et al., 2000.
Society of Petroleum Engineers, "Solid Expandable Tubular Technology—A Year of Case Histories in the Drilling Environment" Dupal, Kenneth, et al., 2001.

"In-Situ Expansion of Casing and Tubing" Mack, Robert et al.
Society of Petroleum Engineers, "Expandable Tubulars: Field Examples of Application in Well Construction and Remediation" Diagle, Chan, et al., 2000.
AADE Houston Chapter, "Subsidence Remediation—Extending Well Life Through the Use of Solid Expandable Casing Systems" Shepherd, David, et al., Mar. 2001 Conference.
Society of Petroleum Engineers, "Planning the Well Construction Process for the Use of Solid Expandable Casing" DeMong, Karl, et al., 2003.
Enventure Global Technology, "The Development and Applications of Solid Expandable Tubular Technology" Cales, GL., 2003.
Society of Petroleum Engineers, "Installation of Solid Expandable Tubular Systems Through Milled Casing Windows" Waddell, Kevin, et al., 2004.
Society of Petroleum Engineers, "Solid Expandable Tubular Technology in Mature Basins" Biasingame, Kate, et al., 2003.
"Casing Design in Complex Wells: The Use of Expandables and Multilateral Technology to Attack the size Reduction Issue" DeMong, Karl., et al.
"Well Remediation Using Expandable Cased-Hole Liners—Summary of Case Histories" Merritt, Randy, et al.
Offshore Technology Conference, "Transforming Conventional Wells to Bigbore Completions Using Solid Expandable Tubular Technology" Mohd Nor, Norlizah, et al., 2002.
Society of Petroleum Engineers, "Using Solid Expandable Tubulars for Openhole Water Shutoff" van Noort, Roger, et al., 2002.
Society of Petroleum Engineers, "Case Histories- Drilling and Recompletion Applications Using Solid Expandable Tubular Technology" Campo. Don, et al., 2002.
Society of Petroleum Engineers, "Reaching Deep Reservoir Targets Using Solid Expandable Tubulars" Gusevik Rune, et al., 2002.
Society of Petroleum Engineers, "Breakthroughs Using Solid Expandable Tubulars to Construct Extended Reach Wells" Demong, Karl, et al., 2004.
Deep Offshore Technology Conference "Meeting Economic Challenges of Deepwater Drilling with Expandable-Tubular Technology" Haut, Richard, et al.,1999.
Offshore Technology Conference, "Field Trial Proves Upgrades to Solid Expandable Tubulars" Moore, Melvin, et al., 2002.
"Well Design with Expandable Tubulars Reduces Cost and Increases Success in Deepwater Applications" Dupal, Ken, et al., Deep Shore Technology 2000.
Offshore Technology Conference, "Reducing Non-Productive Time Through the Use of Solid Expandable Tubulars: How to Beat the Curve Through Pre-Planning" Cales, Gerry, et al., 2004.
Offshore Technology Conference, "Three Diverse Applications on Three Continents for a Single Major Operator" Sanders, Tom, et al., 2004.
Offshore Technology Conference,, "Expanding Oil Field Tubulars Through a Window Demonstrates Value and Provides New Well Construction Option" Sparling, Steven, et al., 2004.
Society of Petroleum Engineers, "Advances in Single-diameter Well Technology: The Next Step to Cost-Effective Optimization" Waddell, Kevin, et al., 2004.
Society of Petroleum Engineers, "New Technologies Combine to Reduce Drilling Cost in Ultradeepwater Applications" Touboul, Nicolas, et al., 2004.
Society of Petroleum Engineers, "Solid Expandable Tubular Technology: The Value of Planned Installation vs. Contingency" Rivenbark, Mark, et al., 2004.
Society of Petroleum Engineers, "Changing Safety Paradigms in the Oil and Gas Industry" Ratliff, Matt, et al., 2004.
"Casing Remediation- Extending Well Life Through The Use of Solid Expandable Casing Systems" Merritt, Randy, et al.
Society of Petroleum Engineers, "Window Exit Sidetrack Enhancement Through the Use of Solid Expandable Casing", Rivenbark, Mark, et al., 2004.
"Solid Expandable Tubular Technology: The Value of Planned Installations vs. Contingency", Carstens, Chris, et al.
*Data Sheet, "Enventure Cased-Hole Liner (CHL) System" Enventure Global Technology*, Dec. 2002.
Case History, "Graha Ranch No. 1 Newark East Barnett Field" Enventure Global Technology, Feb. 2002.
Case History, "K.K. Camel No. 1 Ridge Field Lafayette Parish, Louisiana" Enventure Global Technology, Feb. 2002.
Case History, "Eemskanaal -2 Groningen" Enventure Global Technology, Feb. 2002.
Case History, "Yibal 381 Oman" Enventure Global Technology, Feb. 2002.
Case History, "Mississippi Canyon 809 URSA TLP, OSC-G 5868, No. A-12" Enventure Global Technology, Mar. 2004.
Case History, "Unocol Sequoia Mississippi Canyon 941 Well No. 2" Enventure Global Technology, 2005.
"Set Technology: The Facts" Enventure Global Technology, 2004.
Data Sheet, "Enventure Openhole Liner (OHL) System" Enventure Global Technology, Dec. 2002.
Data Sheet, "Windows Exit Applications OHL Window Exit Expansion" Enventure Global Technology, Jun. 2003.
Combined Search Report and Written Opinion to Application No. PCT/US04/00631; Mar. 28, 2005.
Combined Search Report and Written Opinion to Application No. PCT/US04/02122, Feb. 24, 2005.
Combined Search Report and Written Opinion to Application No. PCT/US04/04740, Jan. 19, 2005.
Combined Search Report and Written Opinion to Application No. PCT/US04/06246, Jan. 26, 2005.
Combined Search Report and Written Opinion to Application No. PCT/US04/08030, Jan. 6, 2005.
Combined Search Report and Written Opinion to Application No. PCT/US04/08073, Mar. 4, 2005.
Combined Search Report and Written Opinion to Application No. PCT/US04/08170, Jan. 13, 2005.
Combined Search Report and Written Opinion to Application No. PCT/US04/08171, Feb. 16, 2005.
Combined Search Report and Written Opinion to Application No. PCT/US04/11172, Feb. 14, 2005.
Combined Search Report and Written Opinion to Application No. PCT/US04/28438, Mar. 14, 2005.
Written Opinion to Application No. PCT/US01/19014; Dec. 10, 2002.
Written Opinion to Application No. PCT/US01/23815; Jul. 25, 2002.
Written Opinion to Application No. PCT/US01/28960; Dec. 2, 2002.
Written Opinion to Application No. PCT/US01/30256; Nov. 11, 2002.
Written Opinion to Application No. PCT/US02/00093; Apr. 21, 2003.
Written Opinion to Application No. PCT/US02/00877; Apr. 17, 2003.
Written Opinion to Application No. PCT/US02/04353; Apr. 11, 2003.
Written Opinion to Application No. PCT/US02/20256; May 9, 2003.
Written Opinion to Application No. PCT/US02/24399; Apr. 28, 2004.
Written Opinion to Application No. PCT/US02/25608, Sep. 13, 2004.
Written Opinion to Application No. PCT/US02/25608, Feb. 2, 2005.
Written Opinion to Application No. PCT/US03/25675, Nov. 24, 2004.
Written Opinion to Application No. PCT/US02/25727; May 17, 2004.
Written Opinion to Application No. PCT/US02/39418; Jun. 9, 2004.
Written Opinion to Appliction No. PCT/US02/39425; Nov. 22, 2004.
Written Opinion to Application No. PCT/US02/39425; Apr. 11, 2005.
Written Opinion to Appliction No. PCT/US03/06544; Feb. 18, 2005.
Written Opinion to Application No. PCT/US03/11765 May 11, 2004.
Written Opinion to Application No. PCT/US03/13787 Nov. 9, 2004.
Written Opinion to Application No. PCT/US03/14153 Sep. 9, 2004.
Written Opinion to Application No. PCT/US03/14153 Nov. 9, 2004.
Written Opinion to Application No. PCT/US03/18530 Sep. 13, 2004.
Written Opinion to Application No. PCT/US03/19993 Oct. 15, 2004.
Written Opinion to Application No. PCT/US03/25675 May 9, 2005.
Written Opinion to Application No. PCT/US03/29858 Jan. 21, 2004.
Written Opinion to Application No. PCT/US03/38550 Dec. 10, 2004.

Written Opinion to Application No. PCT/US04/08171 May 5, 2005.
Baker Hughes, "Expatch Expandable Cladding System," Oct. 2002.
Baker Hughes, "Express Expandable Screen System,".
Baker Hughes, "Formlock Expandable Liner Hangers,".
Banabic, "Research Projects," Jan. 30, 1999.
Cales et al., "Subsidence Remediation—Extending Well Life Through the Use of Solid Expandable Casing Systems," *AADE Houston Chapter,* Mar. 27, 2001.
Case History, "Eemskanaal -2 Groningen," Enventure Global Technology, Feb. 2002.
Case History, "Graham Ranch No. 1 Newark East Barnett Field" Enventure Global Technology, Feb. 2002.
Case History, "K.K. Camel No. 1 Ridge Field Lafayette Parish, Louisiana," Enventure Global Technology, Feb. 2002.
Case History, "Mississippi Canyon 809 URSA TLP, OSC-G 5868, No. A-12," Enventure Global Technology, Mar. 2004.
Case History, "Yibal 381 Oman," Enventure Global Technology, Feb. 2002.
Data Sheet, "Enventure Openhole Linear (OHL) System" Enventure Global Technology, Dec. 2002.
Duphorne, "Letter Re: Enventure Claims of Baker Infringement of Enventure's Expandable Patents," Apr. 1, 2005.
"EIS Expandable Isolation Sleeve" *Expandable Tubular Technology,* Feb. 2003.
Enventure Global Technology, Solid Expandable Tubulars are Enabling Technology, *Drilling Cantractor,* Mar.-Apr. 2001.
"Expandable Casing Accesses Remote Reservoirs," *Petroleum Engineer International,* Apr. 1999.
Fraunhofer Iwu, "Research Area: Sheet Metal Forming—Superposition of Vibrations," 2001.
"Innovators Chart the Course,".
Linzell, "Trib-Gel A Chemical Cold Welding Agent," 1999.
Mohawk Energy, :Minimizing Drilling Ecoprints Houston, Dec. 16, 2005.
News Release, "Shell and Halliburton Agree to Form Company to Develop and Market Expandable Casing Technology," Jun. 3, 1998.
Sanders et al., Practices for Providing Zonal Isolation in Conjunction with Expandable Casing Jobs-Case Histories, 2003.
"Set Technology: The Facts" 2004.
"Slim Well:Stepping Stone to MonoDiameter," *Hart's E&P,* Jun. 2003.
www.MITCHMET.com, "3d Surface Texture Parameters," 2004.
www.SPURIND.com, "Glavanic Protection, Metallurigical Bonds, Custom Fabrications -Spur Industries," 2000.
"Expand Your Opportunities." *Enventure*. CD-ROM. Jun. 1999.
"Expand Your Opportunities." *Enventure*. CD-ROM. May 2001.
International Preliminary Examination Report, Application PCT/US02/24399, Aug. 6, 2004.
International Preliminary Examination Report, Application PCT/US02/25608, Jun. 1, 2005.
International Preliminary Examination Report, Application PCT/US02/25727, Jul. 7, 2004.
International Preliminary Examination Report PCT/US02/36157, Apr. 14, 2004.
International Preliminary Examination Report, Application PCT/US02/36267, Jan. 4, 2004.
International Preliminary Examination Report, Application PCT/US02/39418, Feb. 18, 2005.
International Preliminary Examination Report, Application PCT/US02/39425, Nov. 16, 2005.
International Preliminary Examination Report, Application PCT/US03/04837, Dec. 9, 2004.
International Preliminary Examination Report, Application PCT/US03/06544, May 10, 2005.
International Preliminary Examination Report, Application PCT/US03/10144, Jul. 7, 2004.
International Preliminary Examination Report, Application PCT/US03/11765, Dec. 10, 2004.
International Preliminary Examination Report, Application PCT/US03/11765, Jan. 25, 2005.
International Preliminary Examination Report, Application PCT/US03/11765, Jul. 18, 2005.
International Preliminary Examination Report, Application PCT/US01/11765, Aug. 15, 2005 (Corrected).
International Preliminary Examination Report, Application PCT/US03/13787, Mar. 2, 2005.
International Preliminary Examination Report, Application PCT/US03/13787, Apr. 7, 2005.
International Preliminary Examination Report, Application PCT/US03/14153, May 12, 2005.
International Preliminary Examination Report, Application PCT/US03/15020, May 9, 2005.
International Preliminary Examination Report, Application PCT/US03/15020 (corrected), Nov. 14, 2004.
International Preliminary Examination Report, Application PCT/US03/20870, Sep. 30, 2004.
International Preliminary Examination Report, Application PCT/US03/25667, May 25, 2005.
International Preliminary Examination Report, Application PCT/US03/25675, Aug. 30, 2005.
International Preliminary Examination Report, Application PCT/US03/25676, Aug. 17, 2004.
International Preliminary Examination Report, Application PCT/US03/25677, Aug. 17, 2004.
International Preliminary Examination Report, Application PCT/US03/25742, Dec. 20, 2004.
International Preliminary Examination Report, application PCT/US03/29460, Dec. 8, 2004.
International Preliminary Examination Report, Application PCT/US03/29858, May 23, 2005.
International Preliminary Examination Report, Application PCT/US03/29859, Aug. 16, 2004.
International Preliminary Examination Report, Application PCT/US03/38550, May 23, 2005.
International Preliminary Report on Patentability, Application PCT/US04/008170, Sep. 29, 2005.
International Preliminary Report on Patentability, Application PCT/US04/08171, Sep. 13, 2005.
International Preliminary Report on Patentability, Application PCT/US04/28438, Sep. 20, 2005.
Written Opinion to Application No. PCT/US03/25675, May 9, 2005.
Combined Search Report and Written Opinion to Application No. PCT/US04/10762, Sep. 1, 2005.
Combined Search Report and Written Opinion to Application No. PCT/US04/11973, Sep. 27, 2005.
Combined Search Report and Written Opinion to Application No. PCT/US04/28423, Jul. 13, 2005.
Combined Search Report and Written Opinion to Application No. PCT/US04/28831, Dec. 19, 2005.
Combined Search Report and Written Opinion to Application No. PCT/US04/28889, Nov. 14, 2005.
Examination Report to Application No. GB 0316883.8, Nov. 25, 2003.
Examination Report to Application No. GB 0316886.1, Nov. 25, 2003.
Examination Report to Application No. GB 0316887.9, Nov. 25, 2003.
Examination Report to Application No. GB 0400018.8, May 17, 2005.
Examination Report to Application No. GB 0400019.6, Sep. 2, 2005.
Examination Report to Application No. GB 0400019.6, Nov. 4, 2005.
Examination Report to Application No. GB 0404833.6, Aug. 19, 2004.
Examination Report to Application No. GB 0406257.6, Sep. 2, 2005.
Examination Report to Application No. GB 0406257.6, Nov. 9, 2005.
Examination Report to Application No. GB 0406258.4, Jul. 27, 2005.
Examination Report to Appliction No. GB 0416834.0, Nov. 16, 2004.
Examination Report to Application No. GB 0422419.2, Nov. 8, 2005.
Examination Report to Application No. GB 0422893.8, Aug. 8, 2005.
Examination Report to Application No. GB 0422893.8, Dec. 15, 2005.
Examination Report to Application No. GB 0425948.7, Nov. 24, 2005.
Examination Report to Application No. GB 0425956.0, Nov. 24, 2005.

Examination Report to Application No. GB 0428141.6, Sep. 15, 2005.
Examination Report to Application No. GB 0500184.7, Sep. 12, 2005.
Examination Report to Application No. GB 0500600.2, Sep. 6, 2005.
Examination Report to Application No. GB 0503250.3, Nov. 15, 2005.
Examination Report to Application No. GB 0503470.7, Sep. 22, 2005.
Examination Report to Application No. GB 0506699.8, Sep. 21, 2005.
Examination Report to Application No. GB 0507979.3, Jun. 16, 2005.
Examination Report to Application No. GB 0507980.1, Sep. 29, 2005.
Examination Report to Application No. GB 0517448.7, Nov. 9, 2005.
Examination Report to Application No. GB 0518025.2, Oct. 27, 2005.
Examination Report to Application No. GB 0518039.3, Nov. 29, 2005.
Examination Report to Application No. GB 0518252.2, Oct. 28, 2005.
Examination Report to Application No. GB 0518799.2, Nov. 9, 2005.
Examination Report to Application No. GB 0518893.3, Dec. 16, 2005.
Examination Report to Application No. GB 0521024.0, Dec. 22, 2005.
Examination Report to Application No. GB 0522050.4, Dec. 13, 2005.
Search and Examination Report to Application No. GB 0412876.5, Sep. 27, 2005.
Search and Examination Report to Application No. GB 0505039.8, Jul. 22, 2005.
Search and Examination Report to Application No. GB 0506700.4, Sep. 20, 2005.
Search and Examination Report to Application No. GB 0509618.5, Sep. 27, 2005.
Search and Examination Report to Application No. GB 0509620.1, Sep. 27, 2005.
Search and Examination Report to Application No. GB 0509626.8, Sep. 27, 2005.
Search and Examination Report to Application No. GB 0509627.6, Sep. 27, 2005.
Search and Examination Report to Application No. GB 0509629.2, Sep. 27, 2005.
Search and Examination Report to Application No. GB 0509630.0, Sep. 27, 2005.
Search and Examination Report to Application No. GB 0509631.8, Sep. 27, 2005.
Search and Examination Report to Application No. GB 0512396.3, Jul. 26, 2005.
Search and Examination Report to Application No. GB 0512398.9, Jul. 27, 2005.
Search and Examination Report to Application No. GB 0516429.8, Nov. 7, 2005.
Search and Examination Report to Application No. GB 0516430.6, Nov. 8, 2005.
Search and Examination Report to Application No. GB 0516431.4, Nov. 8, 2005.
Search and Examination Report to Application No. GB 0522892.9 Jan. 5, 2006.
Search and Examination Report to Application No. GB 0523075.0, Jan. 12, 2006.
Search and Examination Report to Application No. GB 0523076.8, Dec. 14, 2005.
Search and Examination Report to Application No. GB 0523078.4, Dec. 13, 2005.
Search and Examination Report to Application No. GB 0523132.9, Jan. 12, 2006.
Search and Examination Report to Application No. GB 0524692.1, Dec. 19, 2005.
Examination Report to Application No. AU 2003257878, Jan. 19, 2006.
Examination Report to Application No. AU 2003257881, Jan. 19, 2006.
Search Report to Application No. EP 03071281.2; Nov. 14, 2005.
Search Report to Application No. EP 03723674.2; Nov. 22, 2005.
Examination Report dated Nov. 12, 2007 on Australian Patent Application No. 2002301204.
Examination Report dated Nov. 12, 2007 on Australian Patent Application No. 2002301542.
Examination Report dated Oct. 13, 2006 on Australian Patent Application No. 200400246.
Examination Report dated Sep. 22, 2006 on Australian Patent Application No. 2004200248.
Examination Report dated Mar. 7, 2007 on Australian Patent Application No. 2002367017.
Examination Report dated Jun. 5, 2007 on Brazilian patent application No. PI 9906143-0.
Examination Report dated Oct. 16, 2007 on Brazilian patent application No. PI 0003319-7.
Examination Report dated Nov. 13, 2007 on Canadian Patent Application No. 2397480.
Examination Report dated Jul. 3, 2007 on Canadian Patent Application No. 2536623.
Examination Report dated Jun. 12, 2007 on Canadian Patent Application No. 2516140.
Examination Report dated Feb. 20, 2007 on Canadian Patent Application No. 2428819.
Examination Report dated Feb. 26, 2007 on Canadian Patent Application No. 2389094.
Examination Report dated Oct. 11, 2007 on European Patent Application No. 2806451.7.
Examination Report dated Jul. 4, 2007 on European Patent Application No. 3728326.4.
Examination Report dated Apr. 2, 2007 on European Patent Application No. 3701281.2.
Examination Report dated Jan. 10, 2007 on European Patent Application No. 3723674.2.
Examination Report dated Sep. 14, 2007 on German Patent Application No. 199 58 399.4-24.
Examination Report dated Mar. 15, 2007 on British patent application No. 602877.3.
Examination Report dated Sep. 17, 2007 on British patent application No. 602877.3.
Examination Report dated Sep. 18, 2007 on British patent application No. 604359.0.
Examination Report dated Sep. 13, 2007 on British Patent application No. 604360.8.
Examination Report dated Aug. 7, 2007 on British Patent application No. 613924.0.
Examination Report dated May 23, 2007 on British patent application No. 621060.3.
Examination Report dated Jul. 23, 2007 on British patent application No. 621060.3.
Examination Report dated Jun. 21, 2007 on British patent application No. 621059.5.
Examination Report dated Aug. 8, 2007 on British patent application No. 621059.5
Examination Report dated Jun. 21, 2007 on British patent application No. 621053.8.
Examination Report dated Aug. 13, 2007 on British patent application No. 621053.8.
Examination Report dated Aug. 17, 2007 on British patent application No. 603576.
Examination Report dated May 23, 2007 on British patent application No. 621062.9.
Examination Report dated Jul. 23, 2007 on British patent application No. 621062.9.
Examination Report dated Apr. 5, 2007 on British patent application No. 613406.8.
Examination Report dated Jun. 22, 2007 on British patent application No. 609173.
Examination Report dated Sep. 14, 2007 on British patent application No. 623634.3.

Examination Report dated Jul. 5, 2007 on British patent application No. 624328.1.
Examination Report dated Sep. 4, 2007 on British patent application No. 624328.1.
Examination Report dated Oct. 26, 2007 on British patent application No. 624328.1.
Examination Report dated Sep. 5, 2007 on British patent application No. 624394.3.
Examination Report dated Sep. 5, 2007 on British patent application No. 624768.
Examination Report dated Sep. 13, 2007 on British patent application No. 624779.5.
Examination Report dated Aug. 15, 2007 on British patent application No. 625615.
Examination Report dated Jul. 26, 2007 on British patent application No. 522049.6.
Examination Report dated Mar. 5, 2007 on British patent application No. 522049.6.
Examination Report dated Sep. 7, 2007 on British patent application No. 522049.6.
Examination Report dated Aug. 16, 2007 on British patent application No. 625636.6.
Examination Report dated Jul. 16, 2007 on British patent application No. 522155.1.
Examination Report dated Sep. 26, 2007 on British patent application No. 624781.1.
Search and Examination Report dated Aug. 16, 2007 on British patent application No. 621054.6.
Search and Examination Report dated Oct. 5, 2007 on British patent application No. 623631.9.
Search and Examination Report dated Mar. 30, 2007 on British patent application No. 702797.2.
Search and Examination Report dated Aug. 2, 2007 on British Patent application No. 702797.2.
Search and Examination Report dated Mar. 19, 2007 on British patent application No. 624327.3.
Search and Examination Report dated Aug. 15, 2007 on British patent application No. 624327.3.
Search and Examination Report dated Mar. 19, 2007 on British patent application No. 625615.
Search and Examination Report dated Jun. 28, 2007 on British patent application No. 707073.3.
Search and Examination Report dated Jul. 31, 2007 on British patent application No. 706794.5.
Search and Examination Report dated Jun. 7, 2007 on British patent application No. 706799.4.
Search and Examination Report dated Sep. 3, 2007 on British patent application No. 715477.6.
Search and Examination Report dated Sep. 3, 2007 on British patent application No. 715478.4.
Search and Examination Report dated Sep. 3, 2007 on British patent application No. 715362.
Search and Examination Report dated Sep. 4, 2007 on British patent application No. 715357.
Search and Examination Report dated Sep. 4, 2007 on British patent application No. 715365.3.
Search and Examination Report dated Mar. 15, 2007 on British patent application No. 625636.6.
Search and Examination Report dated Mar. 15, 2007 on British patent application No. 624394.3.
Search and Examination Report dated Mar. 15, 2007 on British patent application No. 604357.4.
Search and Examination Report dated Mar. 15, 2007 on British patent application No. 623631.9.
Search and Examination Report dated Mar. 15, 2007 on British patent application No. 623634.3.
Search and Examination Report dated Apr. 24, 2007 on British patent application No. 702989.5.
Search and Examination Report dated Mar. 15, 2007 on British patent application No. 624779.5.
Search and Examination Report dated Mar. 15, 2007 on British patent application No. 624790.2.
Search and Examination Report dated Mar. 15, 2007 on British patent application No. 603995.2.
Search and Examination Report dated Oct. 10, 2007 on British patent application No. 603995.2.
Search and Examination Report dated Mar. 15, 2007 on British patent application No. 6043593.
Search and Examination Report dated Mar. 15, 2007 on British patent application No. 604360.8.
Search Report dated Jun. 6, 2007 on British patent application No. 613406.8.
Substantive Examination dated Jul. 25, 2007 on Mexican patent application No. PA/A/2004/006681.
Examination Report dated Oct. 5, 2007 on Mexican patent application No. PA/A/2005/003117.
Examination Report dated Oct. 16, 2007 on Mexican patent application No. PA/A/2005/003116.
Examination Report dated Oct. 5, 2007 on Mexican patent application No. PA/A/2004/007922.
Examination Report dated Aug. 31, 2007 on Norwegian Patent Application No. 20002876.
Examination Report dated May 23, 2007 on Norwegian patent application No. 20001281.
Examination Report dated Jul. 26, 2007 on Norwegian patent application No. 20021613.
Examination Report dated Oct. 10, 2005 on Norwegian patent application No. 20000924.
Examination Report dated Aug. 3, 2007 on Norwegian patent applic-tion No. 20000924.
International Preliminary Exam Report dated May 23, 2007 on International patent application No. PCT/US06/009886.
Written Opinion of ISA dated Aug. 2, 2007 on International patent application No. PCT/US05/028451.
Search Report of ISA dated Aug. 2, 2007 on International patent application No. PCT/US05/028451.

* cited by examiner

MONO-DIAMETER WELLBORE CASING

CROSS REFERENCE TO RELATED APPLICATIONS

This application is a divisional of U.S. application Ser. No. 10/465,835, filed Jun. 13, 2003, now U.S. Pat. No. 7,185,710, which was the U.S. National Phase utility patent application corresponding to PCT patent application Ser. No. PCT/US02/00677, filed on Jan. 11, 2002, having a priority date of Jan. 17, 2001, and claimed the benefit of the filing date of U.S. provisional patent application Ser. No. 60/262,434, filed on Jan. 17, 2001, the disclosures of which are incorporated herein by reference.

This application is a divisional of U.S. application Ser. No. 10/465,835, filed Jun. 13, 2003, which was a continuation-in-part of U.S. application Ser. No. 10/418,687, filed on Apr. 18, 2003, which was a continuation of U.S. application Ser. No. 09/852,026, filed on May 9, 2001, which issued as U.S. Pat. No. 6,561,227, which was a continuation of U.S. application Ser. No. 09/454,139, filed on Dec. 3, 1999, which issued as U.S. Pat. No. 6,497,289, which claimed the benefit of the filing date of U.S. provisional patent application Ser. No. 60/111,293, filed on Dec. 7, 1998, the disclosures of which are incorporated herein by reference.

This application is related to the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application Ser. No. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, (21) U.S. provisional patent application Ser. No. 60/237,334, filed on Oct. 2, 2000, and (22) U.S. provisional patent application Ser. No. 60259,486, filed on Jan. 3, 2001, the disclosures of which are incorporated herein by reference.

This application is related to the following co-pending applications: (1) U.S. Pat. No. 6,497,289, which was filed as U.S. patent application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application 60/121,702, filed on Feb. 25, 1999, (3) U.S. patent application Ser. No. 09/502,350, filed on Feb. 10, 2000, which claims priority from provisional application 60/119,611, filed on Feb. 11, 1999, (4) U.S. Pat. No. 6,328,113, which was filed as U.S. patent application Ser. No. 09/440,338, filed on Nov. 15, 1999, which claims priority from provisional application 60/108,558, filed on Nov. 16, 1998, (5) U.S. patent application Ser. No. 10/169,434, filed on Jul. 1, 2002, which claims priority from provisional application 60/183,546, filed on Feb. 18, 2000, (6) U.S. patent application Ser. No. 09/523,468 (now U.S. Pat. No. 6,640,903), filed on Mar. 10, 2000, which claims priority from provisional application 60/124,042, filed on Mar. 11, 1999, (7) U.S. Pat. No. 6,568,471, which was filed as patent application Ser. No. 09/512,895, filed on Feb. 24, 2000, which claims priority from provisional application 60/121,841, filed on Feb. 26, 1999, (8) U.S. Pat. No. 6,575,240, which was filed as patent application Ser. No. 09/511,941, filed on Feb. 24, 2000, which claims priority from provisional application 60/121,907, filed on Feb. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. patent application Ser. No. 09/981,916, filed on Oct. 18, 2001 as a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (11) U.S. Pat. No. 6,604,763, which was filed as application Ser. No. 09/559,122, filed on Apr. 26, 2000, which claims priority from provisional application 60/131,106, filed on Apr. 26, 1999, (12) U.S. patent application Ser. No. 10/030,593, filed on Jan. 8, 2002, which claims priority from provisional application 60/146,203, filed on Jul. 29, 1999, (13) U.S. provisional patent application Ser. No. 60/143,039, filed on Jul. 9, 1999, (14) U.S. patent application Ser. No. 10/111,982, filed on Apr. 30, 2002, which claims priority from provisional patent application Ser. No. 60/162,671, filed on Nov. 1, 1999, (15) U.S. provisional patent application Ser. No. 60/154,047, filed on Sep. 16, 1999, (16) U.S. provisional patent application Ser. No. 60/438,828, filed on Jan. 9, 2003, (17) U.S. Pat. No. 6,564,875, which was filed as application Ser. No. 09/679,907, on Oct. 5, 2000, which claims priority from provisional patent application Ser. No. 60/159,082, filed on Oct. 12, 1999, (18) U.S. patent application Ser. No. 10/089,419, filed on Mar. 27, 2002, which claims priority from provisional patent application Ser. No. 60/159,039, filed on Oct. 12, 1999, (19) U.S. patent application Ser. No. 09/679,906, filed on Oct. 5, 2000, which claims priority from provisional patent application Ser. No. 60/159,033, filed on Oct. 12, 1999, (20) U.S. patent application Ser. No. 10/303,992, filed on Nov. 22, 2002, which claims priority from provisional patent application Ser. No. 60/212,359, filed on Jun. 19, 2000, (21) U.S. provisional patent application Ser. No. 60/165,228, filed on Nov. 12, 1999, (22) U.S. provisional patent application Ser. No. 60/455,051, filed on Mar. 14, 2003, (23) PCT application US02/2477, filed on Jun. 26, 2002, which claims priority from U.S. provisional patent application Ser. No. 60/303,711, filed on Jun. 6, 2001, (24) U.S. patent application Ser. No. 10/311,412, filed on Dec. 12, 2002, which claims priority from provisional patent application Ser. No. 60/221,443, filed on Jul. 28, 2000, (25) U.S. patent application Ser. No. 10/322,947, filed on Dec. 18, 2002, which claims priority from provisional patent application Ser. No. 60/221,645, filed on Jul. 28, 2000, (26) U.S. patent application Ser. No. 10/322,947, filed on Jan. 22, 2003, which claims priority from provisional patent application Ser. No. 60/233,638, filed on Sep. 18, 2000, (27) U.S. patent application Ser. No. 10/406,648, filed on Mar. 31, 2003, which claims priority from provisional patent application Ser. No. 60/237,334, filed on Oct. 2, 2000, (28) PCT application US02/04353, filed on Feb. 14, 2002, which claims priority from U.S. provisional patent application Ser. No. 60/270,007, filed on Feb. 20, 2001, (29) U.S. patent application Ser. No. 10/465,835, filed on Jun. 13, 2003, which claims priority from provisional patent application Ser. No. 60/262,434, filed on Jan. 17, 2001, (30) U.S. patent application Ser. No. 10/465,831, filed on Jun. 13, 2003, which claims priority from U.S. provisional patent application Ser. No. 60/259,486, filed on Jan. 3, 2001, (31) U.S. provisional patent application Ser. No. 60/452,303, filed on Mar. 5, 2003, (32) U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (33) U.S. Pat. No. 6,561,227, which was filed as patent application Ser. No. 09/852,026, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (34) U.S. patent application Ser. No. 09/852,027, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (35) PCT Application US02/25608, filed on Aug. 13, 2002, which claims priority from provisional application 60/318,021, filed on Aug. 7, 2001, (36) PCT Application US02/24399, filed on Aug. 1, 2002, which claims priority from U.S. provisional patent application Ser. No. 60/313,453, filed on Aug. 20, 2001, (37) PCT Application US02/29856, filed on Sep. 19, 2002, which claims priority from U.S. provisional patent application Ser. No. 60/326,886, filed on Oct. 3, 2001, (38) PCT Application US02/20256, filed on Jun. 26, 2002, which claims priority from U.S. provisional patent application Ser. No. 60/303,740, filed on Jul. 6, 2001, (39) U.S. patent application Ser. No. 09/962,469, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (40) U.S. patent application Ser. No. 09/962,470, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (41) U.S. patent application Ser. No. 09/962,471, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (42) U.S. patent application Ser. No. 09/962,467, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (43) U.S. patent application Ser. No. 09/962,468, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (44) PCT application US 02/25727, filed on Aug. 14, 2002, which claims priority from U.S. provisional patent application Ser. No. 60/317,985, filed on Sep. 6, 2001, and U.S. provisional patent application Ser. No. 60/318,386, filed on Sep. 10, 2001, (45) PCT application US 02/39425, filed on Dec. 10, 2002, which claims priority from U.S. provisional patent application Ser. No. 60/343,674, filed on Dec. 27, 2001, (46) U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (47) U.S. utility patent application Ser. No. 10/516,467, filed on Dec. 10, 2001, which is a continuation application of U.S. utility patent application Ser. No. 09/969,922, filed on Oct. 3, 2001, (now U.S. Pat. No. 6,634,431 which issued Dec. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (48) PCT application US 03/00609, filed on Jan. 9, 2003, which claims priority from U.S. provisional patent application Ser. No. 60/357,372, filed on Feb. 15, 2002, (49) U.S. patent application Ser. No. 10/074,703, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (50) U.S. patent application Ser. No. 10/074,244, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (52) U.S. patent application Ser. No. 10/076,661, filed on Feb. 15, 2002, which is a divisional of U.S. Pat. No. 6,568,471, which was filed as patent application Ser. No. 09/512,895, filed, on Feb. 24, 2000, which claims priority from provisional application 60/121,841, filed on Feb. 26, 1999, (53) U.S. patent application Ser. No. 10/076,659, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (54) U.S. patent application Ser. No. 10/078,928, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (55) U.S. patent application Ser. No. 10/078,922, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (56) U.S. patent application Ser. No. 10/078,921, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (57) U.S. patent application Ser. No. 10/261,928, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (58) U.S. patent application Ser. No. 10/079276, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (59) U.S. patent application Ser. No. 10/262,009, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (60) U.S. patent application Ser. No. 10/092,481, filed on Mar. 7, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (61) U.S. patent application Ser. No. 10/261,926, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (62) PCT application US 02/36157, filed on Feb. 12, 2002 which claims priority from U.S. provisional patent application Ser. No. 60/338,996, filed on Nov. 12, 2001, (63) PCT application US 02/36267, filed on Nov. 12, 2002, which claims priority from U.S. provisional patent application Ser. No. 60/339,013, filed on Nov. 12, 2001, (64) PCT application US 03/11765, filed on Apr. 16, 2003, which claims priority from U.S. provisional patent application Ser. No. 60/383,917, filed on May 29, 2002, (65) PCT application US 03/15020, filed on May 12, 2003, which claims priority from U.S. provisional patent application Ser. No. 60/391,703, filed on Jun. 26, 2002, (66) PCT application US 02/39418, filed on Dec. 10, 2002, which claims priority from U.S. provisional patent application Ser. No. 60/346,309, filed on Jan. 7, 2002, (67) PCT application US 03/06544, filed on Mar. 4, 2003, which claims priority from U.S. provisional patent application Ser. No. 60/372,048, filed on Apr. 12, 2002, (68) U.S. patent application Ser. No. 10/331,718, filed on Dec. 30, 2002, which is a divisional U.S. patent application Ser. No. 09/679,906, filed on Oct. 5, 2000, which claims priority from provisional patent application Ser. No. 60/159,033, filed on Oct. 12, 1999, (69) PCT application US 03/04837, filed on Feb. 29, 2003, which claims priority from U.S. provisional patent application Ser. No. 60/363,829, filed on Mar. 13, 2002, (70) U.S. patent application Ser. No. 10/261,927, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (71) U.S. patent application Ser. No. 10/262,008, filed on Oct. 1, 2002, which is a divisional of U.S. Pat. No. 6,557,640, which was filed as patent application Ser. No. 09/588,946, filed on Jul. 7, 2000, which claims priority from provisional application 60/137,998, filed on Jun. 7, 1999, (72) U.S. patent application Ser. No. 10/261,925, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (73) U.S. patent application Ser. No. 10/199,524, filed on Jul. 19, 2002, which is a continuation of U.S. Pat. No. 6,497,289, which was filed as U.S. patent application Ser. No. 09/454,139, filed on Dec. 3, 1999, which claims priority from provisional application 60/111,293, filed on Dec. 7, 1998, (74) PCT application US 03/10144, filed on Mar. 28, 2003, which claims priority from U.S. provisional patent application Ser. No. 60/372,632, filed on Apr. 15, 2002, (75) U.S. provisional patent application Ser. No. 60/412,542, filed on Sep. 20, 2002, (76) PCT application US 03/14153, filed on May 6, 2003, which claims priority from U.S. provisional patent application Ser. No. 60/380,147, filed on May 6, 2002, (77) PCT application US 03/19993, filed on Jun. 24, 2003, which claims priority from U.S. provisional patent application Ser. No. 60/397,284, filed on Jul. 19, 2002, (78) PCT application US 03/13787, filed on May 5, 2003, which claims priority from U.S. provisional patent application Ser. No. 60/387,486, filed on Jun. 10, 2002, (79) PCT application US 03/18530, filed on Jun. 11, 2003, which claims priority from U.S. provisional patent application Ser. No. 60/387,961, filed on Jun. 12, 2002, (80) PCT application US 03/20694, filed on Jul. 1, 2003, which claims priority from U.S. provisional patent application Ser. No. 60/398,061, filed on Jul. 24, 2002, (81) PCT application US 03/20870, filed on Jul. 2, 2003, which claims priority from U.S. provisional patent application Ser. No. 60/399,240, filed on Jul. 29, 2002, (82) U.S. provisional patent application Ser. No. 60/412,487, filed on Sep. 20, 2002, (83) U.S. provisional patent application Ser. No. 60/412,488, filed on Sep. 20, 2002, (84) U.S. patent application Ser. No. 10/280,356, filed on Oct. 25, 2002, which is a continuation of U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. No. 60/405,610, filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application US 03/24779, filed on Aug. 8, 2003, which claims priority from U.S. provisional patent application Ser. No. 60/407,442, filed on Aug. 30, 2002, (91) U.S. provisional patent application Ser. No. 60/423,363, filed on Dec. 10, 2002, (92) U.S. provisional patent application Ser. No. 60/412,196, filed on Sep. 20, 2002, (93) U.S. provisional patent application Ser. No. 60/412,187, filed on Sep. 20, 2002, (94) U.S. provisional patent application Ser. No. 60/412,371, filed on Sep. 20, 2002, (95) U.S. patent application Ser. No. 10/382,325, filed on Mar. 5, 2003, which is a continuation of U.S. Pat. No. 6,557,640, which was filed as patent application Ser. No. 09/588,946, filed on Jun. 7, 2000, which claims priority from provisional application 60/137,998, filed on Jun. 7, 1999, (96) U.S. patent application Ser. No. 10/624,842, filed on Jul. 22, 2003, which is a divisional of U.S. patent application Ser. No. 09/502,350, filed on Feb. 10, 2000, which claims priority from provisional application 60/119,611, filed on Feb. 11, 1999, (97) U.S. provisional patent application Ser. No. 60/431,184, filed on Dec. 5, 2002, (98) U.S. provisional patent application Ser. No. 60/448,526, filed on Feb. 18, 2003, (99) U.S. provisional patent application Ser. No. 60/461,539, filed on Apr. 9, 2003, (100) U.S. provisional patent application Ser. No. 60/462,750, filed on Apr. 14, 2003, (101) U.S. provisional patent application Ser. No. 60/436,106, filed on Dec. 23, 2002, (102) U.S. provisional patent application Ser. No. 60/442,942, filed on Jan. 27, 2003, (103) U.S. provisional patent application Ser. No. 60/442,938, filed on Jan. 27, 2003, (104) U.S. provisional patent application Ser. No. 60/418,687, filed on Apr. 18, 2003, (105) U.S. provisional patent application Ser. No. 60/454,896, filed on Mar. 14, 2003, (106) U.S. provisional patent application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 11, 2003, (110) U.S. patent application Ser. No. 10/421,682, filed on Apr. 23, 2003, which is a continuation of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (111) U.S. provisional patent application Ser. No. 60/457,965, filed on Mar. 27, 2003, (112) U.S. provisional patent application Ser. No. 60/455,718, filed on Mar. 18, 2003, (113) U.S. Pat. No. 6,550,821, which was filed as patent application Ser. No. 09/811,734, filed on Mar. 19, 2001, (114) U.S. patent application Ser. No. 10/436,467, filed on May 12, 2003, which is a continuation of U.S. Pat. No. 6,604,763, which was filed as application Ser. No. 09/559, 122, filed on Apr. 26, 2000, which claims priority from provisional application. 60/131,106, filed on Apr. 26, 1999, (115) U.S. provisional patent application Ser. No. 60/459,776, filed on Apr. 2, 2003, (116) U.S. provisional patent application Ser. No. 60/461,094, filed on Apr. 8, 2003, (117) U.S. provisional patent application Ser. No. 60/461,038, filed on Apr. 7, 2003, (118) U.S. provisional patent application Ser. No. 60/463, 586, filed on Apr. 17, 2003, (119) U.S. provisional patent application Ser. No. 60/472,240, filed on May. 20, 2003, (120) U.S. patent application Ser. No. 10/619,285, filed on Jul. 14, 2003, which is a continuation-in-part of U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, and (121) U.S. utility patent application Ser. No. 10/418,688, which was filed on Apr. 18, 2003, as a division of U.S. utility patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (122) PCT patent application Ser. No. PCT/US2004/06246, filed on Feb. 26, 2004; (123) PCT patent application Ser. No. PCT/US2004/08170, filed on Mar. 15, 2004; (124) PCT patent application Ser. No. PCT/US2004/08171, filed on Mar. 15, 2004; (125) PCT patent application Ser. No. PCT /US2004/08073, filed on Mar. 18, 2004; (126) PCT patent application Ser. No. PCT/US2004/07711, filed on Mar. 11, 2004; (127) PCT patent application Ser. No. PCT/US2004/029025, filed on Mar. 26, 2004; (128) PCT patent application Ser. No. PCT/US2004/010317, filed on Apr. 2, 2004; (129) PCT patent application Ser. No. PCT/US2004/010712, filed on Apr. 6, 2004; (130) PCT patent application Ser. No. PCT/US2004/010762, filed on Apr. 6, 2004; (131) PCT patent application Ser. No. PCT/US2004/011973, filed on Apr. 15, 2004; (132) U.S. provisional patent application Ser. No. 60/495056, filed on Aug. 14, 2003; (133) U.S. provisional patent application Ser. No. 60/600679, filed on Aug. 11, 2004; (134) PCT patent application Ser. No. PCT/US2005/027318, filed on Jul. 29, 2005; (135) PCT patent application Ser. No. PCT/US2005/028936, filed on Aug. 12, 2005; (136) PCT patent application Ser. No. PCT/US2005/028669, filed on Aug. 11, 2005; (137) PCT patent application Ser. No. PCT/US2005/028453, filed on Aug. 11, 2005; (138) PCT patent application Ser. No. PCT/US2005/028641, filed on Aug. 11, 2005; (139) PCT patent application Ser. No. PCT/US2005/028819, filed on Aug. 11, 2005; (140) PCT patent application Ser. No. PCT/US2005/028446, filed on Aug. 11, 2005; (141) PCT patent application Ser. No. PCT/US2000/028642, filed on Aug. 11, 2005; (142) PCT patent application Ser. No. PCT/US2005/028451, filed on Aug. 11, 2005, and (143). PCT patent application Ser. No. PCT/US2005/028473, filed on Aug. 11, 2005, (144) U.S. utility patent application Ser. No. 10/546082, filed on Aug. 16, 2005, (145) U.S. utility patent application Ser. No. 10/546076, filed on Aug. 16, 2005, (146) U.S. utility patent application Ser. No. 10/545936, filed on Aug. 16, 2005, (147) U.S. utility patent application Ser. No. 10/546079, filed on Aug. 16, 2005 (148) U.S. utility patent application Ser. No. 10/545941, filed on Aug. 16, 2005, (149) U.S. utility patent application Ser. No. 546078, filed on Aug. 16, 2005, filed on Aug. 11, 2005., (150) U.S. utility patent application Ser. No. 10/545941, filed on Aug. 16, 2005, (151) U.S. utility patent application Ser. No. 11/249967, filed on Oct. 13, 2005, (152) U.S. provisional patent application Ser. No. 60/734302, filed on Nov. 7, 2005, (153) U.S. provisional patent application Ser. No. 60/725181, filed on Oct. 11, 2005, (154) PCT patent application Ser. No. PCT/US2005/023391, filed Jun. 29, 2005 which claims priority from U.S. provisional patent application Ser. No. 60/585370, filed on Jul. 7, 2004, (155) U.S. provisional patent application Ser. No. 60/721 579, filed on Sep. 28, 2005, (156) U.S. provisional patent application Ser. No. 60/717391, filed on Sep. 15, 2005, (157) U.S. provisional patent application Ser. No. 60/702935, filed on Jul. 27, 2005, (158) U.S. provisional patent application Ser. No. 60/663913, filed on Mar. 21, 2005, (159) U.S. provisional patent application Ser. No. 60/652564, filed on Feb. 14, 2005, (160) U.S. provisional patent application Ser. No. 60/645840, filed on Jan. 21, 2005, (161) PCT patent application Ser. No. PCT/US2005/043122, filed on Nov. 29, 2005 which claims priority from U.S. provisional patent application Ser. No. 60/631703, filed on Nov. 30, 2004, (162) U.S. provisional patent application Ser. No. 60/752787, filed on Dec. 22, 2005, (163) U.S. National Stage application Ser. No. 10/548934, filed on Sep. 12, 2005; (164) U.S. National Stage application Ser. No. 10/549410, filed on Sep. 13, 2005; (165) U.S. Provisional patent application No. 60/717391, filed on Sep. 15, 2005; (166) U.S. National Stage application Ser. No. 10/550906, filed on Sep. 27, 2005; (167) U.S. National Stage application Ser. No. 10/551880, filed on Sep. 30, 2005; (168) U.S. National Stage application Ser. No. 10/552253, filed on Oct. 4, 2005; (169) U.S. National Stage application Ser. No. 10/552790, filed on Oct. 11, 2005; (170) U.S. Provisional patent application No. 60/725181, filed on Oct. 11, 2005; (171) U.S. National Stage application Ser. No. 10/553094, filed on Oct. 13, 2005; (172) U.S. National Stage application Ser. No. 10/553566, filed on Oct. 17, 2005; (173) PCT Patent Application No. PCT/US2006/002449, filed on Jan. 20, 2006, and (174) PCT patent application No. PCT/US2006/004809, filed on Feb. 9, 2006; (175) U.S. Utility patent application Ser. No. 11/356899, filed on Feb. 17, 2006, (176) U.S. National Stage application Ser. No. 10/568200, filed on Feb. 13, 2006, (177) U.S. National Stage application Ser. No. 10/568719, filed on Feb. 16, 2006, (178) U.S. National Stage application Ser. No. 10/569323, filed on Feb. 17, 2006, (179) U.S. National State patent application Ser. No. 10/571041, filed on Mar. 3, 2006; (180) U.S. National State patent application Ser. No. 10/571086, filed on Mar. 3, 2006; (181) U.S. National State patent application Ser. No. 10/571086, filed on Mar. 6, 2006; and (182) U.S. National Stage patent application Ser. No. 10/571085, filed on Mar. 6, 2006, (183) U.S. utility patent application Ser. No. 10/938788, filed on Sep. 10, 2004, (184) U.S. utility patent application Ser. No. 10/938225, filed on Sep. 10, 2004, (185) U.S. utility patent application Ser. No. 10/952288, filed on Sep. 28, 2004, (186) U.S. utility patent application Ser. No. 10/952416, filed on Sep. 28, 2004, (187) U.S. utility patent application Ser. No. 10/950749, filed on Sep. 27, 2004, (188)U.S. utility patent application Ser. No. 10/950869, filed on Sep. 27, 2004, (189) U.S. provisional patent application Ser. No. 60/761324, filed on Jan. 23, 2006, (190) U.S. provisional patent application Ser. No. 60/754556, filed on Dec. 28, 2005, (191) U.S. utility patent application Ser. No. 11/380051, filed on Apr. 25, 2006, (192) U.S. utility patent application Ser. No. 11/380055, filed on Apr. 25, 2006, (193) U.S. utility patent application Ser. No. 10/522039, filed on Mar. 10, 2006; (194) U.S. provisional Patent application Ser. No. 60/746,813, filed on May 9, 2006; (195) U.S. utility patent application Ser. No. 11/456584, filed on Jul. 11, 2006; and (196) U.S. utility patent application Ser. No. 11/456587, filed on Jul. 11, 2006; (197) PCT patent application No. PCT/US2006/009886, filed on Mar. 21, 2006; (198) PCT patent application No. PCT/US2006/010674, filed on Mar. 21, 2006; (199) U.S. Pat. No. 6,409,175 which issued Jun. 25, 2002, (200) U.S. Pat. No. 6,550,821 which issued Apr. 22, 2003, (201) U.S. patent application Ser. No. 10/767,953, filed Jan. 29, 2004, now U.S. Pat. No. 7,077,211 which issued Jul. 18, 2006; (202) U.S. patent application Ser. No. 10/769726, filed Jan. 30, 2004, (203) U.S. patent application Ser. No. 10/770363 filed Feb. 2, 2004, (204) U.S. utility patent application Ser. No. 11/068,595, filed on Feb. 28, 2005; (205) U.S. utility patent application Ser. No. 11/070,147, filed on Mar. 2, 2005; (206) U.S. utility patent application Ser. No. 11/071,409, filed on Mar. 2, 2005; (207) U.S. utility patent application Ser. No. 11/071,557, filed on Mar. 3, 2005; (208) U.S. utility patent application Ser. No. 11/072,578, filed on Mar. 4, 2005; (209) U.S. utility patent application Ser. No. 11/072,893, filed on Mar. 4, 2005; (210) U.S. utility patent application Ser. No. 11/072,594, filed on Mar. 4, 2005; (211) U.S. utility patent application Ser. No. 11/074,366, filed on Mar. 7, 2005; (212) U.S. utility patent application Ser. No. 11/074,266, filed on Mar. 7, 2005, (213) U.S. provisional patent application Ser. No. 60/832909, filed on Jul. 24, 2006, (214) U.S. utility patent application Ser. No. 11/536,302, filed Sep. 28, 2006, (215) U.S. utility patent application Ser. No. 11/538228, filed Oct. 3, 2006, and (216) U.S. utility patent application Ser. No. 11/552,703, filed on October 25, 2006.

BACKGROUND OF THE INVENTION

This invention relates generally to wellbore casings, and in particular to wellbore casings that are formed using expandable tubing.

Conventionally, when a wellbore is created, a number of casings are installed in the borehole to prevent collapse of the borehole wall and to prevent undesired outflow of drilling fluid into the formation or inflow of fluid from the formation into the borehole. The borehole is drilled in intervals whereby a casing which is to be installed in a lower borehole interval is lowered through a previously installed casing of an upper borehole interval. As a consequence of this procedure the casing of the lower interval is of smaller diameter than the casing of the upper interval. Thus, the casings are in a nested arrangement with casing diameters decreasing in downward direction. Cement annuli are provided between the outer surfaces of the casings and the borehole wall to seal the casings from the borehole wall. As a consequence of this nested arrangement a relatively large borehole diameter is required at the upper part of the wellbore. Such a large borehole diameter involves increased costs due to heavy casing handling equipment, large drill bits and increased volumes of drilling fluid and drill cuttings. Moreover, increased drilling rig time is involved due to required cement pumping, cement hardening, required equipment changes due to large variations in hole diameters drilled in the course of the well, and the large volume of cuttings drilled and removed.

The present invention is directed to overcoming one or more of the limitations of the existing procedures for forming new sections of casing in a wellbore.

SUMMARY OF THE INVENTION

According to one aspect of the present invention, a method of creating a mono-diameter wellbore casing in a borehole located in a subterranean formation including a preexisting wellbore casing is provided that includes installing a tubular liner and a first expansion cone in the borehole, injecting a fluidic material into the borehole, pressurizing a portion of an interior region of the tubular liner below the first expansion cone, radially expanding at least a portion of the tubular liner in the borehole by extruding at least a portion of the tubular liner off of the first expansion cone, and radially expanding at least a portion of the preexisting wellbore casing and the tubular liner using a second expansion cone.

According to another aspect of the present invention, an apparatus for forming a mono-diameter wellbore casing in a borehole located in a subterranean formation including a preexisting wellbore casing is provided that includes means for installing a tubular liner and a first expansion cone in the borehole, means for injecting a fluidic material into the borehole, means for pressurizing a portion of an interior region of the tubular liner below the first expansion cone, means for radially expanding at least a portion of the tubular liner in the borehole by extruding at least a portion of the tubular liner off of the first expansion cone, and means for radially expanding at least a portion of the preexisting wellbore casing and the tubular liner using a second expansion cone.

According to another aspect of the present invention, a method of joining a second tubular member to a first tubular member positioned within a subterranean formation, the first tubular member having an inner diameter greater than an outer diameter of the second tubular member is provided that includes positioning a first expansion cone within an interior region of the second tubular member, pressurizing a portion of the interior region of the second tubular member adjacent to the first expansion cone, extruding at least a portion of the second tubular member off of the first expansion cone into engagement with the first tubular member, and radially expanding at least a portion of the first tubular member and the second tubular member using a second expansion cone.

According to another aspect of the present invention, an apparatus for joining a second tubular member to a first tubular member positioned within a subterranean formation, the first tubular member having an inner diameter greater than an outer diameter of the second tubular member, is provided that includes means for positioning a first expansion cone within an interior region of the second tubular member, means for pressurizing a portion of the interior region of the second tubular member adjacent to the first expansion cone, means for extruding at least a portion of the second tubular member off of the first expansion cone into engagement with the first tubular member, and means for radially expanding at least a portion of the first tubular member and the second tubular member using a second expansion cone.

According to another aspect of the present invention, an apparatus is provided that includes a subterranean formation including a borehole, a wellbore casing coupled to the borehole, and a tubular liner coupled to the wellbore casing. The inside diameters of the wellbore casing and the tubular liner are substantially equal, and the tubular liner is coupled to the wellbore casing by a method that includes installing the tubular liner and a first expansion cone in the borehole, injecting a fluidic material into the borehole, pressurizing a portion of an interior region of the tubular liner below the first expansion cone, radially expanding at least a portion of the tubular liner in the borehole by extruding at least a portion of the tubular liner off of the first expansion cone, and radially expanding at least a portion of the wellbore casing and the tubular liner using a second expansion cone.

According to another aspect of the present invention, an apparatus is provided that includes a subterranean formation including a borehole, a first tubular member coupled to the borehole, and a second tubular member coupled to the wellbore casing. The inside diameters of the first and second tubular members are substantially equal, and the second tubular member is coupled to the first tubular member by a method that includes installing the second tubular member and a first expansion cone in the borehole, injecting a fluidic material into the borehole, pressurizing a portion of an interior region of the second tubular member below the first expansion cone, radially expanding at least a portion of the second tubular member in the borehole by extruding at least a portion of the second tubular member off of the first expansion cone, and radially expanding at least a portion of the first tubular member and the second tubular member using a second expansion cone.

According to another aspect of the present invention, an apparatus for radially expanding an overlapping joint between a wellbore casing and a tubular liner is provided that includes a tubular support including first and second passages, a sealing member coupled to the tubular support, a slip joint coupled to the tubular support including a third passage fluidicly coupled to the second passage, and an expansion cone coupled to the slip joint including a fourth passage fluidicly coupled to the third passage.

According to another aspect of the present invention, a method of radially expanding an overlapping joint between a wellbore casing and a tubular liner is provided that includes positioning an expansion cone within the wellbore casing above the overlapping joint, sealing off an annular region within the wellbore casing above the expansion cone, displacing the expansion cone by pressurizing the annular region, and removing fluidic materials displaced by the expansion cone from the tubular liner.

According to another aspect of the present invention, an apparatus for radially expanding an overlapping joint between a wellbore casing and a tubular liner is provided that includes means for positioning an expansion cone within the wellbore casing above the overlapping joint, means for sealing off an annular region within the wellbore casing above the expansion cone, means for displacing the expansion cone by pressurizing the annular region, and means for removing fluidic materials displaced by the expansion cone from the tubular liner.

According to another aspect of the present invention, an apparatus for radially expanding an overlapping joint between a wellbore casing and a tubular liner is provided that includes a tubular support including a first passage, a sealing member coupled to the tubular support, a releasable latching member coupled to the tubular support, and an expansion cone releasably coupled to the releasable latching member including a second passage fluidicly coupled to the first passage.

According to another aspect of the present invention, a method of radially expanding an overlapping joint between a wellbore casing and a tubular liner is provided that includes positioning an expansion cone within the wellbore casing above the overlapping joint, sealing off a region within the wellbore casing above the expansion cone, releasing the expansion cone, and displacing the expansion cone by pressurizing the annular region.

According to another aspect of the present invention, an apparatus for radially expanding an overlapping joint between a wellbore casing and a tubular liner is provided that includes means for positioning an expansion cone within the wellbore casing above the overlapping joint, means for sealing off a region within the wellbore casing above the expansion cone, means for releasing the expansion cone, and means for displacing the expansion cone by pressurizing the annular region.

According to another aspect of the present invention, an apparatus for radially expanding an overlapping joint between first and second tubular members is provided that includes a tubular support including first and second passages, a sealing member coupled to the tubular support, a slip joint coupled to the tubular support including a third passage fluidicly coupled to the second passage, and an expansion cone coupled to the slip joint including a fourth passage fluidicly coupled to the third passage.

According to another aspect of the present invention, a method of radially expanding an overlapping joint between first and second tubular members is provided that includes positioning an expansion cone within the first tubular member above the overlapping joint, sealing off an annular region within the first tubular member above the expansion cone, displacing the expansion cone by pressurizing the annular region, and removing fluidic materials displaced by the expansion cone from the second tubular member.

According to another aspect of the present invention, an apparatus for radially expanding an overlapping joint between first and second tubular members is provided that includes means for positioning an expansion cone within the first tubular member above the overlapping joint, means for sealing off an annular region within the first tubular member above the expansion cone, means for displacing the expansion cone by pressurizing the annular region, and means for removing fluidic materials displaced by the expansion cone from the second tubular member.

According to another aspect of the present invention, an apparatus for radially expanding an overlapping joint between first and second tubular members is provided that includes a tubular support including a first passage, a sealing member coupled to the tubular support, a releasable latching member coupled to the tubular support, and an expansion cone releasably coupled to the releasable latching member including a second passage fluidicly coupled to the first passage.

According to another aspect of the present invention, a method of radially expanding an overlapping joint between first and second tubular members is provided that includes positioning an expansion cone within the first tubular member above the overlapping joint, sealing off a region within the first tubular member above the expansion cone, releasing the expansion cone, and displacing the expansion cone by pressurizing the annular region.

According to another aspect of the present invention, an apparatus for radially expanding an overlapping joint between first and second tubular members is provided that includes means for positioning an expansion cone within the first tubular member above the overlapping joint, means for sealing off a region within the first tubular member above the expansion cone, means for releasing the expansion cone, and means for displacing the expansion cone by pressurizing the annular region.

DETAILED DESCRIPTION OF THE ILLUSTRATIVE EMBODIMENTS

Figure 1:
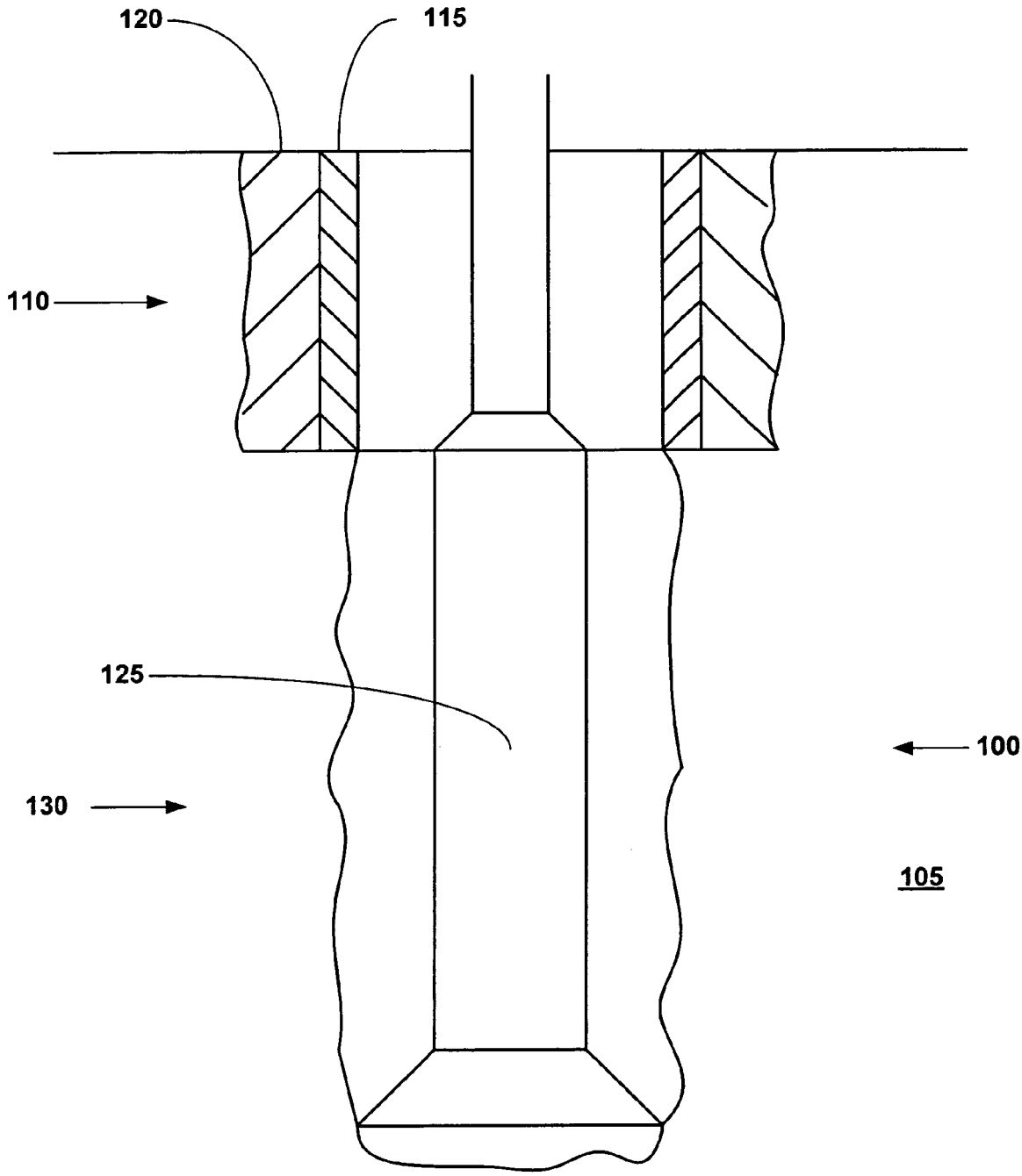
FIG. 1 is a fragmentary cross-sectional view illustrating the drilling of a new section of a well borehole.

Referring initially to FIGS. 1-9, an embodiment of an apparatus and method for forming a mono-diameter wellbore casing within a subterranean formation will now be described. As illustrated in FIG. 1, a wellbore 100 is positioned in a subterranean formation 105. The wellbore 100 includes a pre-existing cased section 110 having a tubular casing 115 and an annular outer layer 120 of a fluidic sealing material such as, for example, cement. The wellbore 100 may be positioned in any orientation from vertical to horizontal. In several alternative embodiments, the pre-existing cased section 110 does not include the annular outer layer 120.

In order to extend the wellbore 100 into the subterranean formation 105, a drill string 125 is used in a well known manner to drill out material from the subterranean formation 105 to form a new wellbore section 130.

Figure 2:
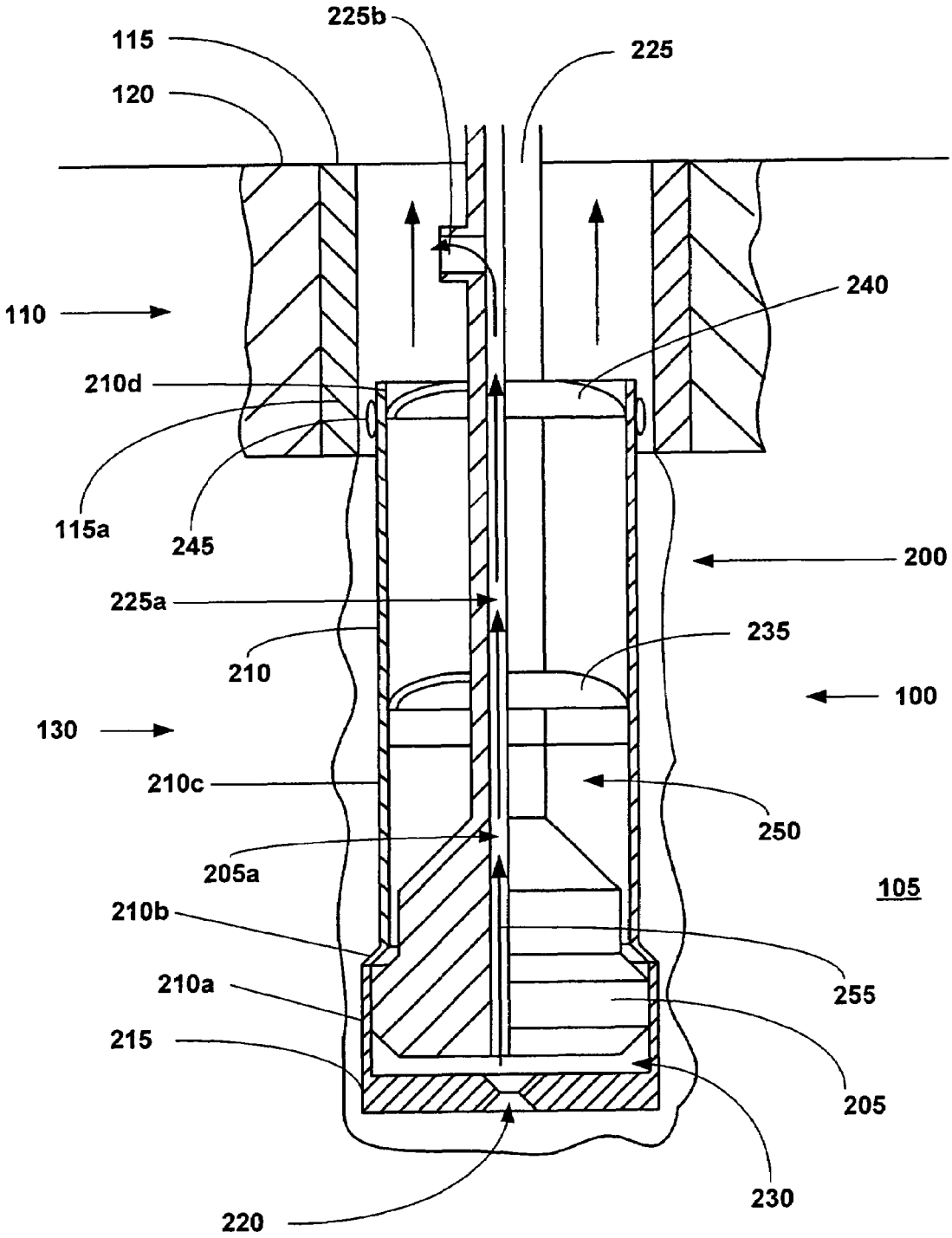
FIG. 2 is a fragmentary cross-sectional view illustrating the placement of an embodiment of an apparatus for creating a casing within the new section of the well borehole of FIG. 1.

As illustrated in FIG. 2, an apparatus 200 for forming a wellbore casing in a subterranean formation is then positioned in the new section 130 of the wellbore 100. The apparatus 200 preferably includes an expansion cone 205 having a fluid passage 205*a* that supports a tubular member 210 that includes a lower portion 210*a*, an intermediate portion 210*b*, an upper portion 210*c*, and an upper end portion 210*d*.

The expansion cone 205 may be any number of conventional commercially available expansion cones. In several alternative embodiments, the expansion cone 205 may be controllably expandable in the radial direction, for example, as disclosed in U.S. Pat. Nos. 5,348,095, and/or 6,012,523, the disclosures of which are incorporated herein by reference.

The tubular member 210 may be fabricated from any number of conventional commercially available materials such as, for example, Oilfield Country Tubular Goods (OCTG), 13 chromium steel tubing/casing, or plastic tubing/casing. In a preferred embodiment, the tubular member 210 is fabricated from OCTG in order to maximize strength after expansion. In several alternative embodiments, the tubular member 210 may be solid and/or slotted. In a preferred embodiment, the length of the tubular member 210 is limited to minimize the possibility of buckling. For typical tubular member 210 materials, the length of the tubular member 210 is preferably limited to between about 40 to 20,000 feet in length.

The lower portion 210*a* of the tubular member 210 preferably has a larger inside diameter than the upper portion 210*c* of the tubular member. In a preferred embodiment, the wall thickness of the intermediate portion 210*b* of the tubular member 201 is less than the wall thickness of the upper portion 210*c* of the tubular member in order to faciliate the initiation of the radial expansion process. In a preferred embodiment, the upper end portion 210*d* of the tubular member 210 is slotted, perforated, or otherwise modified to catch or slow down the expansion cone 205 when it completes the extrusion of tubular member 210.

A shoe 215 is coupled to the lower portion 210*a* of the tubular member. The shoe 215 includes a valveable fluid passage 220 that is preferably adapted to receive a plug, dart, or other similar element for controllably sealing the fluid passage 220. In this manner, the fluid passage 220 may be optimally sealed off by introducing a plug, dart and/or ball sealing elements into the fluid passage 240.

The shoe 215 may be any number of conventional commercially available shoes such as, for example, Super Seal II float shoe, Super Seal II Down-Jet float shoe or a guide shoe with a sealing sleeve for a latch down plug modified in accordance with the teachings of the present disclosure. In a preferred embodiment, the shoe 215 is an aluminum down-jet guide shoe with a sealing sleeve for a latch-down plug available from Halliburton Energy Services in Dallas, Tex., modified in accordance with the teachings of the present disclosure, in order to optimally guide the tubular member 210 in the wellbore, optimally provide an adequate seal between the interior and exterior diameters of the overlapping joint between the tubular members, and to optimally allow the complete drill out of the shoe and plug after the completion of the cementing and expansion operations.

In a preferred embodiment, the shoe 215 further includes one or more through and side outlet ports in fluidic communication with the fluid passage 220. In this manner, the shoe 215 optimally injects hardenable fluidic sealing material into the region outside the shoe 215 and tubular member 210.

A support member 225 having fluid passages 225*a* and 225*b* is coupled to the expansion cone 205 for supporting the apparatus 200. The fluid passage 225*a* is preferably fluidicly coupled to the fluid passage 205*a*. In this manner, fluidic materials may be conveyed to and from a region 230 below the expansion cone 205 and above the bottom of the shoe 215.

The fluid passage 225*b* is preferably fluidicly coupled to the fluid passage 225*a* and includes a conventional control valve. In this manner, during placement of the apparatus 200 within the wellbore 100, surge pressures can be relieved by the fluid passage 225*b*. In a preferred embodiment, the support member 225 further includes one or more conventional centralizers (not illustrated) to help stabilize the apparatus 200.

During placement of the apparatus 200 within the wellbore 100, the fluid passage 225*a* is preferably selected to transport materials such as, for example, drilling mud or formation fluids at flow rates and pressures ranging from about 0 to 3,000 gallons/minute and 0 to 9,000 psi in order to minimize drag on the tubular member being run and to minimize surge pressures exerted on the wellbore 130 which could cause a loss of wellbore fluids and lead to hole collapse. During placement of the apparatus 200 within the wellbore 100, the fluid passage 225*b* is preferably selected to convey fluidic materials at flow rates and pressures ranging from about 0 to 3,000 gallons/minute and 0 to 9,000 psi in order to reduce the drag on the apparatus 200 during insertion into the new section 130 of the wellbore 100 and to minimize surge pressures on the new wellbore section 130.

A lower cup seal 235 is coupled to and supported by the support member 225. The lower cup seal 235 prevents foreign materials from entering the interior region of the tubular member 210 adjacent to the expansion cone 205. The lower cup seal 235 may be any number of conventional commercially available cup seals such as, for example, TP cups, or Selective Injection Packer (SIP) cups modified in accordance with the teachings of the present disclosure. In a preferred embodiment, the lower cup seal 235 is a SIP cup seal, available from Halliburton Energy Services in Dallas, Tex. in order to optimally block foreign material and contain a body of lubricant.

The upper cup seal 240 is coupled to and supported by the support member 225. The upper cup seal 240 prevents foreign materials from entering the interior region of the tubular member 210. The upper cup seal 240 may be any number of conventional commercially available cup seals such as, for example, TP cups or SIP cups modified in accordance with the teachings of the present disclosure. In a preferred embodiment, the upper cup seal 240 is a SIP cup, available from Halliburton Energy Services in Dallas, Tex. in order to optimally block the entry of foreign materials and contain a body of lubricant.

One or more sealing members 245 are coupled to and supported by the exterior surface of the upper end portion 210*d* of the tubular member 210. The seal members 245 preferably provide an overlapping joint between the lower end portion 115*a* of the casing 115 and the portion 260 of the tubular member 210 to be fluidicly sealed. The sealing members 245 may be any number of conventional commercially available seals such as, for example, lead, rubber, Teflon, or epoxy seals modified in accordance with the teachings of the present disclosure. In a preferred embodiment, the sealing members 245 are molded from Stratalock epoxy available from Halliburton Energy Services in Dallas, Tex. in order to optimally provide a load bearing interference fit between the upper end portion 210*d* of the tubular member 210 and the lower end portion 115*a* of the existing casing 115.

In a preferred embodiment, the sealing members 245 are selected to optimally provide a sufficient frictional force to support the expanded tubular member 210 from the existing casing 115. In a preferred embodiment, the frictional force optimally provided by the sealing members 245 ranges from about 1,000 to 1,000,000 lbf in order to optimally support the expanded tubular member 210.

In a preferred embodiment, a quantity of lubricant 250 is provided in the annular region above the expansion cone 205 within the interior of the tubular member 210. In this manner, the extrusion of the tubular member 210 off of the expansion cone 205 is facilitated. The lubricant 250 may be any number of conventional commercially available lubricants such as, for example, Lubriplate, chlorine based lubricants, oil based lubricants or Climax 1500 Antisieze (3100). In a preferred embodiment, the lubricant 250 is Climax 1500 Antisieze (3100) available from Climax Lubricants and Equipment Co. in Houston, Tex. in order to optimally provide optimum lubrication to faciliate the expansion process.

In a preferred embodiment, the support member 225 is thoroughly cleaned prior to assembly to the remaining portions of the apparatus 200. In this manner, the introduction of foreign material into the apparatus 200 is minimized. This minimizes the possibility of foreign material clogging the various flow passages and valves of the apparatus 200.

In a preferred embodiment, before or after positioning the apparatus 200 within the new section 130 of the wellbore 100, a couple of wellbore volumes are circulated in order to ensure that no foreign materials are located within the wellbore 100 that might clog up the various flow passages and valves of the apparatus 200 and to ensure that no foreign material interferes with the expansion process.

As illustrated in FIG. 2, in a preferred embodiment, during placement of the apparatus 200 within the wellbore 100, fluidic materials 255 within the wellbore that are displaced by the apparatus are conveyed through the fluid passages 220, 205*a*, 225*a*, and 225*b*. In this manner, surge pressures created by the placement of the apparatus within the wellbore 100 are reduced.

Figure 3:
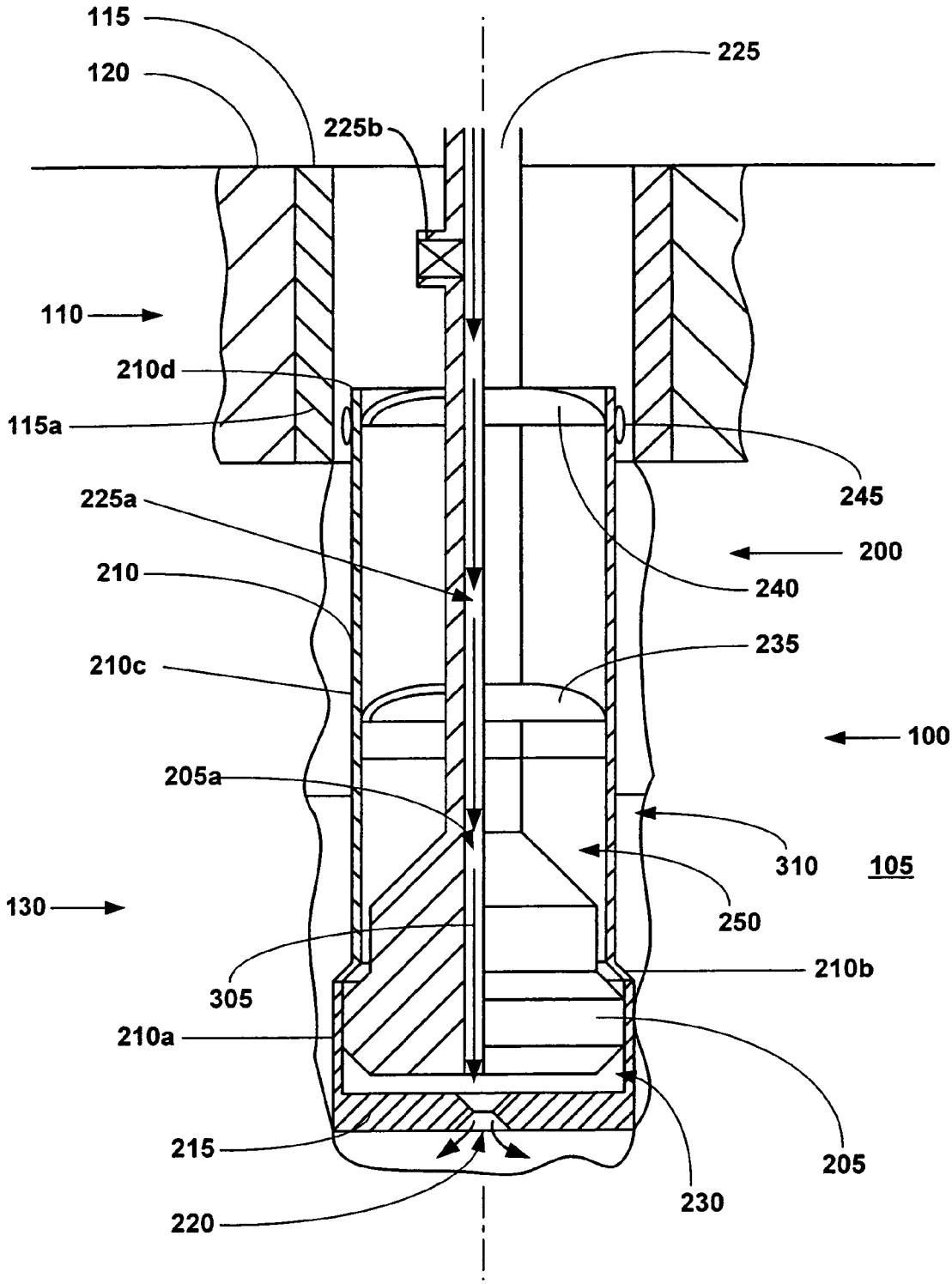
FIG. 3 is a fragmentary cross-sectional view illustrating the injection of a hardenable fluidic sealing material into the new section of the well borehole of FIG. 2.

As illustrated in FIG. 3, the fluid passage 225*b* is then closed and a hardenable fluidic sealing material 305 is then pumped from a surface location into the fluid passages 225*a* and 205*a*. The material 305 then passes from the fluid passage 205*a* into the interior region 230 of the tubular member 210 below the expansion cone 205. The material 305 then passes from the interior region 230 into the fluid passage 220. The material 305 then exits the apparatus 200 and fills an annular region 310 between the exterior of the tubular member 210 and the interior wall of the new section 130 of the wellbore 100. Continued pumping of the material 305 causes the material 305 to fill up at least a portion of the annular region 310.

The material 305 is preferably pumped into the annular region 310 at pressures and flow rates ranging, for example, from about 0 to 5000 psi and 0 to 1,500 gallons/min, respectively. The optimum flow rate and operating pressures vary as a function of the casing and wellbore sizes, wellbore section length, available pumping equipment, and fluid properties of the fluidic material being pumped. The optimum flow rate and operating pressure are preferably determined using conventional empirical methods.

The hardenable fluidic sealing material 305 may be any number of conventional commercially available hardenable fluidic sealing materials such as, for example, slag mix, cement or epoxy. In a preferred embodiment, the hardenable fluidic sealing material 305 is a blended cement prepared specifically for the particular well section being drilled from Halliburton Energy Services in Dallas, Tex. in order to provide optimal support for tubular member 210 while also maintaining optimum flow characteristics so as to minimize difficulties during the displacement of cement in the annular region 315. The optimum blend of the blended cement is preferably determined using conventional empirical methods. In several alternative embodiments, the hardenable fluidic sealing material 305 is compressible before, during, or after curing.

The annular region 310 preferably is filled with the material 305 in sufficient quantities to ensure that, upon radial expansion of the tubular member 210, the annular region 310 of the new section 130 of the wellbore 100 will be filled with the material 305.

In an alternative embodiment, the injection of the material 305 into the annular region 310 is omitted.

Figure 4:
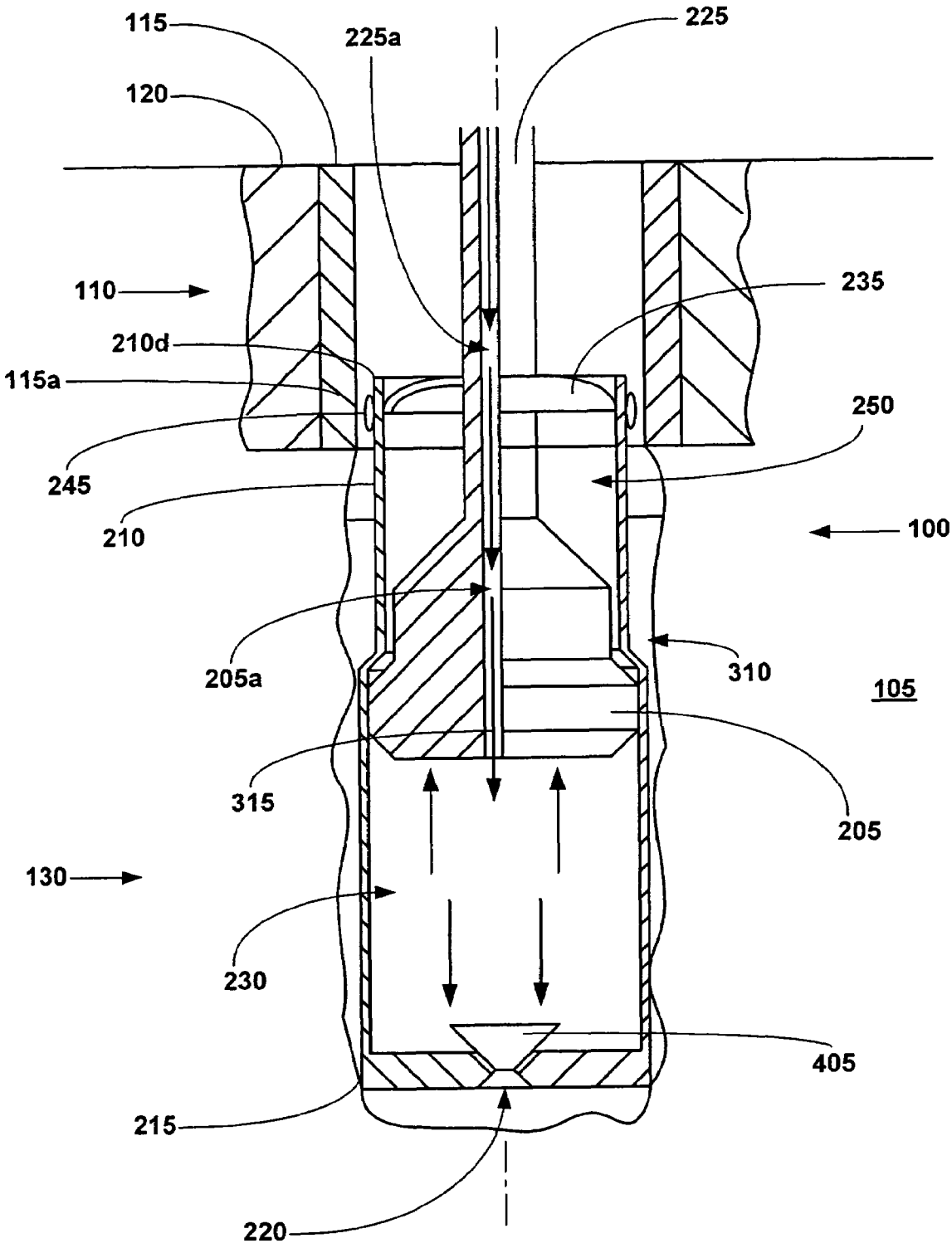
FIG. 4 is a fragmentary cross-sectional view illustrating the injection of a fluidic material into the new section of the well borehole of FIG. 3.

As illustrated in FIG. 4, once the annular region 310 has been adequately filled with the material 305, a plug 405, or other similar device, is introduced into the fluid passage 220, thereby fluidicly isolating the interior region 230 from the annular region 310. In a preferred embodiment, a non-hardenable fluidic material 315 is then pumped into the interior region 230 causing the interior region to pressurize. In this manner, the interior region 230 of the expanded tubular member 210 will not contain significant amounts of cured material 305. This also reduces and simplifies the cost of the entire process. Alternatively, the material 305 may be used during this phase of the process.

Once the interior region 230 becomes sufficiently pressurized, the tubular member 210 is preferably plastically deformed, radially expanded, and extruded off of the expansion cone 205. During the extrusion process, the expansion cone 205 may be raised out of the expanded portion of the tubular member 210. In a preferred embodiment, during the extrusion process, the expansion cone 205 is raised at approximately the same rate as the tubular member 210 is expanded in order to keep the tubular member 210 stationary relative to the new wellbore section 130. In an alternative preferred embodiment, the extrusion process is commenced with the tubular member 210 positioned above the bottom of the new wellbore section 130, keeping the expansion cone 205 stationary, and allowing the tubular member 210 to extrude off of the expansion cone 205 and into the new wellbore section 130 under the force of gravity and the operating pressure of the interior region 230.

The plug 405 is preferably placed into the fluid passage 220 by introducing the plug 405 into the fluid passage 225*a* at a surface location in a conventional manner. The plug 405 preferably acts to fluidicly isolate the hardenable fluidic sealing material 305 from the non hardenable fluidic material 315.

The plug 405 may be any number of conventional commercially available devices from plugging a fluid passage such as, for example, Multiple Stage Cementer (MSC) latch-down plug, Omega latch-down plug or three-wiper latch-down plug modified in accordance with the teachings of the present disclosure. In a preferred embodiment, the plug 405 is a MSC latch-down plug available from Halliburton Energy Services in Dallas, Tex.

After placement of the plug 405 in the fluid passage 220, the non hardenable fluidic material 315 is preferably pumped into the interior region 310 at pressures and flow rates ranging, for example, from approximately 400 to 10,000 psi and 30 to 4,000 gallons/min. In this manner, the amount of hardenable fluidic sealing material within the interior 230 of the tubular member 210 is minimized. In a preferred embodiment, after placement of the plug 405 in the fluid passage 220, the non hardenable material 315 is preferably pumped into the interior region 230 at pressures and flow rates ranging from approximately 500 to 9,000 psi and 40 to 3,000 gallons/min in order to maximize the extrusion speed.

In a preferred embodiment, the apparatus 200 is adapted to minimize tensile, burst, and friction effects upon the tubular member 210 during the expansion process. These effects will be depend upon the geometry of the expansion cone 205, the material composition of the tubular member 210 and expansion cone 205, the inner diameter of the tubular member 210, the wall thickness of the tubular member 210, the type of lubricant, and the yield strength of the tubular member 210. In general, the thicker the wall thickness, the smaller the inner diameter, and the greater the yield strength of the tubular member 210, then the greater the operating pressures required to extrude the tubular member 210 off of the expansion cone 205.

For typical tubular members 210, the extrusion of the tubular member 210 off of the expansion cone 205 will begin when the pressure of the interior region 230 reaches, for example, approximately 500 to 9,000 psi.

During the extrusion process, the expansion cone 205 may be raised out of the expanded portion of the tubular member 210 at rates ranging, for example, from about 0 to 5 ft/sec. In a preferred embodiment, during the extrusion process, the expansion cone 205 is raised out of the expanded portion of the tubular member 210 at rates ranging from about 0 to 2 ft/sec in order to minimize the time required for the expansion process while also permitting easy control of the expansion process.

When the upper end portion 210*d* of the tubular member 210 is extruded off of the expansion cone 205, the outer surface of the upper end portion 210*d* of the tubular member 210 will preferably contact the interior surface of the lower end portion 115*a* of the casing 115 to form an fluid tight overlapping joint. The contact pressure of the overlapping joint may range, for example, from approximately 50 to 20,000 psi. In a preferred embodiment, the contact pressure of the overlapping joint ranges from approximately 400 to 10,000 psi in order to provide optimum pressure to activate the annular sealing members 245 and optimally provide resistance to axial motion to accommodate typical tensile and compressive loads.

The overlapping joint between the existing casing 115 and the radially expanded tubular member 210 preferably provides a gaseous and fluidic seal. In a particularly preferred embodiment, the sealing members 245 optimally provide a fluidic and gaseous seal in the overlapping joint. In an alternative embodiment, the sealing members 245 are omitted.

In a preferred embodiment, the operating pressure and flow rate of the non-hardenable fluidic material 315 is controllably ramped down when the expansion cone 205 reaches the upper end portion 210*d* of the tubular member 210. In this manner, the sudden release of pressure caused by the complete extrusion of the tubular member 210 off of the expansion cone 205 can be minimized. In a preferred embodiment, the operating pressure is reduced in a substantially linear fashion from 100% to about 10% during the end of the extrusion process beginning when the expansion cone 205 is within about 5 feet from completion of the extrusion process.

Alternatively, or in combination, a shock absorber is provided in the support member 225 in order to absorb the shock caused by the sudden release of pressure. The shock absorber may, for example, be any conventional commercially available shock absorber adapted for use in wellbore operations.

Alternatively, or in combination, an expansion cone catching structure is provided in the upper end portion 210*d* of the tubular member 210 in order to catch or at least decelerate the expansion cone 205.

Once the extrusion process is completed, the expansion cone 205 is removed from the wellbore 100. In a preferred embodiment, either before or after the removal of the expansion cone 205, the integrity of the fluidic seal of the overlapping joint between the upper end portion 210*d* of the tubular member 210 and the lower end portion 115*a* of the preexisting wellbore casing 115 is tested using conventional methods.

In a preferred embodiment, if the fluidic seal of the overlapping joint between the upper end portion 210*d* of the tubular member 210 and the lower end portion 115*a* of the casing 115 is satisfactory, then any uncured portion of the material 305 within the expanded tubular member 210 is then removed in a conventional manner such as, for example, circulating the uncured material out of the interior of the expanded tubular member 210. The expansion cone 205 is then pulled out of the wellbore section 130 and a drill bit or mill is used in combination with a conventional drilling assembly 505 to drill out any hardened material 305 within the tubular member 210. In a preferred embodiment, the material 305 within the annular region 310 is then allowed to fully cure.

Figure 5:
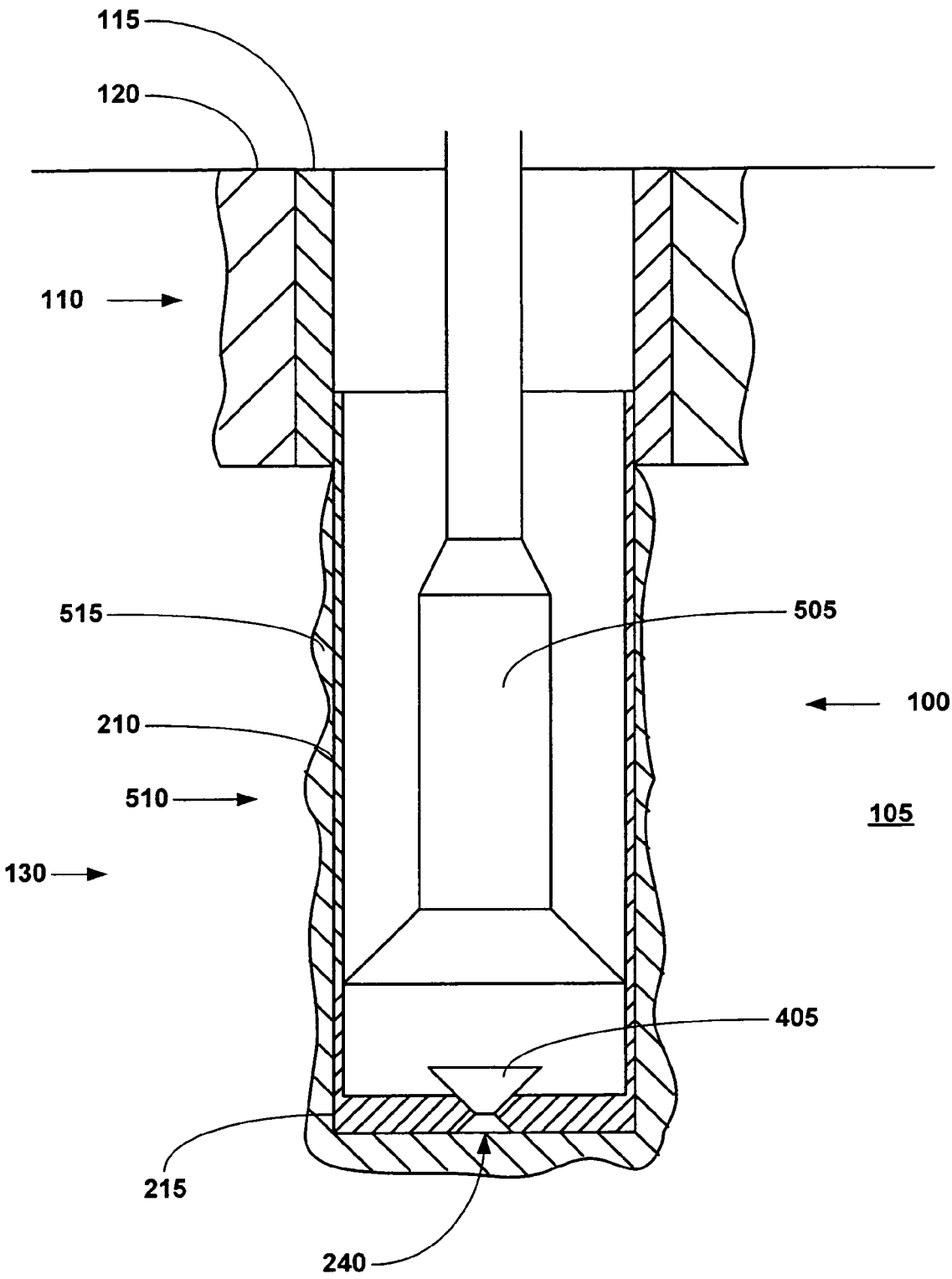
FIG. 5 is a fragmentary cross-sectional view illustrating the drilling out of the cured hardenable fluidic sealing material and the shoe from the new section of the well borehole of FIG. 4.

As illustrated in FIG. 5, preferably any remaining cured material 305 within the interior of the expanded tubular member 210 is then removed in a conventional manner using a conventional drill string 505. The resulting new section of casing 510 preferably includes the expanded tubular member 210 and an outer annular layer 515 of the cured material 305.

Figure 6:
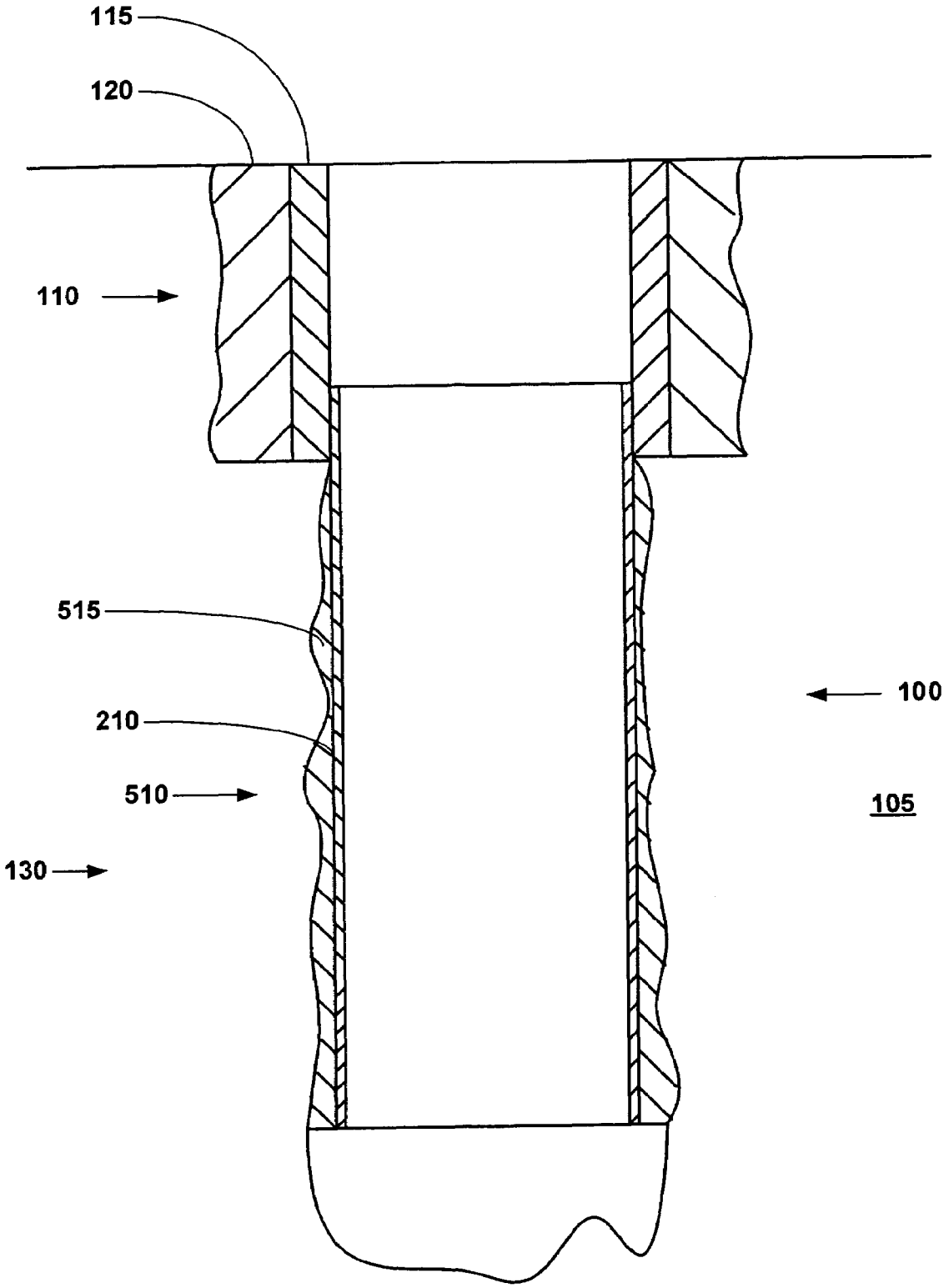
FIG. 6 is a cross-sectional view of the well borehole of FIG. 5 following the drilling out of the shoe.

As illustrated in FIG. 6, the bottom portion of the apparatus 200 including the shoe 215 and dart 405 may then be removed by drilling out the shoe 215 and dart 405 using conventional drilling methods.

Figure 7:
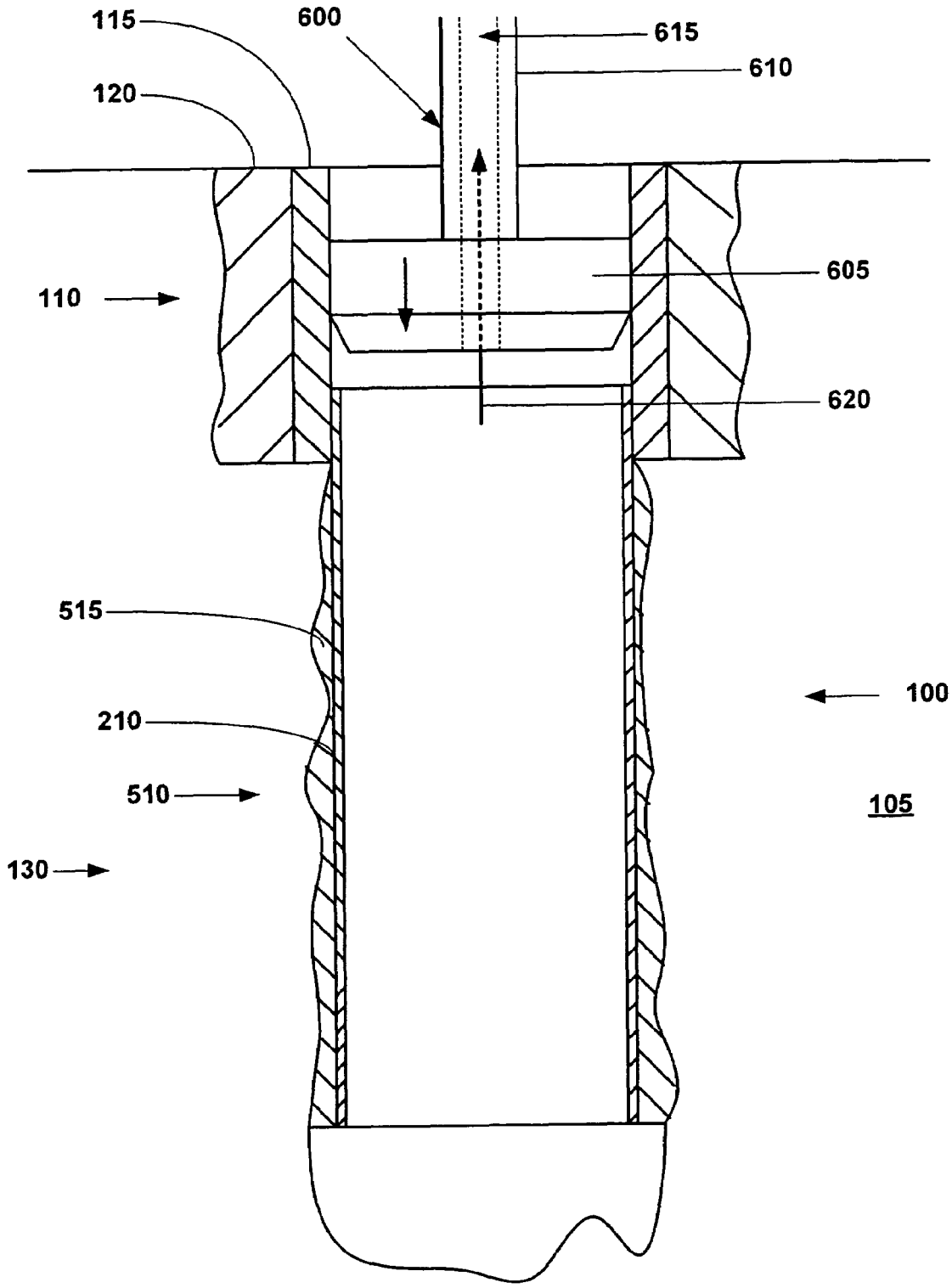
FIG. 7 is a fragmentary cross-sectional view of the placement and actuation of an expansion cone within the well borehole of FIG. 6 for forming a mono-diameter wellbore casing.

As illustrated in FIG. 7, an apparatus 600 for forming a mono-diameter wellbore casing is then positioned within the wellbore casing 115 proximate the tubular member 210 that includes an expansion cone 605 and a support member 610. In a preferred embodiment, the outside diameter of the expansion cone 605 is substantially equal to the inside diameter of the wellbore casing 115. The apparatus 600 preferably further includes a fluid passage 615 for conveying fluidic materials 620 out of the wellbore 100 that are displaced by the placement and operation of the expansion cone 605.

Figure 8:
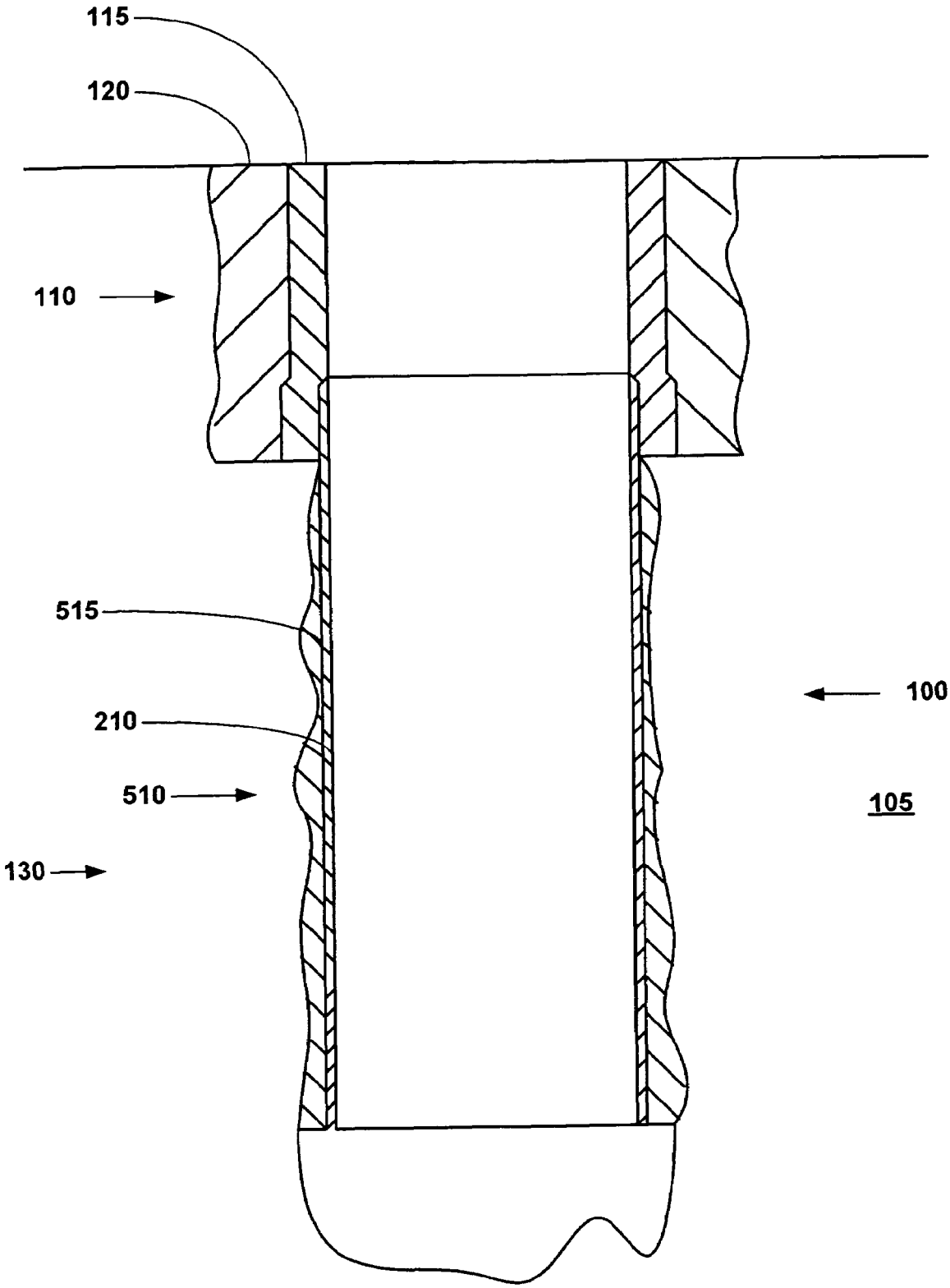
FIG. 8 is a cross-sectional illustration of the well borehole of FIG. 7 following the formation of a mono-diameter wellbore casing.

The expansion cone 605 is then driven downward using the support member 610 in order to radially expand and plastically deform the tubular member 210 and the overlapping portion of the tubular member 115. In this manner, as illustrated in FIG. 8, a mono-diameter wellbore casing is formed that includes the overlapping wellbore casings 115 and 210. In several alternative embodiments, the secondary radial expansion process is performed before, during, or after the material 515 fully cures. In several alternative embodiments, a conventional expansion device including rollers may be substituted for, or used in combination with, the apparatus 600.

Figure 9:
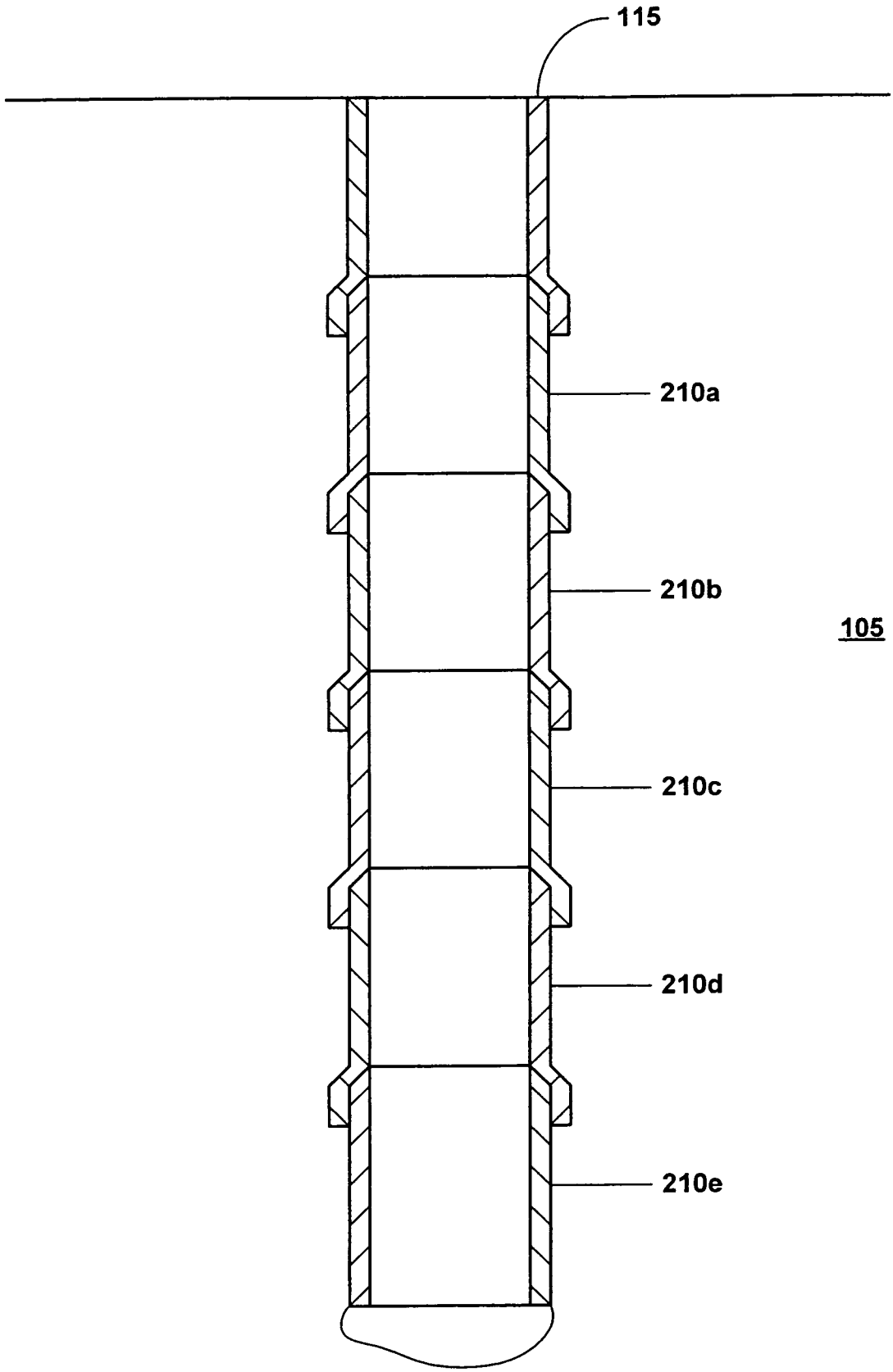
FIG. 9 is a cross-sectional illustration of the well borehole of FIG. 8 following the repeated operation of the methods of FIGS. 1-8 in order to form a mono-diameter wellbore casing including a plurality of overlapping wellbore casings.

More generally, as illustrated in FIG. 9, the method of FIGS. 1-8 is repeatedly performed in order to provide a mono-diameter wellbore casing that includes overlapping wellbore casings 115 and 210*a*-210*e*. The wellbore casing 115, and 210*a*-210*e* preferably include outer annular layers of fluidic sealing material. In this manner, a mono-diameter wellbore casing may be formed within the subterranean formation that extends for tens of thousands of feet. More generally still, the teachings of FIGS. 1-9 may be used to form a mono-diameter wellbore casing, a pipeline, a structural support, or a tunnel within a subterranean formation at any orientation from the vertical to the horizontal.

In a preferred embodiment, the formation of a mono-diameter wellbore casing, as illustrated in FIGS. 1-9, is further provided as disclosed in one or more of the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application Ser. No. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, (21) U.S. provisional patent application Ser. No. 60/237,334, filed on Oct. 2, 2000, and (22) U.S. provisional patent application Ser. No. 60/259,486, filed on Jan. 3, 2001, the disclosures of which are incorporated herein by reference.

In an alternative embodiment, the fluid passage 220 in the shoe 215 is omitted. In this manner, the pressurization of the region 230 is simplified. In an alternative embodiment, the annular body 515 of the fluidic sealing material is formed using conventional methods of injecting a hardenable fluidic sealing material into the annular region 310.

Figure 10:
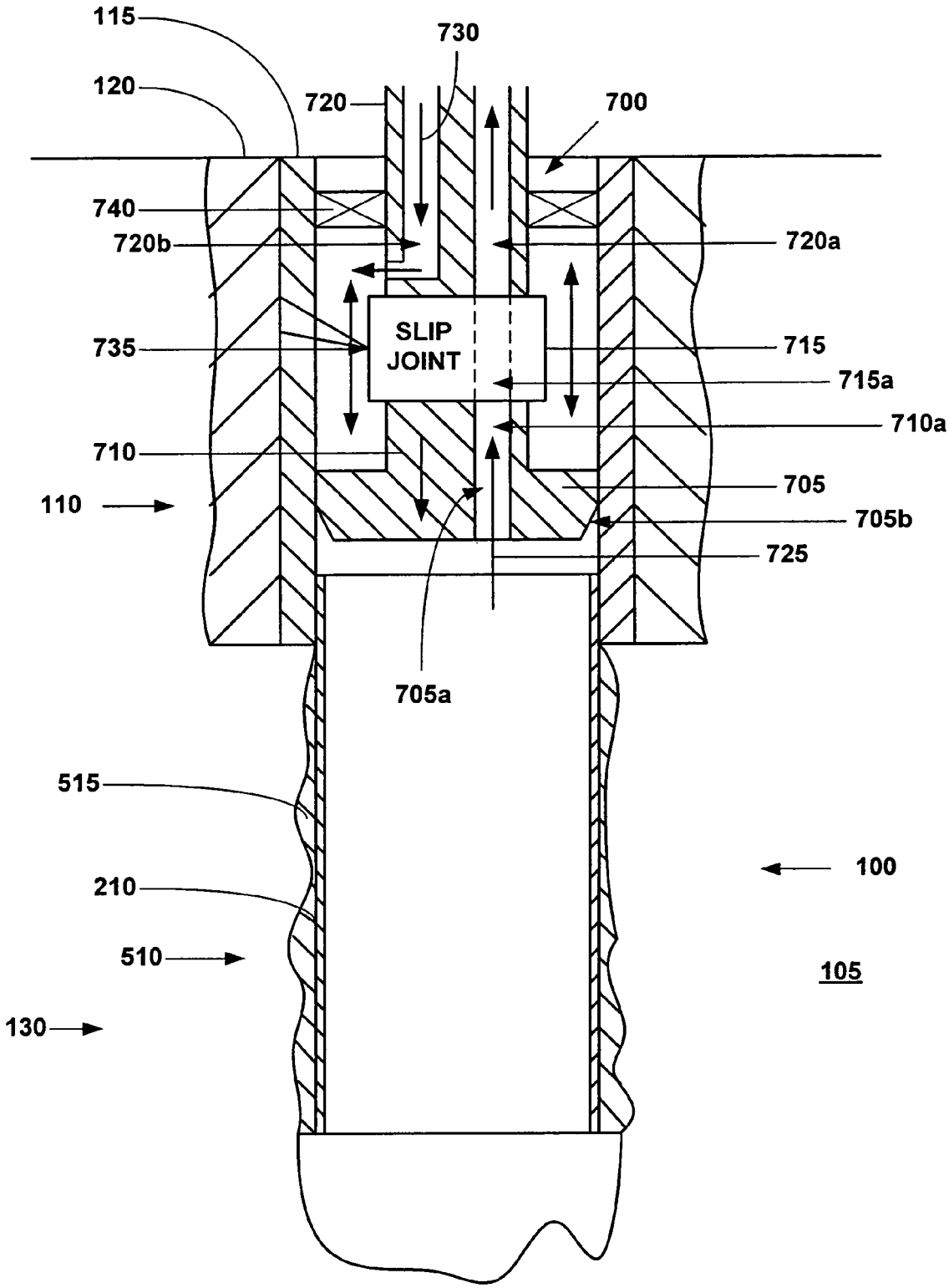
FIG. 10 is a fragmentary cross-sectional illustration of the placement of an alternative embodiment of an apparatus for forming a mono-diameter wellbore casing into the well borehole of FIG. 6.
Figure 11:
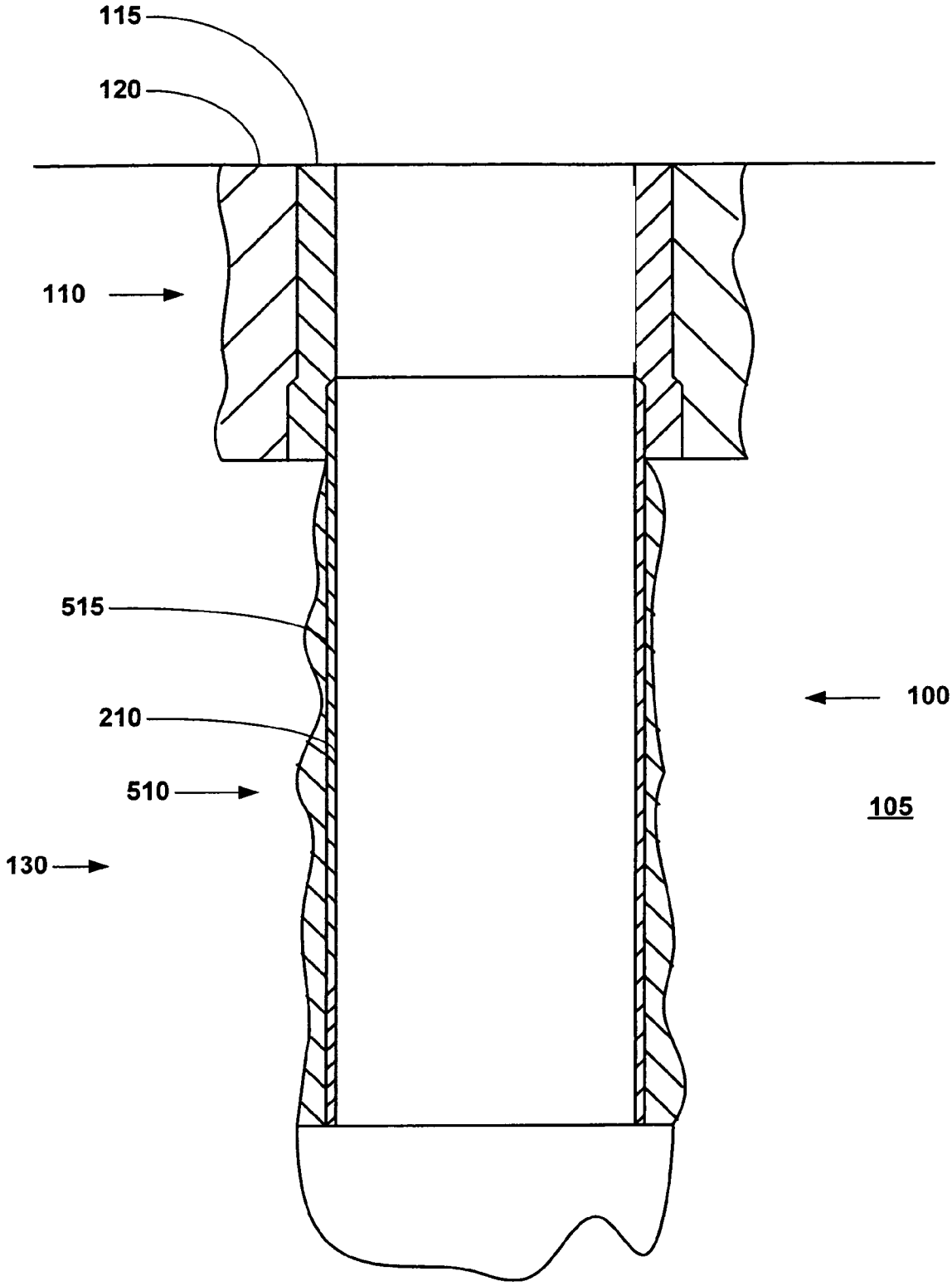
FIG. 11 is a cross-sectional illustration of the well borehole of FIG. 10 following the formation of a mono-diameter wellbore casing.

Referring to FIGS. 10-11, in an alternative embodiment, an apparatus 700 for forming a mono-diameter wellbore casing is positioned within the wellbore casing 115 that includes an expansion cone 705 having a fluid passage 705*a* that is coupled to a support member 710.

The expansion cone 705 preferably further includes a conical outer surface 705*b* for radially expanding and plastically deforming the overlapping portion of the tubular member 115 and the tubular member 210. In a preferred embodiment, the outside diameter of the expansion cone 705 is substantially equal to the inside diameter of the pre-existing wellbore casing 115.

The support member 710 is coupled to a slip joint 715, and the slip joint is coupled to a support member 720. As will be recognized by persons having ordinary skill in the art, a slip joint permits relative movement between objects. Thus, in this manner, the expansion cone 705 and support member 710 may be displaced in the longitudinal direction relative to the support member 720. In a preferred embodiment, the slip joint 710 permits the expansion cone 705 and support member 710 to be displaced in the longitudinal direction relative to the support member 720 for a distance greater than or equal to the axial length of the tubular member 210. In this manner, the expansion cone 705 may be used to plastically deform and radially expand the overlapping portion of the tubular member 115 and the tubular member 210 without having to reposition the support member 720.

The slip joint 715 may be any number of conventional commercially available slip joints that include a fluid passage for conveying fluidic materials through the slip joint. In a preferred embodiment, the slip joint 715 is a pumper sub commercially available from Bowen Oil Tools in order to optimally provide elongation of the drill string.

The support member 710, slip joint 715, and support member 720 further include fluid passages 710*a*, 715*a*, and 720*a*, respectively, that are fluidicly coupled to the fluid passage 705*a*. During operation, the fluid passages 705*a*, 710*a*, 715*a*, and 720*a* preferably permit fluidic materials 725 displaced by the expansion cone 705 to be conveyed to a location above the apparatus 700. In this manner, operating pressures within the subterranean formation 105 below the expansion cone are minimized.

The support member 720 further preferably includes a fluid passage 720*b* that permits fluidic materials 730 to be conveyed into an annular region 735 surrounding the support member 710, the slip joint 715, and the support member 720 and bounded by the expansion cone 705 and a conventional packer 740 that is coupled to the support member 720. In this manner, the annular region 735 may be pressurized by the injection of the fluids 730 thereby causing the expansion cone 705 to be displaced in the longitudinal direction relative to the support member 720 to thereby plastically deform and radially expand the overlapping portion of the tubular member 115 and the tubular member 210.

During operation, as illustrated in FIG. 10, in a preferred embodiment, the apparatus 700 is positioned within the pre-existing casing 115 with the bottom surface of the expansion cone 705 proximate the top of the tubular member 210. During placement of the apparatus 700 within the preexisting casing 115, fluidic materials 725 within the casing are conveyed out of the casing through the fluid passages 705*a*, 710*a*, 715*a*, and 720*a*. In this manner, surge pressures within the wellbore 100 are minimized.

The packer 740 is then operated in a well-known manner to fluidicly isolate the annular region 735 from the annular region above the packer. The fluidic material 730 is then injected into the annular region 735 using the fluid passage 720*b*. Continued injection of the fluidic material 730 into the annular region 735 preferably pressurizes the annular region and thereby causes the expansion cone 705 and support member 710 to be displaced in the longitudinal direction relative to the support member 720.

As illustrated in FIG. 11, in a preferred embodiment, the longitudinal displacement of the expansion cone 705 in turn plastically deforms and radially expands the overlapping portion of the tubular member 115 and the tubular member 210. In this manner, a mono-diameter wellbore casing is formed that includes the overlapping wellbore casings 115 and 210. The apparatus 700 may then be removed from the wellbore 100 by releasing the packer 740 from engagement with the wellbore casing 115, and lifting the apparatus 700 out of the wellbore 100.

In an alternative embodiment of the apparatus 700, the fluid passage 720*b* is provided within the packer 740 in order to enhance the operation of the apparatus 700.

In an alternative embodiment of the apparatus 700, the fluid passages 705*a*, 710*a*, 715*a*, and 720*a* are omitted. In this manner, in a preferred embodiment, the region of the wellbore 100 below the expansion cone 705 is pressurized and one or more regions of the subterranean formation 105 are fractured to enhance the oil and/or gas recovery process.

Referring to FIGS. 12-15, in an alternative embodiment, an apparatus 800 is positioned within the wellbore casing 115 that includes an expansion cone 805 having a fluid passage 805*a* that is releasably coupled to a releasable coupling 810 having fluid passage 810*a*.

The fluid passage 805*a* is preferably adapted to receive a conventional ball, plug, or other similar device for sealing off the fluid passage. The expansion cone 805 further includes a conical outer surface 805*b* for radially expanding and plastically deforming the overlapping portion of the tubular member 115 and the tubular member 210. In a preferred embodiment, the outside diameter of the expansion cone 805 is substantially equal to the inside diameter of the pre-existing wellbore casing 115.

The releasable coupling 810 may be any number of conventional commercially available releasable couplings that include a fluid passage for conveying fluidic materials through the releasable coupling. In a preferred embodiment, the releasable coupling 810 is a safety joint commercially available from Halliburton in order to optimally release the expansion cone 805 from the support member 815 at a predetermined location.

A support member 815 is coupled to the releasable coupling 810 that includes a fluid passage 815*a*. The fluid passages 805*a*, 810*a* and 815*a* are fluidicly coupled. In this manner, fluidic materials may be conveyed into and out of the wellbore 100.

A packer 820 is movably and sealingly coupled to the support member 815. The packer may be any number of conventional packers. In a preferred embodiment, the packer 820 is a commercially available burst preventer (BOP) in order to optimally provide a sealing member.

Figure 12:
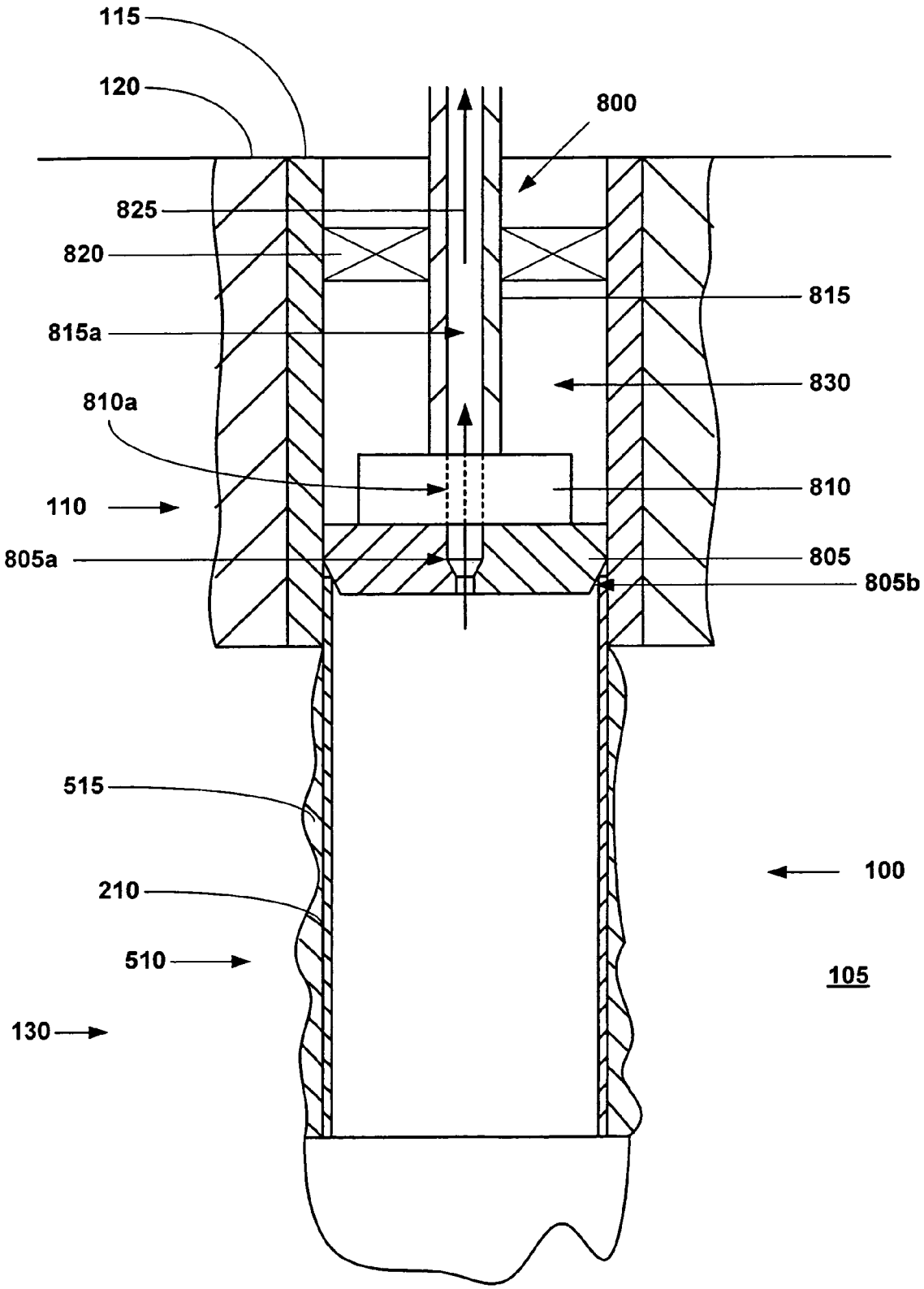
FIG. 12 is a fragmentary cross-sectional illustration of the placement of an alternative embodiment of an apparatus for forming a mono-diameter wellbore casing into the well borehole of FIG. 6.

During operation, as illustrated in FIG. 12, in a preferred embodiment, the apparatus 800 is positioned within the pre-existing casing 115 with the bottom surface of the expansion cone 805 proximate the top of the tubular member 210. During placement of the apparatus 800 within the preexisting casing 115, fluidic materials 825 within the casing are conveyed out of the casing through the fluid passages 805*a*, 810*a*, and 815*a*. In this manner, surge pressures within the wellbore 100 are minimized. The packer 820 is then operated in a well-known manner to fluidicly isolate a region 830 within the casing 115 between the expansion cone 805 and the packer 820 from the region above the packer.

Figure 13:
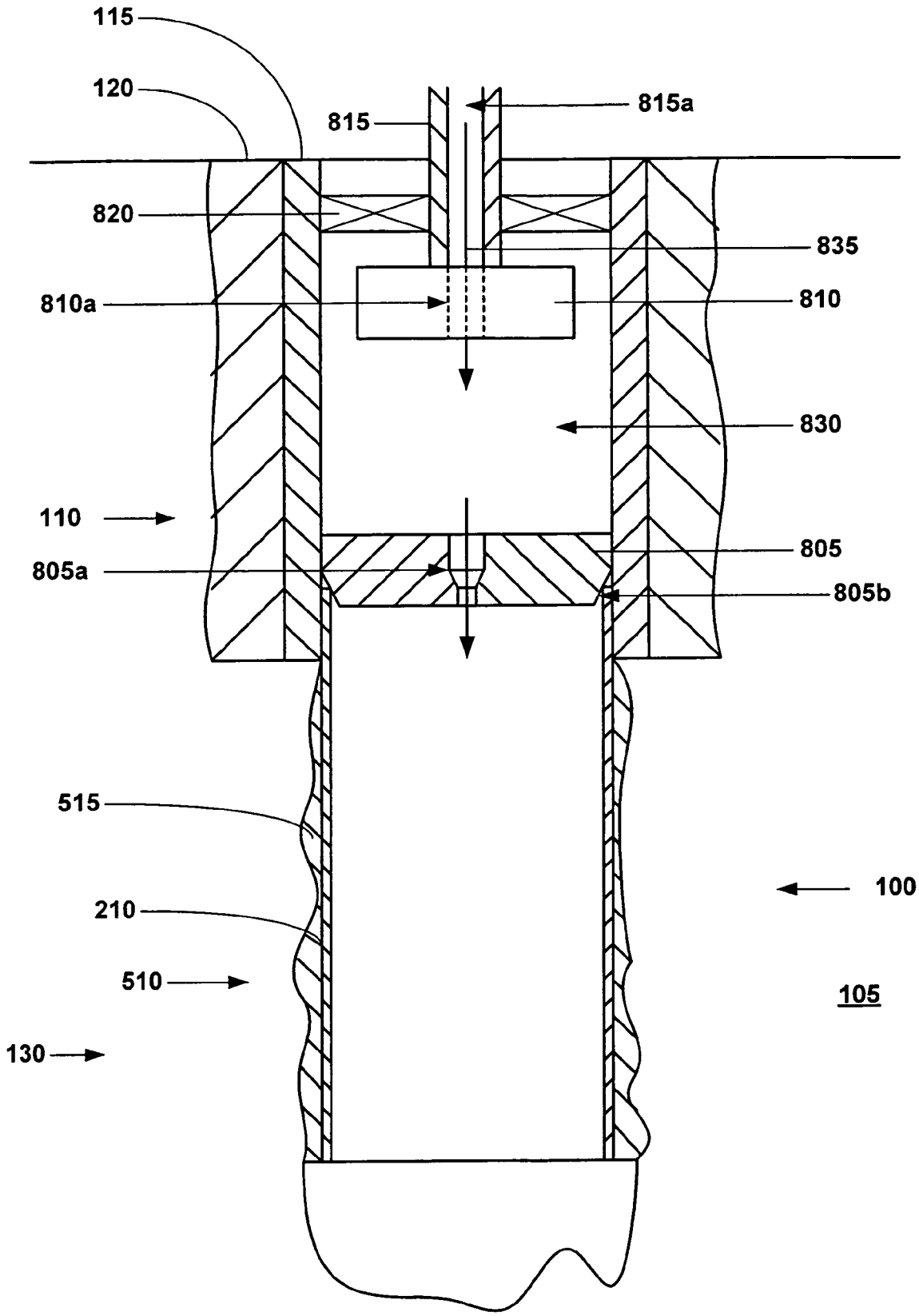
FIG. 13 is a fragmentary cross-sectional illustration of the well borehole of FIG. 12 during the injection of pressurized fluids into the well borehole.

In a preferred embodiment, as illustrated in FIG. 13, the releasable coupling 810 is then released from engagement with the expansion cone 805 and the support member 815 is moved away from the expansion cone. A fluidic material 835 may then be injected into the region 830 through the fluid passages 810*a* and 815*a*. The fluidic material 835 may then flow into the region of the wellbore 100 below the expansion cone 805 through the valveable passage 805*b*. Continued injection of the fluidic material 835 may thereby pressurize and fracture regions of the formation 105 below the tubular member 210. In this manner, the recovery of oil and/or gas from the formation 105 may be enhanced.

Figure 14:
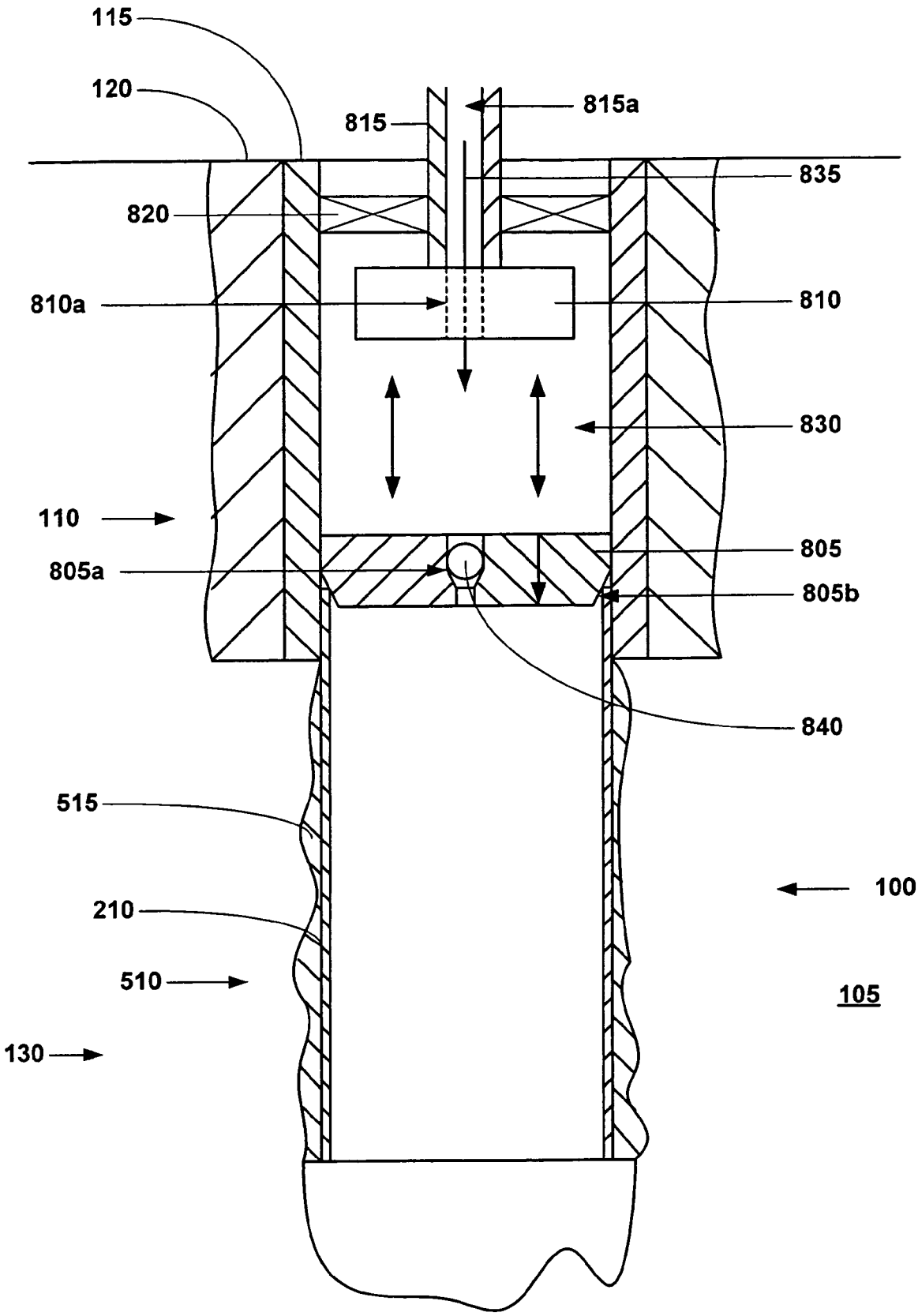
FIG. 14 is a fragmentary cross-sectional illustration of the well borehole of FIG. 13 during the formation of the mono-diameter wellbore casing.

In a preferred embodiment, as illustrated in FIG. 14, a plug, ball, or other similar valve device 840 may then be positioned in the valveable passage 805*a* by introducing the valve device into the fluidic material 835. In this manner, the region 830 may be fluidicly isolated from the region below the expansion cone 805. Continued injection of the fluidic material 835 may then pressurize the region 830 thereby causing the expansion cone 805 to be displaced in the longitudinal direction.

Figure 15:
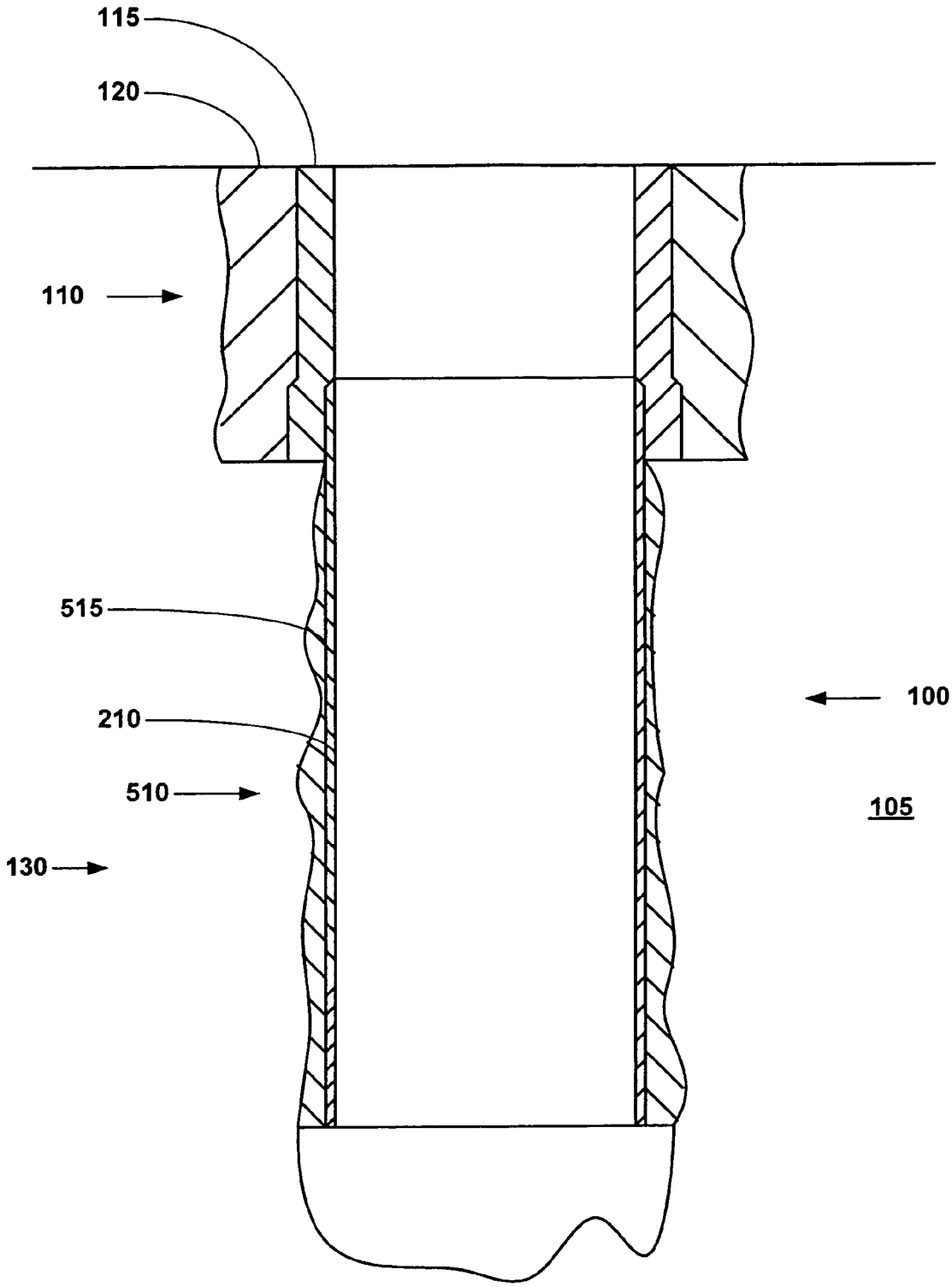
FIG. 15 is a fragmentary cross-sectional illustration of the well borehole of FIG. 14 following the formation of the mono-diameter wellbore casing.

In a preferred embodiment, as illustrated in FIG. 15, the longitudinal displacement of the expansion cone 805 plastically deforms and radially expands the overlapping portion of the pre-existing wellbore casing 115 and the tubular member 210. In this manner, a mono-diameter wellbore casing is formed that includes the pre-existing wellbore casing 115 and the tubular member 210. Upon completing the radial expansion process, the support member 815 may be moved toward the expansion cone 805 and the expansion cone may be recoupled to the releasable coupling device 810. The packer 820 may then be decoupled from the wellbore casing 115, and the expansion cone 805 and the remainder of the apparatus 800 may then be removed from the wellbore 100.

In a preferred embodiment, the displacement of the expansion cone 805 also pressurizes the region within the tubular member 210 below the expansion cone. In this manner, the subterranean formation surrounding the tubular member 210 may be elastically or plastically compressed thereby enhancing the structural properties of the formation.

A method of creating a mono-diameter wellbore casing in a borehole located in a subterranean formation including a preexisting wellbore casing has been described that includes installing a tubular liner and a first expansion cone in the borehole, injecting a fluidic material into the borehole, pressurizing a portion of an interior region of the tubular liner below the first expansion cone, radially expanding at least a portion of the tubular liner in the borehole by extruding at least a portion of the tubular liner off of the first expansion cone, and radially expanding at least a portion of the preexisting wellbore casing and the tubular liner using a second expansion cone. In a preferred embodiment, radially expanding at least a portion of the preexisting wellbore casing and the tubular liner using the second expansion cone includes displacing the second expansion cone in a longitudinal direction, and permitting fluidic materials displaced by the second expansion cone to be removed. In a preferred embodiment, displacing the second expansion cone in a longitudinal direction includes applying fluid pressure to the second expansion cone. In a preferred embodiment, radially expanding at least a portion of the preexisting wellbore casing and the tubular liner using the second expansion cone includes displacing the second expansion cone in a longitudinal direction, and compressing at least a portion of the subterranean formation using fluid pressure. In a preferred embodiment, displacing the second expansion cone in a longitudinal direction includes applying fluid pressure to the second expansion cone. In a preferred embodiment, injecting a hardenable fluidic sealing material into an annulus between the tubular liner and the borehole.

An apparatus for forming a mono-diameter wellbore casing in a borehole located in a subterranean formation including a preexisting wellbore casing has also been described that includes means for installing a tubular liner and a first expansion cone in the borehole, means for injecting a fluidic material into the borehole, means for pressurizing a portion of an interior region of the tubular liner below the first expansion cone, means for radially expanding at least a portion of the tubular liner in the borehole by extruding at least a portion of the tubular liner off of the first expansion cone, and means for radially expanding at least a portion of the preexisting wellbore casing and the tubular liner using a second expansion cone. In a preferred embodiment, the means for radially expanding at least a portion of the preexisting wellbore casing and the tubular liner using the second expansion cone includes means for displacing the second expansion cone in a longitudinal direction, and means for permitting fluidic materials displaced by the second expansion cone to be removed. In a preferred embodiment, the means for displacing the second expansion cone in a longitudinal direction includes means for applying fluid pressure to the second expansion cone. In a preferred embodiment, the means for radially expanding at least a portion of the preexisting wellbore casing and the tubular liner using the second expansion cone includes means for displacing the second expansion cone in a longitudinal direction, and means for compressing at least a portion of the subterranean formation using fluid pressure. In a preferred embodiment, the means for displacing the second expansion cone in a longitudinal direction includes means for applying fluid pressure to the second expansion cone. In a preferred embodiment, the apparatus further includes means for injecting a hardenable fluidic sealing material into an annulus between the tubular liner and the borehole.

A method of joining a second tubular member to a first tubular member positioned within a subterranean formation, the first tubular member having an inner diameter greater than an outer diameter of the second tubular member has also been described that includes positioning a first expansion cone within an interior region of the second tubular member, pressurizing a portion of the interior region of the second tubular member adjacent to the first expansion cone, extruding at least a portion of the second tubular member off of the first expansion cone into engagement with the first tubular member, and radially expanding at least a portion of the first tubular member and the second tubular member using a second expansion cone. In a preferred embodiment, radially expanding at least a portion of the first tubular member and the second tubular member using the second expansion cone includes displacing the second expansion cone in a longitudinal direction, and permitting fluidic materials displaced by the second expansion cone to be removed. In a preferred embodiment, displacing the second expansion cone in a longitudinal direction includes applying fluid pressure to the second expansion cone. In a preferred embodiment, radially expanding at least a portion of the first and second tubular members using the second expansion cone includes displacing the second expansion cone in a longitudinal direction, and compressing at least a portion of the subterranean formation using fluid pressure. In a preferred embodiment, displacing the second expansion cone in a longitudinal direction includes applying fluid pressure to the second expansion cone. In a preferred embodiment, the method further includes injecting a hardenable fluidic sealing material into an annulus around the second tubular member.

An apparatus for joining a second tubular member to a first tubular member positioned within a subterranean formation, the first tubular member having an inner diameter greater than an outer diameter of the second tubular member, has also been described that includes means for positioning a first expansion cone within an interior region of the second tubular member, means for pressurizing a portion of the interior region of the second tubular member adjacent to the first expansion cone, means for extruding at least a portion of the second tubular member off of the first expansion cone into engagement with the first tubular member, and means for radially expanding at least a portion of the first tubular member and the second tubular member using a second expansion cone. In a preferred embodiment, the means for radially expanding at least a portion of the first tubular member and the second tubular member using the second expansion cone includes means for displacing the second expansion cone in a longitudinal direction, and means for permitting fluidic materials displaced by the second expansion cone to be removed. In a preferred embodiment, the means for displacing the second expansion cone in a longitudinal direction includes means for applying fluid pressure to the second expansion cone. In a preferred embodiment, the means for radially expanding at least a portion of the first tubular member and the second tubular member using the second expansion cone includes means for displacing the second expansion cone in a longitudinal direction, and means for compressing at least a portion of the subterranean formation using fluid pressure. In a preferred embodiment, the means for displacing the second expansion cone in a longitudinal direction includes means for applying fluid pressure to the second expansion cone. In a preferred embodiment, the apparatus further includes means for injecting a hardenable fluidic sealing material into an annulus around the second tubular member.

An apparatus has also been described that includes a subterranean formation including a borehole, a wellbore casing coupled to the borehole, and a tubular liner coupled to the wellbore casing. The inside diameters of the wellbore casing and the tubular liner are substantially equal, and the tubular liner is coupled to the wellbore casing by a method that includes installing the tubular liner and a first expansion cone in the borehole, injecting a fluidic material into the borehole, pressurizing a portion of an interior region of the tubular liner below the first expansion cone, radially expanding at least a portion of the tubular liner in the borehole by extruding at least a portion of the tubular liner off of the first expansion cone, and radially expanding at least a portion of the wellbore casing and the tubular liner using a second expansion cone. In a preferred embodiment, radially expanding at least a portion of the wellbore casing and the tubular liner using the second expansion cone includes displacing the second expansion cone in a longitudinal direction, and permitting fluidic materials displaced by the second expansion cone to be removed. In a preferred embodiment, displacing the second expansion cone in a longitudinal direction includes applying fluid pressure to the second expansion cone. In a preferred embodiment, radially expanding at least a portion of the wellbore casing and the tubular liner using the second expansion cone includes displacing the second expansion cone in a longitudinal direction and compressing at least a portion of the subterranean formation using fluid pressure. In a preferred embodiment, displacing the second expansion cone in a longitudinal direction includes applying fluid pressure to the second expansion cone. In a preferred embodiment, the annular layer of the fluidic sealing material is formed by a method that includes injecting a hardenable fluidic sealing material into an annulus between the tubular liner and the borehole.

An apparatus has also been described that includes a subterranean formation including a borehole, a first tubular member coupled to the borehole, and a second tubular member coupled to the wellbore casing. The inside diameters of the first and second tubular members are substantially equal, and the second tubular member is coupled to the first tubular member by a method that includes installing the second tubular member and a first expansion cone in the borehole, injecting a fluidic material into the borehole, pressurizing a portion of an interior region of the second tubular member below the first expansion cone, radially expanding at least a portion of the second tubular member in the borehole by extruding at least a portion of the second tubular member off of the first expansion cone, and radially expanding at least a portion of the first tubular member and the second tubular member using a second expansion cone. In a preferred embodiment, radially expanding at least a portion of the first and second tubular members using the second expansion cone includes displacing the second expansion cone in a longitudinal direction, and permitting fluidic materials displaced by the second expansion cone to be removed. In a preferred embodiment, displacing the second expansion cone in a longitudinal direction includes applying fluid pressure to the second expansion cone. In a preferred embodiment, radially expanding at least a portion of the first and second tubular members using the second expansion cone includes displacing the second expansion cone in a longitudinal direction, and compressing at least a portion of the subterranean formation using fluid pressure. In a preferred embodiment, displacing the second expansion cone in a longitudinal direction includes applying fluid pressure to the second expansion cone. In a preferred embodiment, the annular layer of the fluidic sealing material is formed by a method that includes injecting a hardenable fluidic sealing material into an annulus between the first tubular member and the borehole.

An apparatus for radially expanding an overlapping joint between a wellbore casing and a tubular liner has also been described that includes a tubular support including first and second passages, a sealing member coupled to the tubular support, a slip joint coupled to the tubular support including a third passage fluidicly coupled to the second passage, and an expansion cone coupled to the slip joint including a fourth passage fluidicly coupled to the third passage.

A method of radially expanding an overlapping joint between a wellbore casing and a tubular liner has also been described that includes positioning an expansion cone within the wellbore casing above the overlapping joint, sealing off an annular region within the wellbore casing above the expansion cone, displacing the expansion cone by pressurizing the annular region, and removing fluidic materials displaced by the expansion cone from the tubular liner. In a preferred embodiment, the method further includes supporting the expansion cone during the displacement of the expansion cone.

An apparatus for radially expanding an overlapping joint between a wellbore casing and a tubular liner has also been described that includes means for positioning an expansion cone within the wellbore casing above the overlapping joint, means for sealing off an annular region within the wellbore casing above the expansion cone, means for displacing the expansion cone by pressurizing the annular region, and means for removing fluidic materials displaced by the expansion cone from the tubular liner. In a preferred embodiment, the apparatus further includes means for supporting the expansion cone during the displacement of the expansion cone.

An apparatus for radially expanding an overlapping joint between a wellbore casing and a tubular liner has also been described that includes a tubular support including a first passage, a sealing member coupled to the tubular support, a releasable latching member coupled to the tubular support, and an expansion cone releasably coupled to the releasable latching member including a second passage fluidicly coupled to the first passage.

A method of radially expanding an overlapping joint between a wellbore casing and a tubular liner has also been described that includes positioning an expansion cone within the wellbore casing above the overlapping joint, sealing off a region within the wellbore casing above the expansion cone, releasing the expansion cone, and displacing the expansion cone by pressurizing the annular region. In a preferred embodiment, the method further includes pressurizing the interior of the tubular liner.

An apparatus for radially expanding an overlapping joint between a wellbore casing and a tubular liner has also been described that includes means for positioning an expansion cone within the wellbore casing above the overlapping joint, means for sealing off a region within the wellbore casing above the expansion cone, means for releasing the expansion cone, and means for displacing the expansion cone by pressurizing the annular region. In a preferred embodiment, the apparatus further includes means for pressurizing the interior of the tubular liner.

An apparatus for radially expanding an overlapping joint between first and second tubular members has also been described that includes a tubular support including first and second passages, a sealing member coupled to the tubular support, a slip joint coupled to the tubular support including a third passage fluidicly coupled to the second passage, and an expansion cone coupled to the slip joint including a fourth passage fluidicly coupled to the third passage.

A method of radially expanding an overlapping joint between first and second tubular members has also been described that includes positioning an expansion cone within the first tubular member above the overlapping joint, sealing off an annular region within the first tubular member above the expansion cone, displacing the expansion cone by pressurizing the annular region, and removing fluidic materials displaced by the expansion cone from the second tubular member. In a preferred embodiment, the method further includes supporting the expansion cone during the displacement of the expansion cone.

An apparatus for radially expanding an overlapping joint between first and second tubular members has also been described that includes means for positioning an expansion cone within the first tubular member above the overlapping joint, means for sealing off an annular region within the first tubular member above the expansion cone, means for displacing the expansion cone by pressurizing the annular region, and means for removing fluidic materials displaced by the expansion cone from the second tubular member. In a preferred embodiment, the apparatus further includes means for supporting the expansion cone during the displacement of the expansion cone.

An apparatus for radially expanding an overlapping joint between first and second tubular members has also been described that includes a tubular support including a first passage, a sealing member coupled to the tubular support, a releasable latching member coupled to the tubular support, and an expansion cone releasably coupled to the releasable latching member including a second passage fluidicly coupled to the first passage.

A method of radially expanding an overlapping joint between first and second tubular members has also been described that includes positioning an expansion cone within the first tubular member above the overlapping joint, sealing off a region within the first tubular member above the expansion cone, releasing the expansion cone, and displacing the expansion cone by pressurizing the annular region. In a preferred embodiment, the method further includes pressurizing the interior of the second tubular member.

An apparatus for radially expanding an overlapping joint between first and second tubular members has also been described that includes means for positioning an expansion cone within the first tubular member above the overlapping joint, means for sealing off a region within the first tubular member above the expansion cone, means for releasing the expansion cone, and means for displacing the expansion cone by pressurizing the annular region. In a preferred embodiment, the apparatus further includes means for pressurizing the interior of the second tubular member.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. A method of creating a mono-diameter wellbore casing in a borehole located in a subterranean formation including a preexisting wellbore casing, comprising:

installing a tubular liner and a first expansion device in the borehole;

injecting a fluidic material into the borehole;

pressurizing a portion of an interior region of the tubular liner below the first expansion device;

radially expanding at least a portion of the tubular liner in the borehole by extruding at least a portion of the tubular liner off of the first expansion device; and radially expanding at least a portion of the preexisting wellbore casing and the tubular liner using a second expansion device;

wherein at least one of the first and second expansion devices comprises a slip joint.

2. The method of claim 1, wherein radially expanding at least a portion of the preexisting wellbore casing and the tubular liner using the second expansion device comprises:

displacing the second expansion device in a longitudinal direction; and permitting fluidic materials displaced by the second expansion device to be removed.

3. The method of claim 2, wherein displacing the second expansion device in a longitudinal direction comprises:

applying fluid pressure to the second expansion device.

4. The method of claim 1, wherein radially expanding at least a portion of the preexisting wellbore casing and the tubular liner using the second expansion device comprises:

displacing the second expansion device in a longitudinal direction; and compressing at least a portion of the subterranean formation using fluid pressure.

5. The method of claim 4, wherein displacing the second expansion device in a longitudinal direction comprises:

applying fluid pressure to the second expansion device.

6. The method of claim 1, further comprising:

injecting a hardenable fluidic sealing material into an annulus between the tubular liner and the borehole.

7. The method of claim 1, wherein the inside diameter of the portion of the tubular liner radially expanded by the first expansion device is equal to the inside diameter of the portion of the preexisting wellbore casing that was not radially expanded by the second expansion device.

8. An apparatus for forming a mono-diameter wellbore casing in a borehole located in a subterranean formation including a preexisting wellbore casing, comprising:

means for installing a tubular liner and a first expansion device in the borehole;

means for injecting a fluidic material into the borehole;

means for pressurizing a portion of an interior region of the tubular liner below the first expansion device;

means for radially expanding at least a portion of the tubular liner in the borehole by extruding at least a portion of the tubular liner off of the first expansion device; and means for radially expanding at least a portion of the preexisting wellbore casing and the tubular liner using a second expansion device;

wherein at least one of the first and second expansion devices comprises slip joint means.

9. The apparatus of claim 8, wherein the means for radially expanding at least a portion of the preexisting wellbore casing and the tubular liner using the second expansion device comprises:

means for displacing the second expansion device in a longitudinal direction; and means for permitting fluidic materials displaced by the second expansion device to be removed.

10. The apparatus of claim 9, wherein the means for displacing the second expansion device in a longitudinal direction comprises:

means for applying fluid pressure to the second expansion device.

11. The apparatus of claim 8, wherein the means for radially expanding at least a portion of the preexisting wellbore casing and the tubular liner using the second expansion device comprises:

means for displacing the second expansion device in a longitudinal direction; and means for compressing at least a portion of the subterranean formation using fluid pressure.

12. The apparatus of claim 11, wherein the means for displacing the second expansion device in a longitudinal direction comprises:

means for applying fluid pressure to the second expansion device.

13. The apparatus of claim 8, further comprising:

means for injecting a hardenable fluidic sealing material into an annulus between the tubular liner and the borehole.

14. The apparatus of claim 8, wherein the inside diameter of the portion of the tubular liner radially expanded by the first expansion device is equal to the inside diameter of the portion of the preexisting wellbore casing that was not radially expanded by the second expansion device.

15. A method of joining a second tubular member to a first tubular member positioned within a subterranean formation, the first tubular member having an inner diameter greater than an outer diameter of the second tubular member, comprising:

positioning a first expansion device within an interior region of the second tubular member;

pressurizing a portion of the interior region of the second tubular member adjacent to the first expansion device;

extruding at least a portion of the second tubular member off of the first expansion device into engagement with the first tubular member; and radially expanding at least a portion of the first tubular member and the second tubular member using a second expansion device;

wherein at least one of the first and second expansion devices comprise a slip joint.

16. The method of claim 15, wherein radially expanding at least a portion of the first tubular member and the second tubular member using the second expansion device comprises:

displacing the second expansion device in a longitudinal direction; and permitting fluidic materials displaced by the second expansion device to be removed.

17. The method of claim 16, wherein displacing the second expansion device in a longitudinal direction comprises:

applying fluid pressure to the second expansion device.

18. The method of claim 15, wherein radially expanding at least a portion of the first and second tubular members using the second expansion device comprises:

displacing the second expansion device in a longitudinal direction; and compressing at least a portion of the subterranean formation using fluid pressure.

19. The method of claim 18, wherein displacing the second expansion device in a longitudinal direction comprises:

applying fluid pressure to the second expansion device.

20. The method of claim 15, further comprising:

injecting a hardenable fluidic sealing material into an annulus around the second tubular member.

21. The method of claim 15, wherein the inside diameter of the portion of the tubular liner extruded off of the first expansion device is equal to the inside diameter of the portion of the preexisting wellbore casing that was not radially expanded by the second expansion device.

22. An apparatus for joining a second tubular member to a first tubular member positioned within a subterranean formation, the first tubular member having an inner diameter greater than an outer diameter of the second tubular member, comprising:

means for positioning a first expansion device within an interior region of the second tubular member;

means for pressurizing a portion of the interior region of the second tubular member adjacent to the first expansion device;

means for extruding at least a portion of the second tubular member off of the first expansion device into engagement with the first tubular member; and means for radially expanding at least a portion of the first tubular member and the second tubular member using a second expansion device;

wherein at least one of the first and second expansion devices comprise slip joint means.

23. The apparatus of claim 22, wherein the means for radially expanding at least a portion of the first tubular member and the second tubular member using the second expansion device comprises:

means for displacing the second expansion device in a longitudinal direction; and means for permitting fluidic materials displaced by the second expansion device to be removed.

24. The apparatus of claim 23, wherein the means for displacing the second expansion device in a longitudinal direction comprises:

means for applying fluid pressure to the second expansion device.

25. The apparatus of claim 22, wherein the means for radially expanding at least a portion of the first tubular member and the second tubular member using the second expansion device comprises:

means for displacing the second expansion device in a longitudinal direction; and means for compressing at least a portion of the subterranean formation using fluid pressure.

26. The apparatus of claim 25, wherein the means for displacing the second expansion device in a longitudinal direction comprises:

means for applying fluid pressure to the second expansion device.

27. The apparatus of claim 22, further comprising:

means for injecting a hardenable fluidic sealing material into an annulus around the second tubular member.

28. The apparatus of claim 22, wherein the inside diameter of the portion of the tubular liner extruded off of the first expansion device is equal to the inside diameter of the portion of the preexisting wellbore casing that was not radially expanded by the second expansion device.

29. An apparatus for radially expanding an overlapping joint between a wellbore casing and a tubular liner, comprising:

a tubular support including first and second passages;

a sealing member coupled to the tubular support;

a slip joint coupled to the tubular support including a third passage fluidicly coupled to the second passage; and an expansion device coupled to the slip joint including a fourth passage fluidicly coupled to the third passage;

wherein the slip joint is axially positioned between the tubular support and the expansion device; and wherein the slip joint limits displacement of the expansion device relative to the tubular support in the longitudinal direction.

30. A method of radially expanding an overlapping joint between a wellbore casing and a tubular liner, comprising:
positioning an expansion device within the wellbore casing above the overlapping joint;
sealing off an annular region within the wellbore casing above the expansion device;
displacing the expansion device by pressurizing the annular region; and
removing fluidic materials displaced by the expansion device from the tubular liner;
wherein the expansion device comprises a slip joint.

31. The method of claim 30, further comprising:
supporting the expansion device during the displacement of the expansion device.

32. An apparatus for radially expanding an overlapping joint between a wellbore casing and a tubular liner, comprising:
means for positioning an expansion device within the wellbore casing above the overlapping joint;
means for sealing off an annular region within the wellbore casing above the expansion device;
means for displacing the expansion device by pressurizing, the annular region; and
means for removing fluidic materials displaced by the expansion device from the tubular liner;
wherein a slip joint means is coupled to, and axially positioned above, the expansion device.

33. The apparatus of claim 32, further comprising:
means for supporting the expansion device during the displacement of the expansion device.

34. An apparatus for radially expanding an overlapping joint between a wellbore casing and a tubular liner, comprising:
a tubular support including a first passage;
a sealing member coupled to the tubular support;
a releasable latching member coupled to the tubular support; and
an expansion device releasably coupled to the releasable latching member including a second passage fluidicly coupled to the first passage;
wherein the expansion device comprises a slip joint.

35. A method of radially expanding an overlapping joint between a wellbore casing and a tubular liner, comprising:
positioning an expansion device within the wellbore casing above the overlapping joint;
sealing off an annular region within the wellbore casing above the expansion device;
releasing the expansion device; and
displacing the expansion device by pressurizing the annular region;
wherein the expansion device comprises a slip joint.

36. The method of claim 35, further comprising:
pressurizing the interior of the tubular liner.

37. An apparatus for radially expanding an overlapping joint between a wellbore casing and a tubular liner, comprising:
means for positioning an expansion device within the wellbore casing above the overlapping joint;
means for sealing off a region within the wellbore casing above the expansion device;
means for releasing the expansion device; and
means for displacing the expansion device by pressurizing the annular region;
wherein a slip joint is coupled to, and axially positioned above, the expansion device.

38. The apparatus of claim 37, further comprising:
means for pressurizing the interior of the tubular liner.

39. An apparatus for radially expanding an overlapping joint between first and second tubular members, comprising:
a tubular support including first and second passages;
a sealing member coupled to the tubular support;
a slip joint coupled to the tubular support including a third passage fluidicly coupled to the second passage; and
an expansion device coupled to the slip joint including a fourth passage fluidicly coupled to the third passage;
wherein the slip joint is axially positioned between the tubular support and the expansion devices;
wherein the slip joint limits displacement of the expansion device relative to the tubular support in the longitudinal direction; and
wherein the expansion device comprises a cone.

40. A method of radially expanding an overlapping joint between first and second tubular members, comprising:
positioning an expansion device within the first tubular member above the overlapping joint;
sealing off an annular region within the first tubular member above the expansion device;
displacing the expansion device by pressurizing the annular region; and
removing fluidic materials displaced by the expansion device from the second tubular member;
wherein the expansion device comprises a slip joint.

41. The method of claim 40, further comprising:
supporting the expansion device during the displacement of the expansion device.

42. An apparatus for radially expanding an overlapping joint between first and second tubular members, comprising:
means for positioning an expansion device within the first tubular member above the overlapping joint;
means for sealing off an annular region within the first tubular member above the expansion device;
means for displacing the expansion device by pressurizing the annular region;
and means for removing fluidic materials displaced by the expansion device from the second tubular member;
wherein a slip joint means is coupled to the expansion device and is adapted to be axially spaced from the expansion device.

43. The apparatus of claim 42, further comprising:
means for supporting the expansion device during the displacement of the expansion device.

44. An apparatus for radially expanding an overlapping joint between first and second tubular members, comprising:
a tubular support including a first passage;
a sealing member coupled to the tubular support;
a releasable latching member coupled to the tubular support; and
an expansion device releasably coupled to the releasable latching member including a second passage fluidicly coupled to the first passage;
wherein the expansion device comprises a slip joint.

45. A method of radially expanding an overlapping joint between first and second tubular members, comprising:
positioning an expansion device within the first tubular member above the overlapping joint;
sealing off a region within the first tubular member above the expansion device;
releasing the expansion device; and
displacing the expansion device by pressurizing the annular region;
wherein the expansion device comprises a slip joint.

46. The method of claim 45, further comprising:
pressurizing the interior of the second tubular member.

47. An apparatus for radially expanding an overlapping joint between first and second tubular members, comprising:

means for positioning an expansion device within the first tubular member above the overlapping joint;

means for sealing off a region within the first tubular member above the expansion device;

means for releasing the expansion device; and means for displacing the expansion device by pressurizing the annular region;

wherein a slip joint means is coupled to the expansion device and is adapted to be axially spaced from the expansion device.

48. The apparatus of claim 47, further comprising:

means for pressurizing the interior of the second tubular member.

* * * * *